US008170457B2

(12) United States Patent
Aoyama et al.

(10) Patent No.: US 8,170,457 B2
(45) Date of Patent: May 1, 2012

(54) FIXING DEVICE AND IMAGE FORMING APPARATUS

(75) Inventors: Yuichi Aoyama, Kanagawa (JP); Yasuo Katano, Kanagawa (JP); Yukimichi Someya, Saitama (JP); Takuma Nakamura, Kanagawa (JP); Tetsurou Sasamoto, Kanagawa (JP); Shunichi Abe, Kanagawa (JP); Masafumi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 12/779,432

(22) Filed: May 13, 2010

(65) Prior Publication Data

US 2011/0008081 A1 Jan. 13, 2011

(30) Foreign Application Priority Data

Jul. 9, 2009 (JP) ..... 2009-162607
Feb. 17, 2010 (JP) ..... 2010-032371

(51) Int. Cl.
*G03G 15/20* (2006.01)

(52) U.S. Cl. ..... 399/327; 399/343; 399/350

(58) Field of Classification Search ..... 399/107, 399/110, 111, 123, 320, 326, 327, 343, 350–352
See application file for complete search history.

(56) References Cited

U.S. PATENT DOCUMENTS 4,108,546 A 8/1978 Rezanka
5,327,203 A * 7/1994 Rasch et al. ..... 399/326
5,424,819 A 6/1995 Menjo
5,797,063 A * 8/1998 Umezawa et al. ..... 399/34
5,918,544 A * 7/1999 Doyle ..... 101/424
7,383,007 B2 * 6/2008 Yamada et al. ..... 399/327

FOREIGN PATENT DOCUMENTS

| | | |
|---|---|---|
| JP | 59-119364 | 7/1984 |
| JP | 9-106210 | 4/1997 |
| JP | 3290513 | 3/2002 |
| JP | 2003-5562 | 1/2003 |
| JP | 2003-76195 | 3/2003 |
| JP | 2004-109747 | 4/2004 |
| JP | 2004-109749 | 4/2004 |
| JP | 2007-219105 | 8/2007 |
| JP | 2009-37078 | 2/2009 |
| WO | WO 2009/142252 A1 | 11/2009 |

OTHER PUBLICATIONS

Extended Search Report issued Oct. 20, 2010 in European Application No. 10165030.7.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A disclosed cleaning device for removing adhering matter from a surface of a member subject to cleaning includes a belt-shaped film member arranged in a stretched configuration capable of being wound or endlessly move in a direction opposite to a surface movement direction of the member subject to cleaning while being in contact with the surface of the member subject to cleaning, and a cleaning blade configured to abut on the surface of the member subject to cleaning via the belt-shaped film member at a position where the belt-shaped film member is brought into contact with the member subject to cleaning.

11 Claims, 24 Drawing Sheets

FIXING DEVICE AND IMAGE FORMING APPARATUS

BACKGROUND OF THE INVENTION

1. Field of the Invention

The invention relates to a cleaning device for use in an image forming apparatus, such as a copier, a printer and a facsimile machine, a fixing device having such a cleaning device, and an image forming apparatus having such a fixing device.

2. Description of the Related Art

Image forming apparatuses, such as a copier, a printer, and a facsimile machine typically form an image having a character, a symbol or the like on a recording medium such as a piece of paper, cloth, or OHP sheet on the basis of image information. An image forming apparatus of an electrophotographic system has been widely used in offices because it is capable of recording a high-resolution image on a piece of plain paper at high velocity. In the image forming apparatuses of the electrophotographic system, it is mainstream to adopt a thermal fixing type fixing device to heat and soften a toner formed on a recording medium, and then pressurize the softened toner, thereby fixing the toner forming image information onto a recording medium. The thermal fixing type fixing device can fix images at a high fixing velocity and provide a high fixed image quality, and therefore, it is preferably employed in the image forming apparatuses.

However, in such an image forming apparatus having the thermal fixing type fixing device, approximately half or more of the electricity is consumed for heating a toner. Therefore, an image forming apparatus having fixing device capable of being operated with low power consumption (energy conservation) is desired from the aspect of recent environmental issues. Accordingly, it is desirable to save energy in the above related art image forming apparatus having the thermal fixing type fixing device that consumes half or more of the electricity. Since the related art thermal fixing type fixing device has a disadvantage of consuming half or more of the electricity for heating a toner, a fixing device that can enormously lower the heating temperature for the fixing process more than ever or that does not require the heating process at all is desired. Specifically, from the aspect of low power consumption, it is ideal that the image forming apparatus has a nonthermal fixing type fixing device that fixes a toner onto a recording medium without heating the toner. As such a nonthermal fixing type fixing device, there is a so-called wet fixing type or chemical fixing type image forming apparatus, which applies a fixer containing a solvent for softening, dissolving, or swelling resin particles that compose a toner to a toner image, thereby fixing the toner image onto a recording medium. Examples of the nonthermal fixing type fixing device are disclosed in Japanese Patent No. 3290513, Japanese Patent Application Publication No. 2004-109749, Japanese Patent Application Publication No. 59-119364, and Japanese Patent Application Publication No. 2004-109747. Since such a wet fixing type fixing device does not require the heating process, which involves significant electric power consumption as with the thermal fixing type fixing device, this wet fixing type fixing device can be said to be excellent in terms of an energy-saving strategy.

The nonthermal fixing type fixing devices disclosed in the above Japanese Patent and Japanese Patent Application Publications are configured such that the fixer in a liquid form is applied to an unfixed toner image on the recording medium using an application roller that is a contact-type fixer application device. In such a nonthermal fixing type fixing device by which the fixer in a liquid form is applied to the toner image to fix the toner image on the recording medium, there arises a problem. That is, with the nonthermal fixing type fixing device, it is difficult to prevent a toner offset (i.e., toner on the recording medium is transferred to an application roller) and to apply a small amount of fixer on the toner image on the recording medium at the same time. Such difficulties are described below.

In the nonthermal fixing type fixing device by which the fixer in a liquid form is applied to an unfixed toner image on the recording medium using the application roller, there arise some difficulties in applying a small amount of fixer to the toner image on the recording medium under different conditions. When thickness of a fixer layer applied on the application roller is made smaller than that of an unfixed toner image layer on the recording medium, the following phenomenon is observed. Toner particles of the toner image layer on the recording medium are attracted to the surface of the application roller due to the surface tension of a liquid film formed of the fixer on the application roller. This fixer on the application roller is one that is not applied to the recording medium but remains on the surface of the application roller at a position where the surface of the application roller is, after once having been brought into contact with the recording medium, about to separate from the recording medium. Accordingly, the toner image on the recording medium is, after having separated from the application roller, extremely degraded due to the toner particles attracted from the recording medium that are attached to the application roller (i.e., toner offset). The toner particles attached to the application roller could, otherwise have formed part of the toner image.

In contrast, when the thickness of a fixer layer applied on the application roller is made sufficiently larger than that of an unfixed toner image layer on the recording medium, the surface tension of the liquid film of the fixer on the application roller rarely acts on the toner particles of the toner image layer on the recording medium due to too much amount of the liquid fixer at a position where the surface of the application roller is about to separate from the recording medium. In this case, although little toner is attached to the application roller, a large amount of fixer is applied on the surface of the recording medium. This results in image quality degradation due to the runoff of toner particles of the fixer attracted by the large amount of the liquid fixer applied to the toner image on the recording medium, or due to low fixing responsiveness resulting from a long drying time of the liquid fixer. Further, when touching the recording medium (i.e., paper), a user may feel a significant sense of residual liquid (i.e., wetness) in his or her hand. If a large amount of fixer containing water is applied on the recording medium containing cellulose such as paper, the recording medium such as paper is significantly curled, which may cause paper jamming when transferring paper as a recording medium inside an apparatus such as an image forming apparatus. As described above, in the nonthermal fixing type fixing device by which the liquid fixer is applied to an unfixed toner image on the recording medium using the application roller, too much the liquid fixer application may cause the image quality deterioration due to the runoff of toner particles of the fixer, the low fixing responsiveness due to a long drying time of the liquid fixer, and the paper jamming inside the apparatus. If, on the other hand, a small amount of liquid fixer application may result in the toner offset (toner particle offset), that is, the toner particles are attracted and thus attached to the surface of the application roller as described above. Accordingly, it is difficult to prevent toner particles from attaching to the application roller (toner particle offset), and to apply a small amount of liquid fixer on the toner layer on the recording medium at the same time, in order to improve the fixing responsiveness and prevent the recording medium from curling or wetness.

As a fixing device capable of preventing the toner offset while applying a small amount of the liquid fixer on the toner image on the recording medium, Japanese Patent Application Publication No. 2007-219105 discloses a technology in which a foamed fixer obtained by dispersing air bubbles in a liquid fixer is applied on a toner image on a recording medium. The fixer in a foam has low density, and hence, the foamed fixer can form a thicker film thickness on the application roller with a smaller amount of fixer than that of the liquid fixer used in the above other four related art technologies. As a result, the foamed fixer can reduce an adverse effect of attracting the toner particles due to the surface tension of the fixer. Since the small amount of fixer is used to make the foamed fixer, the user's sense of residual liquid felt on the recording medium can be suppressed. Moreover, since the foamed fixer is less liable to the runoff than the normal fixer in a liquid form, image degradation due to the runoff of toner particles of the liquid fixer may be prevented. Thus, the technology, in which an image is fixed with the foamed fixer disclosed in Japanese Patent Application Publication No. 2007-219105, is capable of fixing the image without degrading the toner image using a smaller amount of fixer than the amounts used in the above described other four related art technologies.

In the technology disclosed in Japanese Patent Application Publication No. 2007-219105, an application member such as the application roller is used in applying foamed fixer onto the recording medium. In this case, it is preferable to further provide an application member-cleaning device to clean the application member after having applied the foamed fixer on the recording medium. Specifically, residual foamed fixer that would have otherwise been applied on the recording medium remains attached to the application member after the application member has passed through the position where the foamed fixer is applied on the recording medium, and the application member-cleaning device may preferably be provided to collect the residual foamed fixer. Since the residual foamed fixer remaining on the application member typically loses part of the foam over time and due to the mechanical force applied on the foam at the application position, the residual foamed fixer has higher density than the foamed fixer at the time it is just applied on the application member. If new foamed fixer is applied on the application member on which the residual foamed fixer still remains, the foamed fixers having different densities are mixed and applied on the recording medium. As a result, the mixed foamed fixers may not be uniformly applied on the recording medium. Further, despite the fact that in the technology using the foamed fixer, the amount of offset toner attached to the application member is smaller than the amount of offset toner on the application roller in the technologies using the liquid fixer, the offset toner is still attached to the application member to be transferred on the recording medium, which results in the degradation of the image. Accordingly, it is preferable to add the application member-cleaning device to remove the residual foamed fixer from the surface of the application member in order to prevent non-uniform application of the foamed fixer on the recording medium and offset toner transferred on the recording medium.

However, the inventors of the present application have found that in a case where a cleaning blade is provided as a removal unit of the application member-cleaning device to remove the residual foamed fixer containing the offset toner obtained, when cleaning, from the surface of the application member, the following drawback may be observed. That is, when the cleaning blade abuts on the surface of the application member, the residual foamed fixer containing the offset toner is blocked to be accumulated at a position where the cleaning blade and the application member abut (i.e., the starting point of abutting) on an upper side of the application member on which the cleaning blade moves to an abutting position. The offset toner is softened with the fixer applied by the application member during image forming operations; however, if the offset toner with the fixer that is left for a substantial amount of time after the image forming operation is deactivated, the offset toner with the fixer solidifies into solid resin. The solidified resin sticks on the cleaning blade and the surface of the application member. If the image forming operation is activated again in the above state, the crushed products may be introduced in the abutting position between the cleaning blade and the application member, thereby damaging the surfaces of the cleaning blade and application member. Thus, the damages on the surfaces of the cleaning blade and the application member result in a defective cleaning of the application member.

Such a drawback not only occurs in the configuration in which the foamed fixer applied on the surface of the application member is applied finally to the recording medium but may also occur in the configuration in which the foamed fixer applied on the surface of the application member is applied to an intermediate toner carriers such as an intermediate transfer member. Further, similar problems may occur in a case where the liquid fixer is applied in place of the foamed fixer. Note that the above drawback is likely to occur in cleaning devices when adhering matter subject to removal or cleaning is the fixer containing the residual toner, in the similar manner as the above described application member-cleaning device in which the toner once softened with the fixer solidifies over time. Further, the similar drawback may be observed in a case where adhering matter subject to removal from a surface of the member subject to cleaning contains materials other than toner. For example, in a case where adhering matter subject to removal or cleaning is the offset toner particles attached to the thermal fixing device in the cleaning device, or the adhering matter subject to removal or cleaning is the residual fixer containing toner particles transferred from the toner carrier in the cleaning device, solidified products may adhere on the member subject to cleaning for some reasons. If the solidified products continuously remain in the abutting position between the member subject to cleaning and the cleaning blade, the surface of the member subject to cleaning may be damaged. Thus, in the cleaning device having the cleaning blade configured to abut on the surface of the member subject to cleaning, if the adhering matter subject to removal or cleaning accumulates at the abutting position between the cleaning blade and the member subject to cleaning, the surface of the member subject to cleaning may be damaged due to the solidified adhering matter. Thus, the damages on the surfaces of the cleaning blade and the member subject to cleaning result in a defective cleaning of the application member.

SUMMARY OF THE INVENTION

It is a general object of at least one embodiment of the present invention to provide a cleaning device capable of removing an adhering matter on a surface of a member subject to cleaning for a long time, a fixing device having the cleaning device, and an image forming apparatus having the fixing device that substantially eliminates one or more problems caused by the limitations and disadvantages of the related art.

According to an embodiment, there is provided a cleaning device for removing adhering matter from a surface of a member subject to cleaning. The cleaning device for removing adhering matter from a surface of a member subject to cleaning, the cleaning device includes a belt-shaped film member arranged in a stretched configuration capable of being wound or endlessly move in a direction opposite to a surface movement direction of the member subject to cleaning while being in contact with the surface of the member subject to cleaning, and a cleaning blade configured to abut on the surface of the member subject to cleaning via the belt-shaped film member at a position where the belt-shaped film member is brought into contact with the member subject to cleaning.

According to another embodiment, there is provided a fixing device that includes a fixer foaming unit configured to generate a foamed fixer by dispersing bubbles in the liquid fixer containing a softener to soften resin particulates by dissolving or swelling at least part of resin in the resin particulates; a foamed fixer application unit configured to include a surface moving member carrying the foamed fixer and apply the foamed fixer on a surface of a recording medium on which a resin particulate layer formed of the resin particulates is carried so as to soften the resin particulates to be fixed thereon; and the above cleaning device as a cleaning unit configured to clean a portion of the foamed fixer generated by the fixer foaming unit that is not applied on the surface of the recording medium but remains on the surface moving member.

According to still another embodiment, there is provided an image forming apparatus that includes a toner image forming unit configured to form a toner image on a recording medium with toner containing resin particulates composed of resin and colorants; and the above fixing device as a fixing unit configured to apply a foamed fixer on a surface of a toner image carrier carrying the toner image to be transferred on the recording medium or a surface of the recording medium carrying the toner image so as to fix the toner image on the recording medium.

Other objects and further features of embodiments will be apparent from the following detailed description when read in conjunction with the accompanying drawings.

DESCRIPTION OF THE PREFERRED EMBODIMENTS

In the following, embodiments for carrying out the present invention will be described by referring to the accompanying drawings.

Below, an electrophotographic printer (hereinafter, simply called a "printer 100") is described as an image forming apparatus to which an embodiment of the invention is applied.

Figure 2:
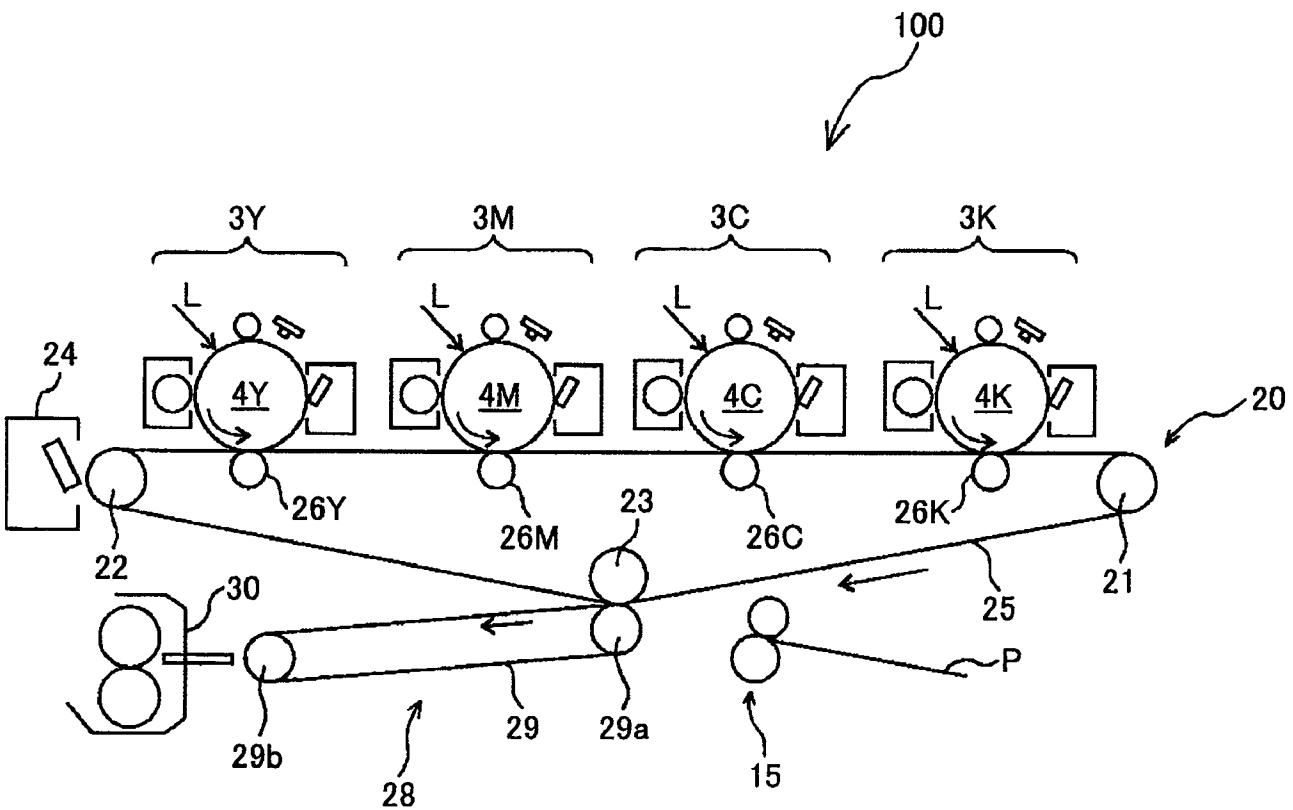
FIG. 2 is a schematic configuration view illustrating main components of a printer according to an embodiment of the invention.
Figure 3:
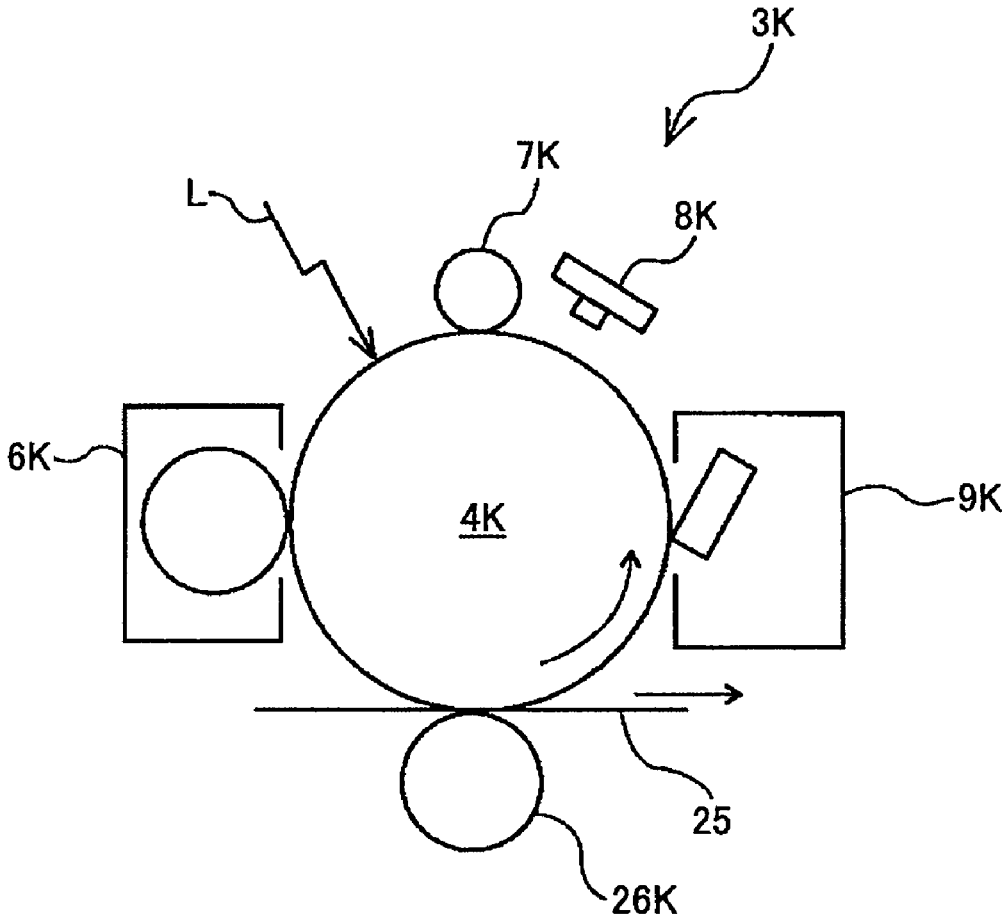
FIG. 3 is an enlarged configuration view illustrating a K process unit of the printer according to the embodiment of the invention.

First, a basic configuration of the printer 100 according to the embodiment is described. FIG. 2 is a schematic configuration view illustrating main components of the printer 100. As illustrated in FIG. 2, the printer 100 includes four process units 3Y, 3M, 3C, and 3K to form a toner image in colors of yellow (Y), magenta (M), cyan (C), and black (K), a transfer unit 20, a sheet-feeding unit 28, a resist roller pair 15, a fixing device 30, and an optical writing device (not shown).

The optical writing device (not shown) drives a light source such as a laser diode or a light emitting diode (i.e., LED) to expose photoreceptors 4Y, 4M, 4C, and 4K in the process units 3Y, 3M, 3C, and 3K to a laser beam L. Upon the application of the laser beam, an electrostatic latent image is formed on surfaces of the photoreceptors 4Y, 4M, 4C, and 4K, which eventually form a toner image via certain development processes. Note that "Y", "M", "C", and "K" given to ends of the reference numerals represent photoreceptors tailored for colors of yellow, magenta, cyan, and black, respectively.

The process units 3Y, 3M, 3C, and 3K include the respective photoreceptors 4Y, 4M, 4C, and 4K of electrostatic latent carriers, and respective peripheral components, and are detachably arranged in the printer 100. For example, the process unit 3K includes the photoreceptor 4K, a development device 6K, a charging device 7K, a static eliminator lamp 8K, and a drum cleaning device 9K.

The photoreceptor 4K is a drum shaped aluminum tube on which a photoreceptive layer is formed by the application of an organic photoreceptive material. The photoreceptor 4K may be an endless belt-shaped member.

The development device 6K is a two-component development type in which the electrostatic latent image is developed with a two-component developer containing a magnetic carrier and non-magnetic toner to thereby form the toner image. The development device 6K may alternatively be a one-component development type in which the electrostatic latent image is developed with a one-component developer without containing the magnetic carrier. A K toner image developed on the photoreceptor 4K is primarily transferred on an intermediate transfer belt 25 at a later-described primary transfer nip.

The photoreceptor 4K obtains, when having passed through the primary transfer nip, a residual transfer toner on the surface thereof, and the drum cleaning device 9K removes the residual transfer toner from the surface of the photoreceptor 4K. FIG. 2 illustrates the drum cleaning device 9K having a configuration in which a cleaning blade made of polyurethane rubber removes the residual transfer toner from the surface of the photoreceptor 4K; however, the drum cleaning device 9K may include other configurations to remove the residual toner.

The static eliminator lamp 8K eliminates static electricity from the photoreceptor 4K by exposure to light. The neutralized surface of the photoreceptor 4K is uniformly charged by the charging device 7 so that the surface of the photoreceptor 4K is initialized. The charging device 7K is configured to include a charging roller in which a charge bias is applied and charges the photoreceptor 4K by abutting the charging roller to the photoreceptor 4K; however, the charging device 7K may be configured to charge the photoreceptor 4K by a scorotron charger that can charge the photoreceptor 4 without being in contact with the photoreceptor 4.

Accordingly, Y, M, C, and K toner images are formed on the photoreceptors 4Y, 4M, 4C, and 4K in the process units 3Y, 3M, 3C, and 3K. The transfer unit 20 is provided below the process units 3Y, 3M, 3C, and 3K. In the transfer unit 20, the primary transfer nips Y, M, C, and K are formed by abutting the intermediate transfer belt 25 stretched by plural rollers (21, 22, and 23) to the photoreceptors 4Y, 4M, 4C, and 4K. The intermediate transfer belt 25 endlessly moves in a clockwise direction by rotationally driving a driving roller 21.

The primary transfer rollers 26Y, 26M, 26C, and 26K provided inside a belt loop of the intermediate transfer belt 25 presses the intermediate transfer belt 25 on the photoreceptors 4Y, 4M, 4C, and 4K near the primary transfer nips Y, M, C, and K. Primary transfer bias is applied to the primary transfer rollers 26Y, 26M, 26C, and 26K by unshown respective power sources. Accordingly, a primary transfer electric field is formed over the primary transfer nips Y, M, C, and K to electrostatically move the toner images on the photoreceptors 4Y, 4M, 4C, and 4K to the intermediate transfer belt 25. The respective toner images are sequentially superimposed (i.e., primary image transfer) on the surface of the intermediate transfer belt 25 at the respective primary transfer nips Y, M, C, and K while the intermediate transfer belt 25 endlessly moves in the clockwise direction to pass through the respective primary transfer nips Y, M, C, and K. A toner image composed of four color images (hereinafter called a "4-color toner image") is formed on the surface of the intermediate transfer belt 25 by the primary image transfer.

The sheet-feeding unit 28, in which an endless sheet-feeding belt 29 is looped over a driving roller 29*b* and a secondary transfer roller 29*a* to endlessly move, is provided below the transfer unit 20. The sheet-feeding belt 29 is sandwiched between the secondary transfer roller 29*a* of the sheet-feeding unit 28 and the intermediate transfer belt 25 of the transfer unit 20. A secondary transfer nip is formed by abutting the surface of the intermediate transfer belt 25 on the surface of the sheet-feeding belt 29.

Secondary transfer bias is applied to the secondary transfer roller 29*a* of the sheet-transfer unit 28 by an unshown power source. In the transfer unit 20, a transfer backup roller 23 over which the intermediate transfer belt 25 is looped is ground. A secondary transfer electric field is formed over the secondary transfer nip.

As illustrated in FIG. 2, the resist roller pair 15 is arranged on the right-hand side of the secondary transfer nip so that a transfer sheet P sandwiched between the resist roller pair 15 is fed to the secondary transfer nip in synchronization with the four color toner image on the intermediate transfer belt 25. In the secondary transfer nip, the four color toner image is secondarily transferred on the transfer sheet P having a white color at once due to effects of the secondary transfer field and a nip pressure, thereby, forming a full color image based on the white color of the transfer sheet P. Having passed through the secondary transfer nip, the transfer sheet P is transferred away from the intermediate transfer belt 25 to a fixing device 30 (not shown) based on the endless moving of the intermediate transfer belt 25 while the surface of the transfer sheet P is kept in an upward direction.

A residual toner that fails to be transferred on the transfer sheet P at the secondary nip adheres on the surface of the intermediate transfer belt 25 that has passed through the secondary transfer nip. The residual toner is removed by a belt cleaning device 24 located adjacent to the intermediate transfer belt 25.

Figure 4:
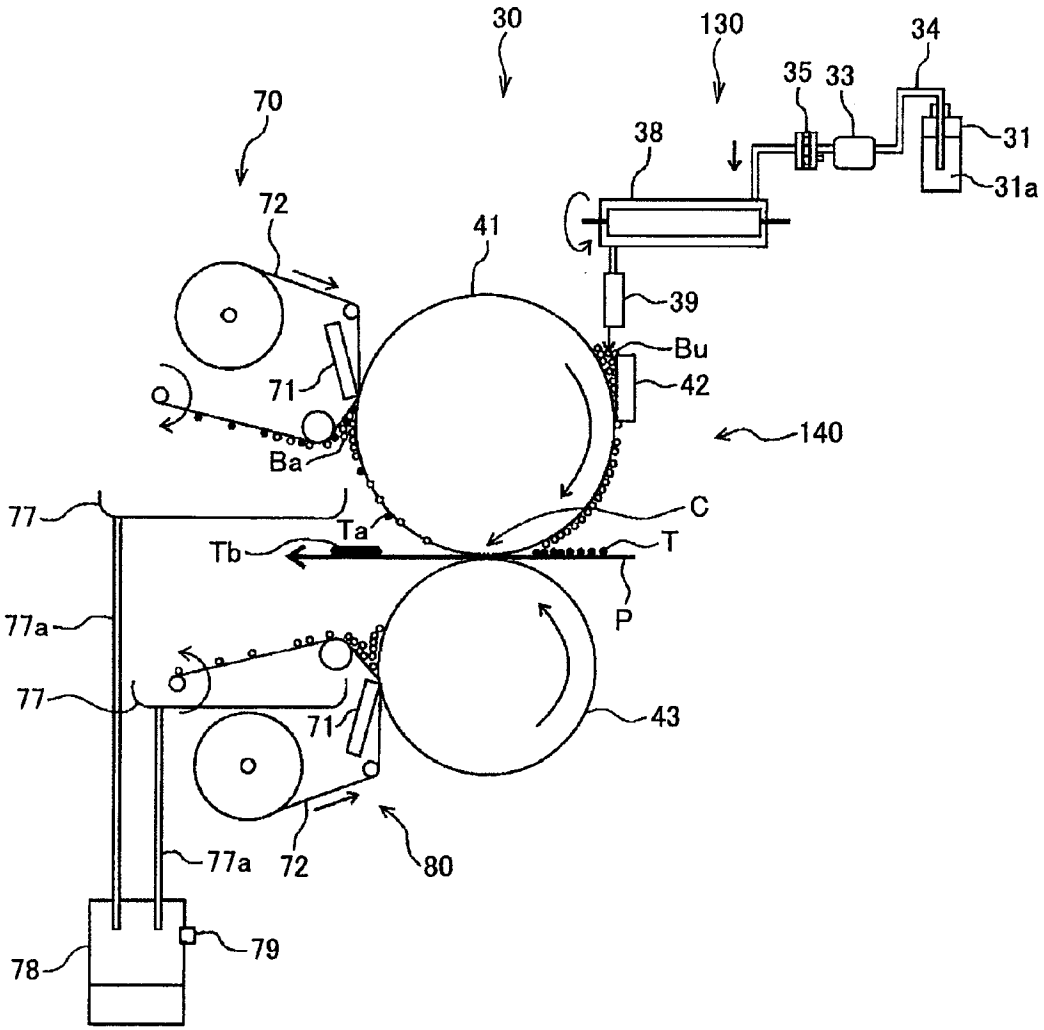
FIG. 4 is an enlarged configuration view illustrating a fixing device of the printer according to the embodiment of the invention.

FIG. 4 is an enlarged configuration view illustrating the fixing device 30 according to the embodiment of the invention. The fixing device 30 includes a fixer application unit 140 configured to apply a fixer to the transfer sheet P and a fixer supply unit 130. The fixer application unit 140 includes an application roller 41, a pressure roller 43, an application member cleaning device 70, and a pressure member cleaning device 80.

Figure 5:
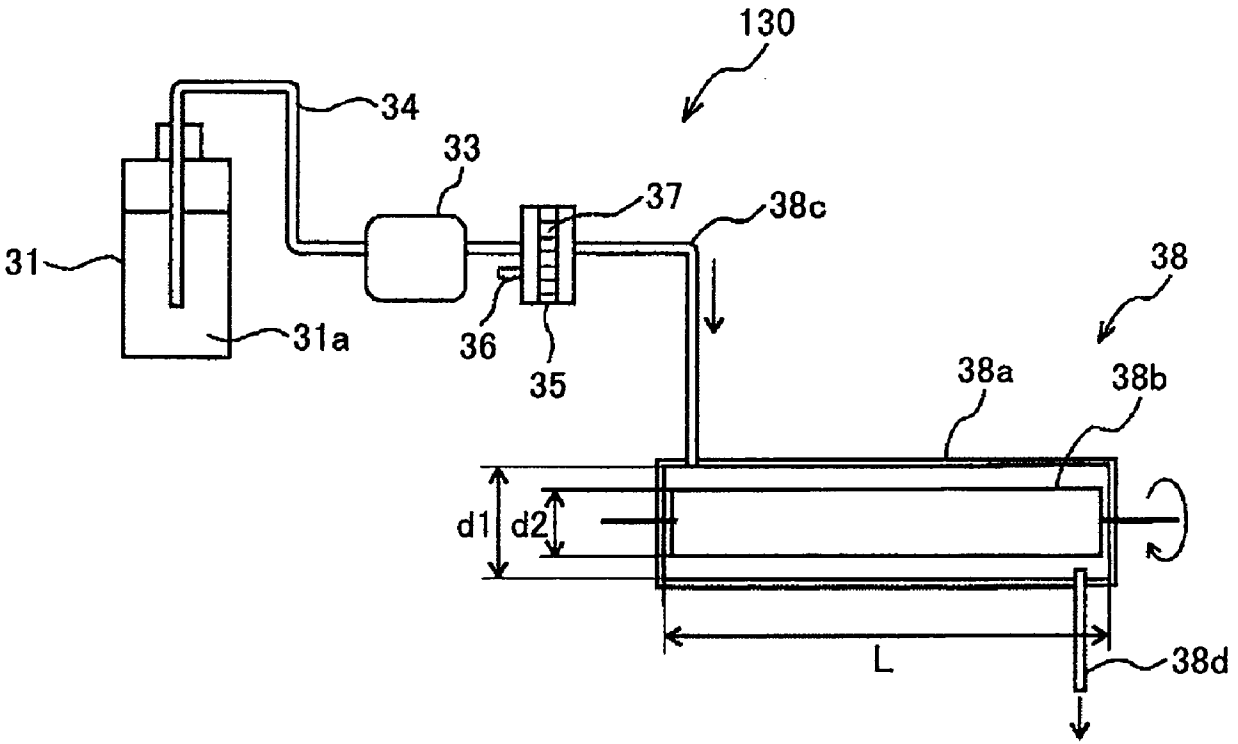
FIG. 5 is an enlarged configuration view illustrating a fixer supply unit of the fixing device.

FIG. 5 is an enlarged configuration view illustrating the fixer supply unit 130 of the fixing device 30. The fixer supply unit 130 foams a liquid fixer 31*a* contained in the fixer container 31 to produce a foamed fixer Bu, and supplies the obtained foamed fixer Bu to the application roller 41. Specifically, the fixer supply unit 130 includes a fixer conveying unit having a transfer pump 33 and a liquid transfer pipe 34, and transfers the liquid fixer 31*a* contained in the fixer container 31 to a air-liquid mixer 35 via the fixer conveying unit.

Examples of the transfer pump 33 include a gear pump, a bellows pump, and a tube pump, and the tube pump is preferable among these. The gear pump includes a drive mechanism that is driven inside the liquid fixer, which may accidentally foam the liquid fixer inside the pump to compress the liquid fixer, thereby lowering a transfer capability. The gear pump may contaminate the liquid fixer due to materials of the drive mechanism inside the gear pump, or the liquid fixer may deteriorate the drive mechanism. The tube pump, on the other hand, includes no such mechanism that is driven inside the liquid fixer, and is configured to push out the liquid inside the tube while deforming the tube to cause the above contamination and deterioration.

The air-liquid mixer 35 introduces air from an air inlet 36 to mix it with the liquid fixer 31*a* pumped via the transfer pump 33, and the obtained mixture is passed through a micro-porous sheet 37, thereby, foaming the liquid fixer. The pore size of the micro-porous sheet 37 is, for example, within a range of 30 to 100 μm. Sintered ceramics formed of a porous material having a continuous open-cell structure, nonwoven fabric, or a foamed resin sheet may be used in place of the micro-porous sheet 37. Alternatively, the air-liquid mixer 35 may include a blade-shaped stirrer to mix the liquid fixer 31*a* with air introduced from the air inlet 36 while stirring the mixture by the blade-shaped stirrer to generate bubbles in the liquid fixer.

The air-liquid mixer 35 may be either of the above configurations to produce the foamed fixer Bu having a relatively large bubble size of 0.5 to 1 mm in an extremely short time. However, it is preferable that the foamed fixer be made as small as possible for fixing the toner. The printer 100 according to the embodiment is provided with a micro-bubble generator 38 to make relatively large bubbles of the foamed fixer Bu obtained from the air-liquid mixer 35 into micro-bubbles thereof.

The foamed fixer Bu having the relatively large bubbles generated by the air-liquid mixer 35 is supplied via a foam transfer pipe 38*c* to the micro-bubble generator 38. The micro-bubble generator 38 makes the relatively large bubbles into small bubbles by applying shearing force to the bubbles of the foamed fixer Bu. The micro-bubble generator 38 has a bicylindrical structure and includes an outer cylinder 38*a* and an inner cylinder 38*b*. The shear force is applied to the bubbles of the foamed fixer Bu by causing the foamed fixer Bu to pass through a gap between the static outer cylinder 38*a* and the rotational inner cylinder 38*b*. The applied shear force causes the foamed fixer Bu to be discharged from a foam outlet 38*d* of the outer cylinder 38*a* to a nozzle 39 while cutting the large bubbles into small bubbles.

Note that it is preferable that a liquid transfer velocity be determined based on the number of revolutions of the rotational inner cylinder 38*b* or the length of the inner cylinder 38*b* in an axis direction. For example, if an inner diameter of the outer cylinder 38*a* is d1 mm, the length of the inner cylinder 38*b* in the axis direction is L mm, an outer diameter of the inner cylinder 38*b* is d2 mm, and the number of revolutions is R rpm, the liquid transfer velocity V is obtained by the following equation: $V\ [mm^3/sec.]=L*\pi*(d12-d22)/4/(100/R)$ For example, if d1 is 10 mm, d2 is 8 mm, L is 50 mm, and R is 1000 rpm, the liquid transfer velocity V is approximately 1400 $mm^3$/sec. (1.4 cc/sec.). If the amount of the foamed fixer required for fixing the toner on an A-size transfer sheet P is 3 cc, generating the required amount of the foamed fixer Bu takes approximately 2 seconds. Accordingly, it is possible to quickly generate the foamed fixer with a desired bubble size. The inner cylinder 38*b* may be provided with a spiral groove to improve the transferability inside the outer cylinder 38*a*.

As described above, the air-liquid mixer 35 to generate the foamed fixer Bu having relatively large bubbles from the liquid fixer 31*a* is combined with the micro-bubble generator 38 to make the large bubbles into small bubbles by the application of shear force, so as to generate the foamed fixer Bu having small bubbles with a bubble size range of 5 to 50 μm from the liquid fixer 31*a* in an extremely short time.

Note that the density of the foamed fixer Bu may preferably be in a range of 0.01 to 0.1 $g/cm^3$. Note also that the fixer is made in a foam only when it is applied on the resin containing particle layer such as a toner layer on the transfer sheet P, and the fixer in the fixer container 31 may not need to be made in a foam. The fixer in the fixer container 31 is stored in a liquid form that does not contain bubbles, and is only made in a foam when the fixer container applies the liquid fixer onto the resin-containing organic particle layer, or when the fixer is transferred in a liquid transfer path for applying the fixer on the resin-containing organic particle layer. With the fixer in foam, the transfer volume or the storage volume of the fixer is reduced, thereby lowering the transfer cost or the storage cost.

Figure 6:
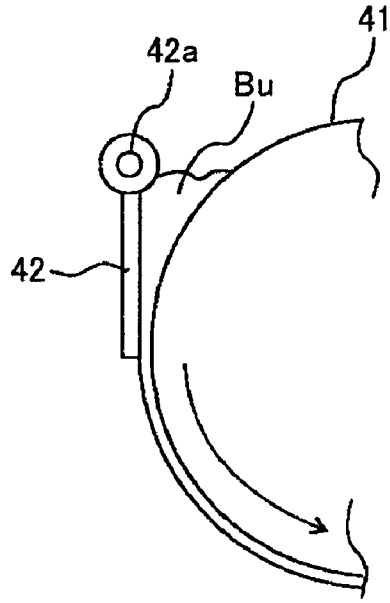
FIG. 6 is an enlarged schematic configuration view illustrating a thickness adjusting blade and an application roller of the fixing device.
Figure 7:
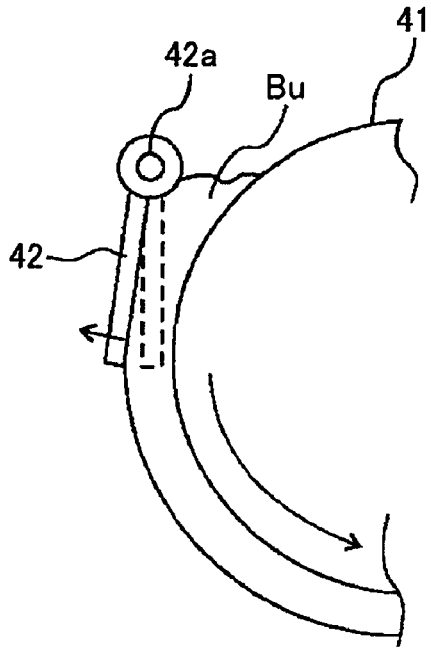
FIG. 7 is an enlarged schematic configuration view illustrating a thickness adjusting blade and an application roller of the fixing device having a wider thickness adjusting gap between the thickness adjusting blade and the application roller than that of FIG. 6.

The foamed fixer Bu having micro-bubbles generated from the micro-bubble generator 38 is passed through the nozzle 39 and applied on the surface of the application roller 41 as illustrated in FIG. 4. The film thickness of the applied foamed fixer Bu on the surface of the application roller 41 is adjusted by a thickness adjusting blade 42 an edge of which is arranged to face the surface of the application roller 21 via a predetermined gap. As illustrated in FIGS. 6 and 7, a fixed end of the thickness adjusting blade 42 is supported by a blade rotational shaft 42*a* so that the gap between the application roller 41 and the edge of the thickness adjusting blade 42 can be adjusted by rotating the application roller 4 based on the blade rotational shaft 42*a*. A control unit (not shown) controls the rotation of the thickness adjusting blade 42 driven by the motor to adjust the aforementioned gap. The thickness of the foamed fixer Bu may be made relatively thin as illustrated in FIG. 6, or may be made relatively thick as illustrated in FIG. 7 by adjusting the gap the application roller 41 and the edge of the thickness adjusting blade 42.

Note that a wire bar may alternatively be used for adjusting the thickness of the foamed fixer Bu instead of the thickness adjusting blade 42. As compared with the case of adjusting the thickness of the foamed fixer by the film thickness adjusting blade 42, the film thickness of the foamed fixer Bu applied on the surface of the application roller 41 may be made uniform in the axis direction of the application roller 41.

The pressure roller 43 having an elastic roller abuts on the application roller 41 for applying the foamed fixer Bu on the toner image formed on the transfer sheet P to create an application nip C. The transfer sheet P, which is transferred from the secondary transfer nip to the fixing device 30 on the sheet-transfer belt 29, is sandwiched in the application nip with an image formed surface thereof being directed at the application roller 41. In the application nip C, the foamed fixer Bu on the application roller 41 is applied over the image formed surface of the transfer sheet P.

Next, the fixing principle in the fixing device 30 according to the embodiment is described. In this embodiment, the foamed fixer that contains a softener for softening particles containing the resin is applied over resin particulates on the surface of a material to which the fixer is applied such as a recording medium by dissolving or swelling at least part of the resin. In this manner, the resin particulates on the surface of the recording medium can be softened to be fixed on the recording medium. The resin particulates may not be particularly specified. However, if the embodiment is applied to an image forming apparatus, the resin particulates represent toner particles.

Next, a related art fixing device having a wet fixing type fixing device is described. Japanese Patent No. 3290513 discloses a fixing device having a wet fixing type fixing device using an O/W emulsion type fixer capable of dissolving or swelling toner. The disclosed O/W emulsion type fixer is obtained by dispersing a water insoluble organic compound in water. In the disclosed fixing device, after the fixer is sprayed or applied dropwise over unfixed toner placed in a predetermined area on a surface of a material on which an image is fixed to dissolve or swell the toner in the fixer, the material on which the image is fixed is dried.

The fixing device disclosed in Japanese Patent No. 3290513 employs the O/W emulsion type fixer obtained by dispersing a water insoluble organic compound in water. If a large amount of fixer is applied over the unfixed toner, the recording medium such as a transfer sheet absorbs water in the fixer to make the recording medium creased or curled. Accordingly, stable and fast transfer required for the image forming apparatus may be significantly degraded. However, if a dryer configured to dry water in the fixer applied over the recording medium is provided in the fixing device to overcome this degradation, power consumption of the image forming apparatus may be comparable to an image forming apparatus with a thermal fixing type fixing device.

Japanese Patent Application Publication No. 2004-109749 discloses an example of a fixer that is not repellent to water-repellent toner. Such a fixer includes a material that may dissolve or swell the toner in a lipid solvent. Specifically, the disclosed water-repellent fixer is obtained by dissolving or swelling an aliphatic dibasic acid ester as a component dissolving a resin component of toner in nonvolatile dimethyl silicone as a diluent (solvent). In addition, Japanese Patent Application Publication No. 59-119364 discloses a fixer for fixing an unfixed toner image obtained by mixing 8 to 120 parts by volume of silicone oil with 100 parts by volume of a solvent that dissolves toner which is compatible to silicone oil. With the above fixer, an electrostatically formed unfixed toner image is easily fixed on the recording medium with high definition and without degrading the image. Since such an oil-based fixer includes a lipid solvent having a high affinity for water-repellent unfixed toner, the oil-based fixer is not repellent to the water-repellent unfixed toner. As a result, the oil-based fixer can dissolve or swell the toner so as to fix the toner on the recording medium.

In the related art wet fixing type fixing device, since the fixer is applied in a liquid form over the toner image on the recording medium, it seems difficult to prevent image degradation due to the offset in which the toner on the recording medium is transferred to the application roller, and to apply a small amount of fixer over the toner image on the recording medium at the same time. The difficulty is described below with reference to FIGS. 27 and 28.

Figure 27A:
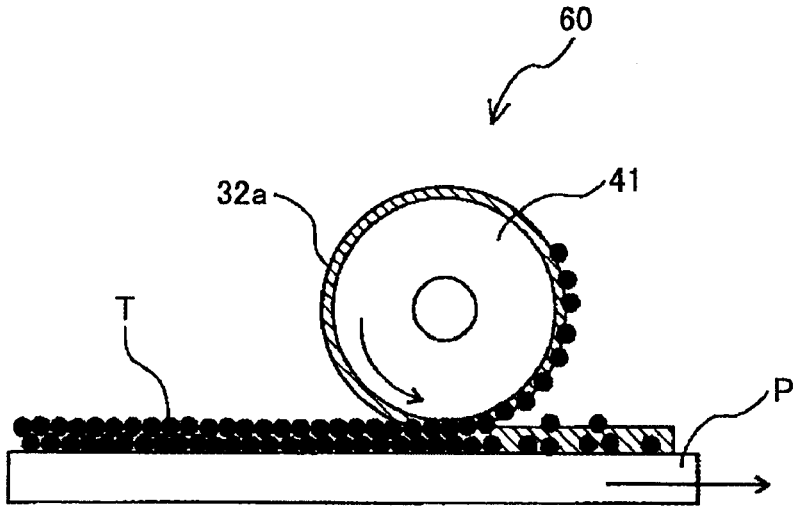
FIG. 27A is a schematic view illustrating a related art fixing device in which a relatively thin fixer layer is applied from an application roller to a transfer sheet.
Figure 27B:
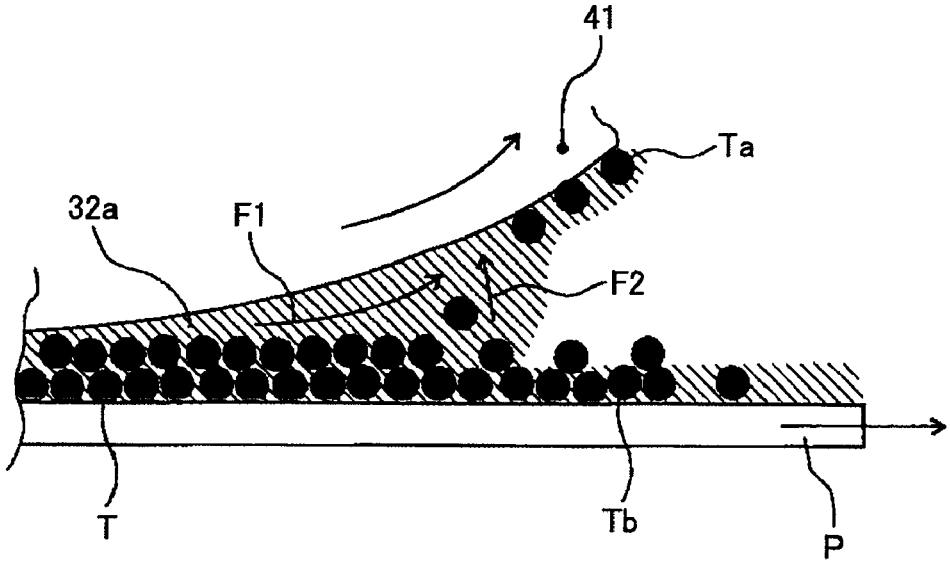
FIG. 27B is an enlarged view specifically illustrating a portion between the application roller and the transfer sheet in the related art fixing device of FIG. 27A.

FIGS. 27A and 27B are views illustrating a fixing device 60 having the related art wet fixing type fixing device in which a liquid fixer is used. FIG. 27A is a schematic view illustrating the fixing device 60 having the related art wet fixing type fixing device in which the liquid fixer is used. FIG. 27B is an enlarged view specifically illustrating a peripheral area of the application roller 41 that applies the liquid fixer 31*a* over the toner image on the transfer sheet P as the recording medium. FIG. 27A illustrates the fixing device having a configuration in which the application roller 41 applies the liquid fixer 31*a* over a unfixed toner layer T on the transfer sheet P. FIG. 27B illustrates a case where the liquid fixer 31*a* applied on the application roller 41 is substantially thinner than the unfixed toner layer T, due to the application of a small amount of the liquid fixer 31*a* on the transfer sheet P. After the application roller 41 has passed through an application position indicated by an arrow F1 in FIG. 27B, a portion of the liquid fixer 31*a* is applied to the transfer sheet P from the application roller 41 at a position where the surface of the application roller 41 abuts on the transfer sheet P as intended, whereas some portion of the liquid fixer 31*a* remains on the surface of the application roller 41. The surface tension (acting in a direction indicated by an arrow F2 in FIG. 27B) of a liquid film of the liquid fixer 31*a* that remains on the surface of the application roller 41 attracts toner particles in the unfixed toner layer T at a position where the application roller 41 is detached from the surface of the transfer sheet P. Accordingly, an image formed of the toner fixed layer Tb on the transfer sheet P is, after having separated from the application roller 41, extremely degraded due to the attracted toner particles Ta attached to the surface of the application roller 41 (i.e., toner particle offset).

Figure 28:
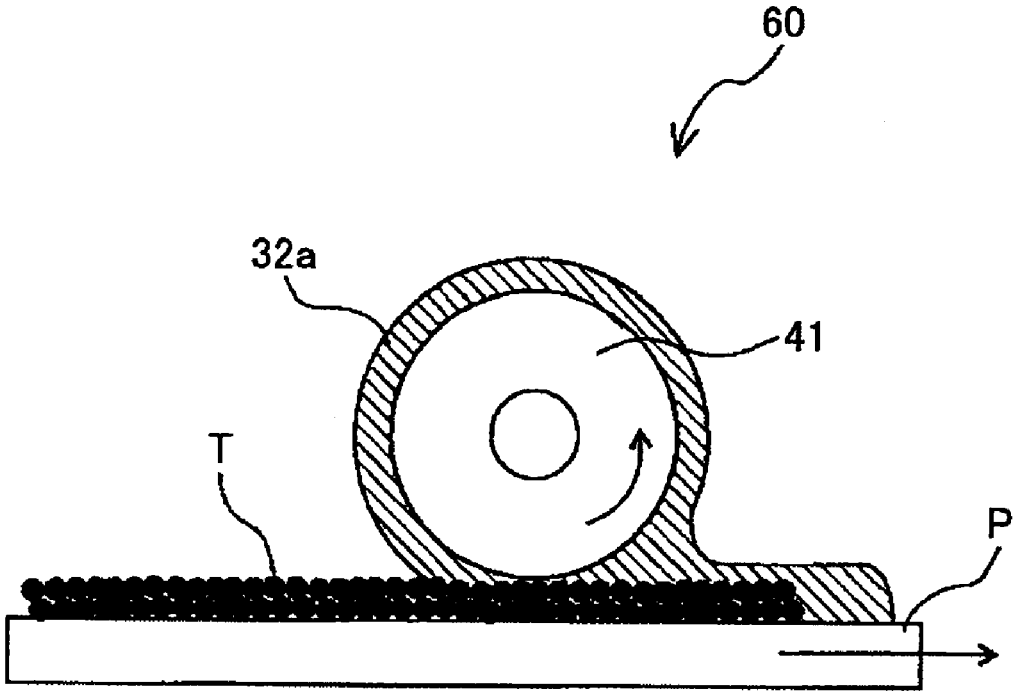
FIG. 28 is an enlarged configuration view illustrating a fixer application portion of the related art fixing device (when a liquid fixer layer applied is relatively thick).

In contrast, FIG. 28 illustrates a case where the liquid fixer 31*a* applied on the application roller 41 is substantially thicker than the unfixed toner layer T. The surface tension of the liquid film of the liquid fixer that remains on the surface of the application roller 41 rarely acts on the toner particles of the unfixed toner layer T on the transfer sheet P at a position where the application roller 41 is detached from the surface of the transfer sheet P. In this case, although little toner is attached to the application roller 41, a large amount of liquid fixer 31*a* is applied on the surface of the transfer sheet P. This results in image quality degradation due to the runoff of toner particles on the transfer sheet P attracted by the large amount of the liquid fixer 31*a* applied to the transfer sheet P, or due to low fixing responsiveness resulting from a long drying time to dry the liquid fixer 31*a* applied on the transfer sheet P. Further, when touching the transfer sheet P, a user may feel a significant sense of residual liquid (i.e., wetness) in his or her hand. Further, if a large amount of liquid fixer 31*a* containing water is applied on the transfer sheet P used as a recording medium containing cellulose such as paper, the transfer sheet such as paper is significantly curled, which may cause paper jamming when transferring the recording medium inside an apparatus such as an image forming apparatus. As described above, in the fixing device having a configuration in which the application roller 41 applies the liquid fixer 31*a* to an unfixed toner image on the transfer sheet P, too much a liquid fixer application may cause the image quality deterioration due to the runoff of toner particles, and the low fixing responsiveness due to a long drying time of the liquid fixer 31*a*. Further, paper jamming may be caused due to a material used as the recording medium. If, on the other hand, a small amount of liquid fixer 31*a* application may result in the toner offset (toner particle offset), that is, the toner particles are attracted and thus attached to the surface of the application roller 41. Accordingly, it is difficult to prevent toner particles from attaching to the application roller 41 (toner particle offset), and to apply a small amount of liquid fixer on the toner layer on the recording medium at the same time, in order to improve the fixing responsiveness and prevent the recording medium from curling or wetness.

As a fixing device capable of preventing the toner offset while applying a small amount of the liquid fixer on the toner image on the recording medium, Japanese Patent Application Publication No. 2007-219105 discloses a technology in which a foamed fixer obtained by dispersing air bubbles in a liquid fixer is applied on a toner image on a recording medium using an application roller. The fixer in foam has low density, and hence, the foamed fixer having a thicker film thickness may be formed on the application roller with a smaller amount of fixer than the amount of the liquid fixer used in the other related art technologies. As a result, the foamed fixer may reduce an adverse effect of attracting the toner particles due to the surface tension of the fixer. Since the small amount of fixer is used to make the foamed fixer, the user's sense of residual liquid felt on the recording medium can be suppressed. Moreover, since the foamed fixer is less liable to the runoff than the normal fixer in a liquid form, image degradation due to the runoff of toner particles of the liquid fixer may be prevented. Thus, the technology, in which an image is fixed with the foamed fixer disclosed in Japanese Patent Application Publication No. 2007-219105, is capable of fixing the image without degrading the toner image using a smaller amount of fixer than used in the above described other four related art technologies. The fixing device 30 according to the embodiment has a configuration similar to the above configuration disclosed in Japanese Patent Application Publication No. 2007-219105, in which the fixer made in a foam is applied over the toner layer on the recording medium.

The fixing device disclosed in Japanese Patent Application Publication No. 2007-219105 includes a foamed fixer-thickness control unit to control the thickness of the foamed fixer applied on the application roller as the application member. The foamed fixer-thickness control unit controls the thickness of the foamed fixer such that an application time, where the foamed fixer is applied over the resin particulates on the recording medium by allowing the application roller to be in contact with the recording medium, is equal to or longer than the permeation time, where the foamed fixer applied over a resin particle layer on the recording medium by the application roller permeates the resin particle layer to reach the recording medium. Accordingly, the offset resin particulates on the application roller may be prevented, and the resin particulates is quickly fixed on the recording medium after the application of the foamed fixer over the resin particulates on the recording medium. Accordingly, an excellent fixing responsiveness can be obtained in the fixing of the resin particulates on the recording medium.

Figure 8:
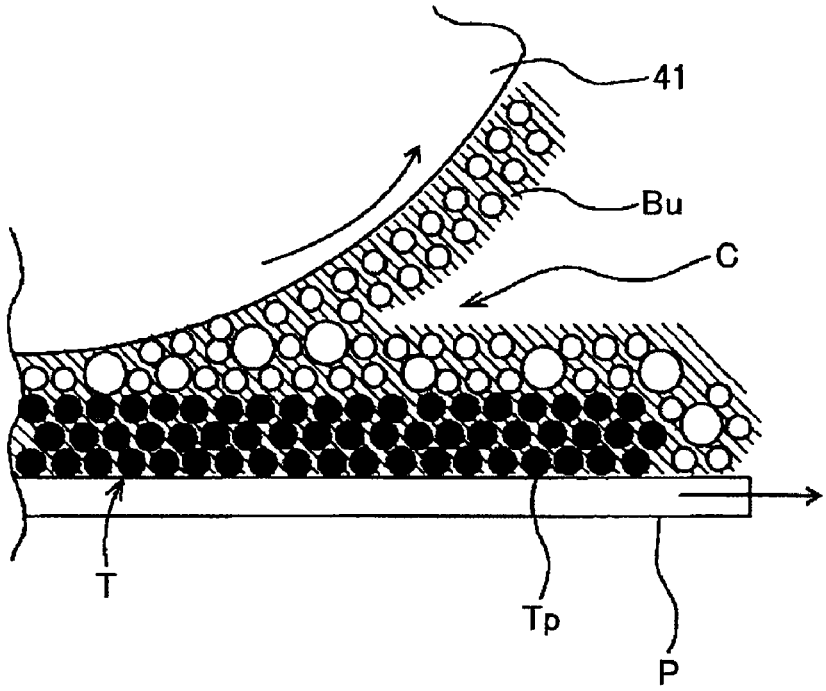
FIG. 8 is an enlarged schematic view illustrating an application nip between a surface of the application roller and a transfer sheet.
Figure 9:
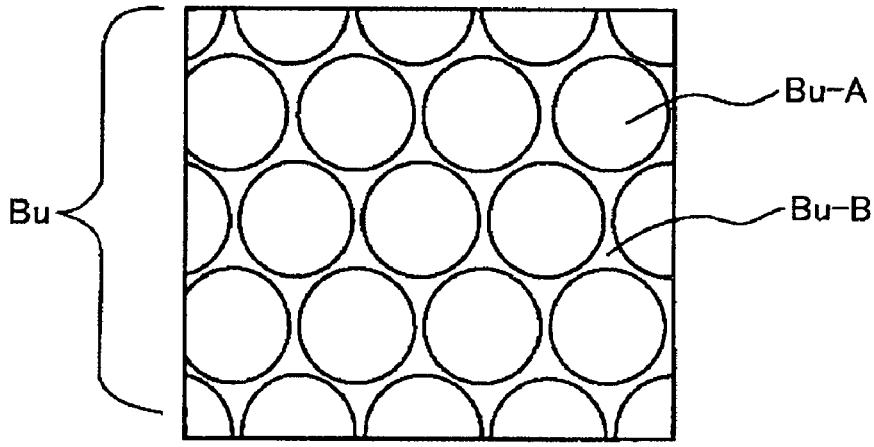
FIG. 9 is an enlarged view illustrating a foamed fixer.

FIG. 8 is an enlarged view illustrating a contact portion (an application nip C) between the application roller 41 and the transfer sheet P in the fixing device 30 according to the embodiment. As illustrated in FIG. 8, if the foamed fixer Bu having a certain thickness on the application roller 41, though the actual amount is small, is applied on the transfer sheet P, part of the foamed fixer on the surface of the application roller 41 can be separated from the rest of the foamed fixer applied on the transfer sheet P at a position more distant from an end position of the application nip C compared to a case where the liquid fixer is used in place of the foamed fixer. Further, the fixer applied in a foam may cancel out the attraction of toner on the transfer sheet P due to the surface tension of the foamed fixer on the application roller 41. Thus, the toner offset by the application roller 41 can efficiently be controlled, which can prevent a white patch on the transfer sheet caused by the toner offset (i.e., insufficient deposition of toner).

Note that when the toner particle Tp size of the unfixed toner layer T is in a range of 5 to 10 μm, it is preferable that a bubble size of the foamed fixer Bu be set at in a range of 5 to 10 μm in order to apply the foamed fixer Bu over the unfixed toner layer T without deteriorating the unfixed toner layer T. The printer 100 includes the micro-bubble generator 38 to produce the foamed fixer Bu having such micro-bubbles of the above bubble size.

The foamed fixer Bu generated by the micro-bubble generator 38 is mainly composed of a bubble Bu-A and a boundary liquid-film Bu-B (generally called a "Plateau Border").

Although the image degradation can be prevented by using the fixer in a foam that can provide smaller amount of the fixer than that in a liquid form, the toner offset by the application roller 41 may still be observed when the fixing velocity is high.

Figure 10:
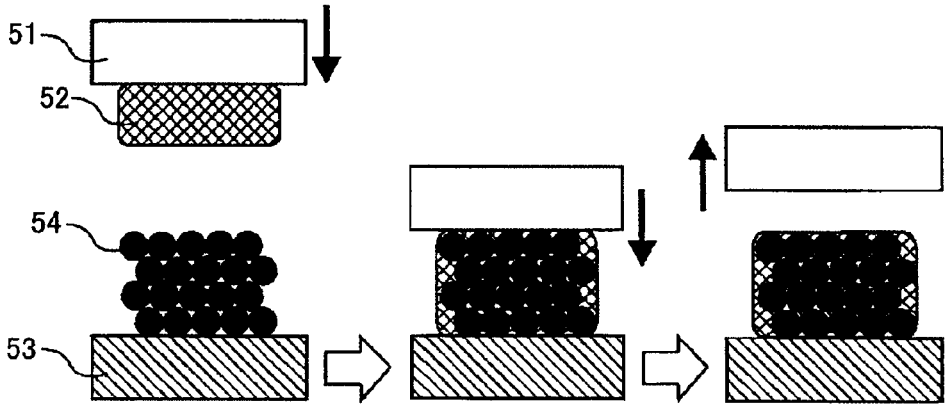
FIG. 10 is an enlarged schematic view illustrating the application nip when a fixing process is carried out at a relatively slow fixing velocity using a fixer in a liquid form.

FIG. 10 is an enlarged schematic view illustrating the application nip when the fixing process is carried out at a relatively slow fixing velocity using a fixer in a liquid form. Note that in FIG. 10, the application member 51 has lyophobic properties whereas the recording medium 53 has lyophilic properties. In the application nip shown in FIG. 10, bonding force is generated between the toner particles, between the toner particles and the recording medium 53, and between the toner particles and the application member 51, due to the surface tension of the fixer applied over the toner particles, the recording medium 53, and the application member 51. However, in FIG. 10, the fixing velocity is set at low until the following process can be carried out. That is, the fixing velocity is set at low until the application member 51 can be detached from the recording medium 53 after the fixer 52 on the surface of the application member 51 comes in contact with and permeates a toner layer 54 on the recording medium 53, and finally reaches the recording medium 53. Note that the application member 51 is made of a material having lyophobic properties whereas the recording medium 53 is made of a material having lyophilic properties. Accordingly, the bonding force between the toner layer and the recording medium 53 is greater than those between the toner particles and between the toner layer and the application member 51, so that the toner layer (toner particles) can be detached from the application member 51 without being attracted by the application member 51.

Figure 11:
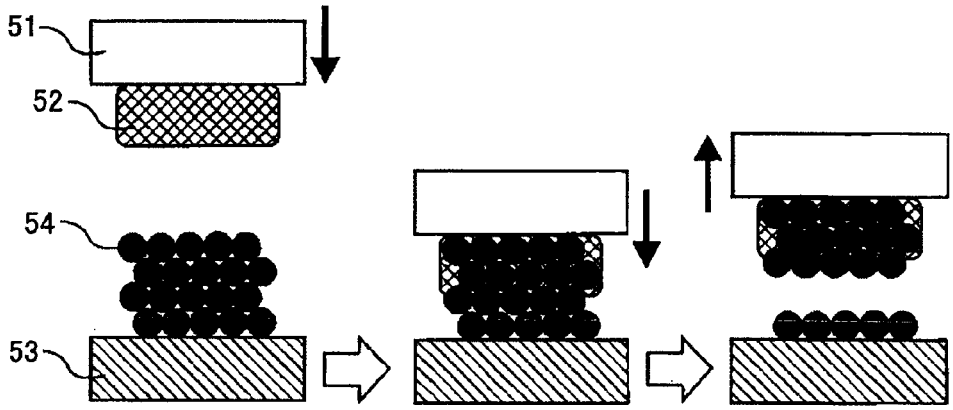
FIG. 11 is an enlarged schematic view illustrating the application nip when the fixing process is carried out at a relatively fast fixing velocity using a fixer in a liquid form.

FIG. 11 is an enlarged schematic view illustrating the application nip when the fixing process is carried out at a relatively fast fixing velocity using a fixer in a liquid form. As illustrated in FIG. 11, after the application member 51 comes in contact with and completely permeates the toner layer 54, the application member 51 is detached from the recording medium 53 before the fixer 52 reaches the recording medium 53. In this case, the bonding force is generated between fixer 52 permeated toner particles and between the toner layer and the application roller 51, due to the surface tension of the fixer 52 applied over the toner particles and the application roller 51. However, the bonding force gets weaker between the fixer applied toner particles when the applied fixer is dried, which causes the toner particles in the toner layer 54 to be separate. As a result, the toner offset by the application member 51 is observed; that is, toner particles in the toner layer 54 is attracted and attached from the toner layer to the application member 51.

In order to prevent such a toner offset, a contact time between the application member 51 and the recording medium 53 may need to be set longer than a fixer permeation time where the fixer 52 permeates the toner layer 54 to reach the recording medium 53. Note that a nip or an application nip indicates a portion between a contact point where the application member 51 is brought into contact with the recording medium 53 and a detaching point where the application member 51 is detached from the recording medium 53. Accordingly, a nip time indicates a time between a contact time where the application member 51 is brought into contact with the recording medium 53 and a detaching time where the application member 51 is detached from the recording medium 53. A nip width indicates a length between the contact point and the detaching point. A nip pressure indicates a pressure applied to the nip portion. The nip pressure is represented by a value obtained by dividing load (pressure) applied to the nip portion by a nip portion area.

Figure 12:
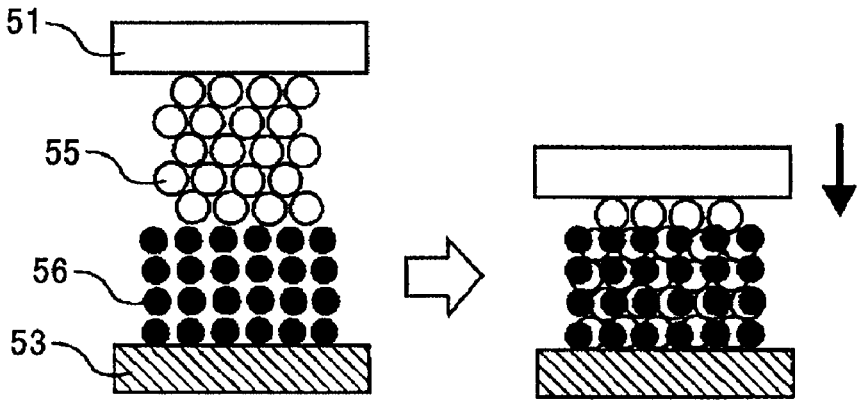
FIG. 12 is an enlarged schematic view illustrating the application nip when a foamed fixer is applied in the thickness equal to or larger than a thickness of a toner layer in a large-scale model experiment using zirconia beads having a size of 300 μm.

The inventors of the present application have observed with an optical microscope the permeation of a foamed fixer 55 (see FIG. 12) in the toner layer 54 in a large-scale model experiment using zirconia beads having a size of 300 μm. As illustrated in FIG. 12, the result shows that the foamed fixer 55 permeates gaps between the zirconia particles 56 without breaking of the foam of the fixer. That is, the bubbles in contact with the zirconia particles 56 (herein after called "contact bubbles") are pressed by the upper bubbles above the contact bubbles, so that the contact bubbles pass through the gaps between the zirconia particles 56 without breaking the contact bubbles. In general, permeation of liquid between particles is caused by capillary action due to surface tension of the liquid. By contrast, foam exhibits behaviors of a flexible continuum model, where the bubbles passed through the gaps between the particles are continuously pressed by the upper side bubbles so that the bubbles further pass through additional gaps between the particles. Similar to the large-scale model experiment, it is presumed that in a particle layer such as a toner layer composed of toner particulates having a size of 6 μm, the bubbles passed through the gaps between the toner particulates be also continuously pressed by the upper side bubbles so that the bubbles further pass through additional gaps between the toner particulates.

Figure 13:
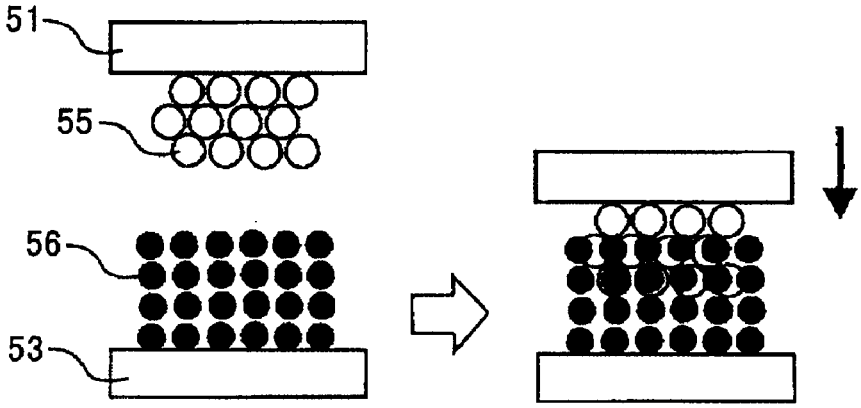
FIG. 13 is an enlarged schematic view illustrating the application nip when the foamed fixer is applied in the thickness smaller than a thickness of the toner layer in the large-scale model experiment using zirconia beads having a size of 300 μm.

FIG. 13 illustrates a case where the thickness of the foamed fixer 55 is smaller than that of the particulate layer in the large-scale model experiment. As illustrated in FIG. 13, in this condition, the pressing force to continuously press the bubbles to pass through the gaps between the particulates diminishes before the foamed fixer 55 reaches the recording medium 53, so that the foamed fixer 55 does not quickly reach the recording medium 53.

The above experiment shows that the thickness of the foamed fixer Bu on the application roller 51 and the thickness of the zirconia particles 56 on the recording medium 53 had profound correlationships with a permeatioin time of the fixer in the particle layer.

The inventors of the present application have measured a time where a fixer permeates the resin (e.g., toner) containing particle layer (defines as a "permeation time") and have examined a relationship between a nip passing time where the resin containing particle layer passes through the nip and the permeation time.

Figure 14:
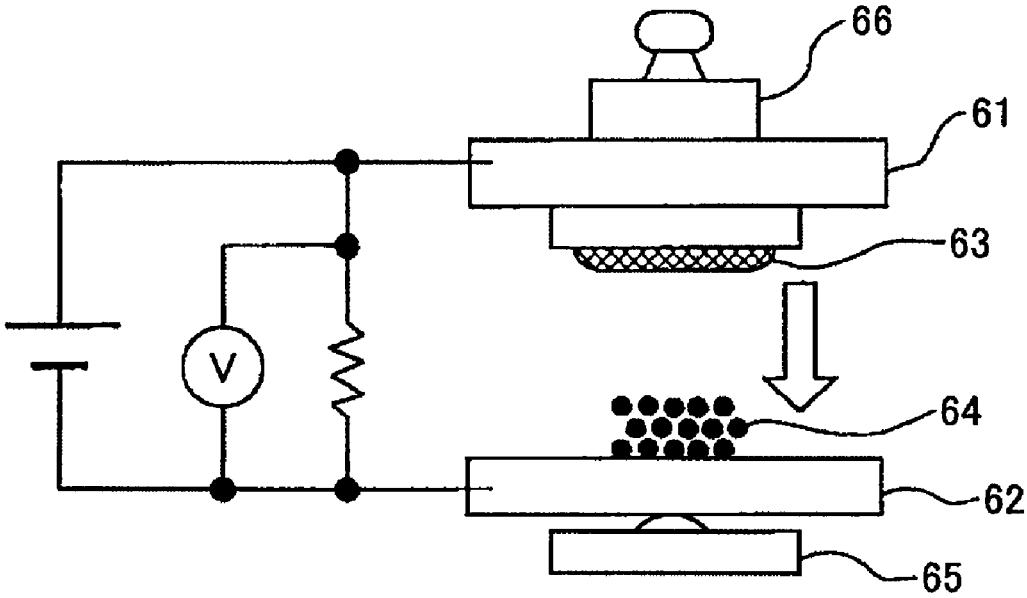
FIG. 14 is a schematic diagram illustrating an example of an osmosis time measurement device used in the large-scale model experiment.

FIG. 14 is a schematic diagram illustrating an example of the permeation time measurement device used in the large-scale model experiment. Note that in this measurement, the fixer used is the fixer in a foam and toner used is made of resin. The fixer contains an ionic material, such as a foaming agent or dispersant required for foaming, so that the fixer exhibits the resistance value of 107Ω·cm or lower. In FIG. 14, an upper electrode 61 corresponds to the application member of the fixing device. Likewise, a lower electrode 62 corresponds to the recording medium inside the fixing device. A layer of the foamed fixer 63 is formed on the upper electrode 61 and a toner layer 64 is formed on the surface of the lower electrode 62. A load-detecting load cell is arranged under the lower electrode 62, and a voltage is then applied between the upper and lower electrodes. When the upper electrode 61 is brought into contact with the lower electrode 62, the load-detecting load cell 65 detects the load applied to the upper electrode 61, thereby determining a contact point. Thereafter, when the foamed fixer 63 passes through the toner layer 64 to reach the lower electrode 62, a current is flown between the upper and lower electrodes to change the value of the applied voltage. The permeation time of the fixer in the toner layer can be obtained by measuring a time between the time where the load-detecting load cell 65 detects the contact time of the upper electrode 61 on the lower electrode 62 and onset of the change in the applied voltage.

Measurement examples of the permeation time measured by the above permeation time measurement device illustrated in FIG. 14 are described below.

[First Measurement]

A foamed fixer layer having an average bubble size of 20 μm was formed on the upper electrode 61 with the volume density of 0.05 g/cm$^3$. The toner particle layer 64 having an average particle size of 6 μm was formed on the lower electrode 62 with the thickness of 30 μm. The upper electrode 61 and the lower electrode 62 used were made of the same material (SUS304). The upper electrode 61 fixed on a linear stage was brought into contact with the lower electrode 62 at a pressure (application pressure) of 0.03 kgf/cm$^2$. The applied voltage between the upper and lower electrodes was set at 0.8 V in order to prevent the fixer between the upper and lower electrodes from being electrolyzed.

Figure 15:
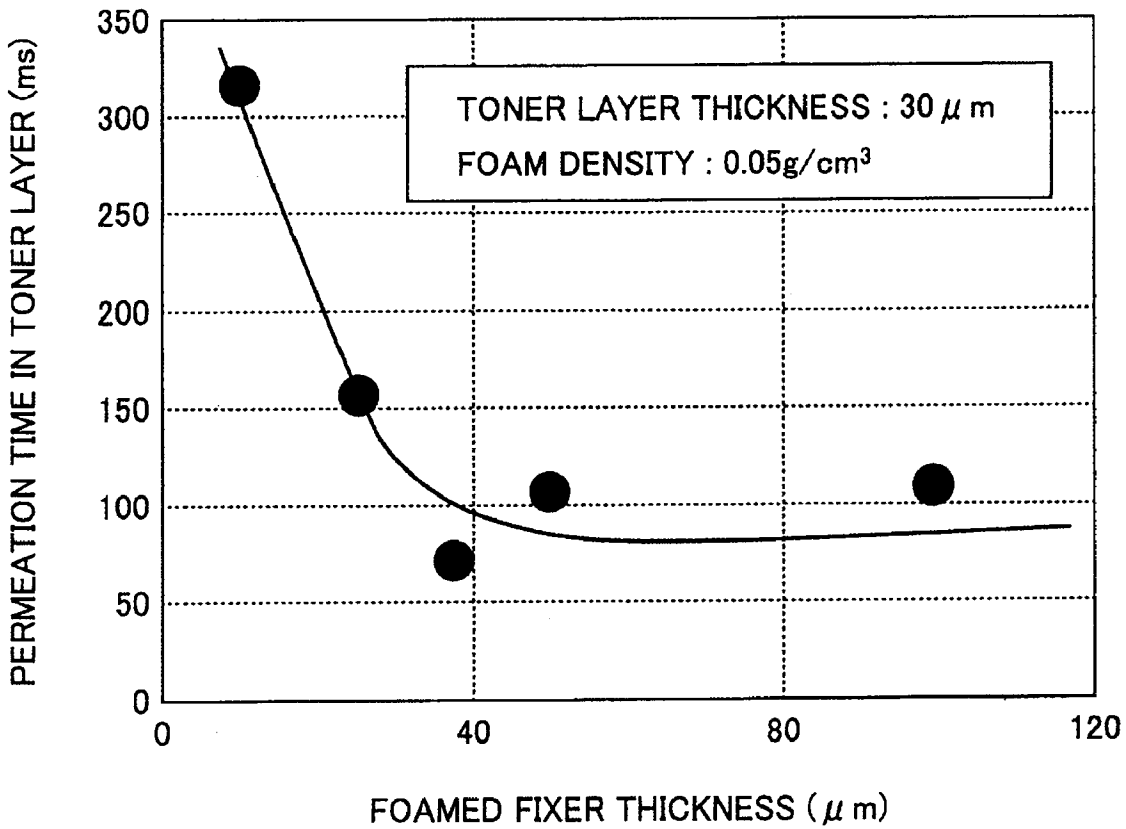
FIG. 15 is a graph illustrating a relationship between the thickness of the foamed fixer applied on an upper electrode and permeability time of the foamed fixer in a toner layer in a first measurement example.

FIG. 15 is a graph illustrating a relationship between the thickness of the foamed fixer applied on the upper electrode 61 and the permeation time of the foamed fixer in the toner layer in a first measurement example. The result in FIG. 15 shows that if the thickness of the foamed fixer is equal to or larger than that of the toner layer, the permeation time results in a constant value; however, if the thickness of the foamed fixer is smaller than that of the toner layer, the permeation time increases as the foamed fixer gets thinner. This result may support the experiment illustrated in FIGS. 12 and 13, where the upper bubbles continuously press the lower bubbles to pass through the gaps between the toner particles so that the foamed fixer permeates the toner layer.

[Second Measurement]

A foamed fixer layer having an average bubble size of 20 μm was formed on the upper electrode 61 with the volume density of 0.05 g/cm$^3$, and the thickness of 50 μm. The toner particle layer 64 having an average particle size of 6 μm was formed on the lower electrode 62 with the thickness of 30 μm. The upper electrode 61 and the lower electrode 62 used were made of the same material (SUS304). The upper electrode 61 fixed on a linear stage was brought into contact with the lower electrode 62 at various pressures (application pressures). The applied voltage between the upper and lower electrodes was set at 0.8 V in order to prevent the fixer between the upper and lower electrodes from being electrolyzed.

Figure 16:
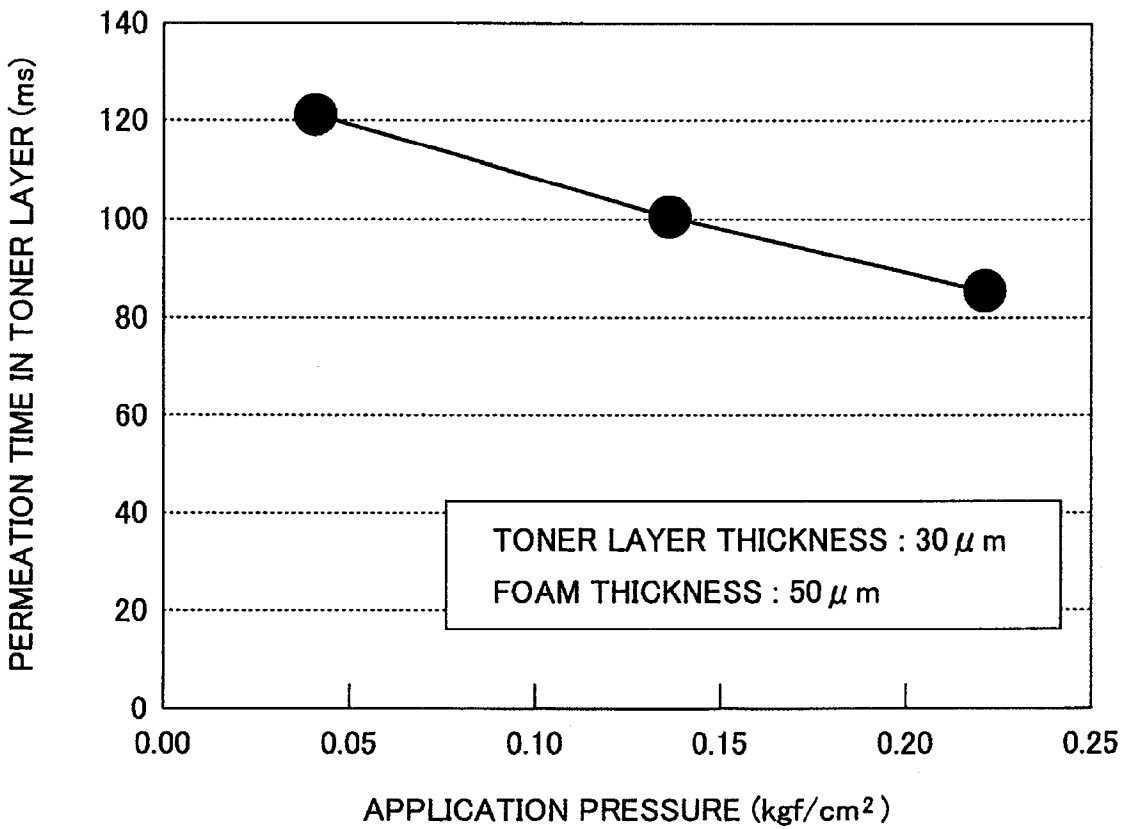
FIG. 16 is a graph illustrating a relationship between foamed fixer application pressure (i.e., nip pressure) on a lower electrode and the permeability time of the foamed fixer in the toner layer in a second measurement example.

FIG. 16 is a graph illustrating a relationship between a foamed fixer application pressure (i.e., nip pressure) on the lower electrode and the permeability time of the foamed fixer in the toner layer in a second measurement example. As illustrated in FIG. 16, the permeation time of the foamed fixer in the toner layer decreases as the foamed fixer application pressure increases. This supports the fact that the permeation rate increases, that is, the permeation time decreases with an increase in the pressure applied to the upper bubbles to continuously press the lower bubbles to pass through the gaps between the toner particles.

[Third Measurement]

A foamed fixer layer having an average bubble size of 20 μm was formed on the upper electrode 61 with the volume density of 0.05 g/cm$^3$, and the thickness of 50 μm. The toner particle layer 64 having an average particle size of 6 μm was formed on the lower electrode 62 with the thickness of 30 μm. The upper electrode 61 and the lower electrode 62 used were made of the same material (SUS304). The upper electrode 61 fixed on a linear stage was brought into contact with the lower electrode 62 at a pressure (application pressure) of 0.03 kgf/cm$^2$. The applied voltage between the upper and lower electrodes was set at 0.8 V in order to prevent the foamed fixer between the upper and lower electrodes from being electrolyzed.

Figure 17:
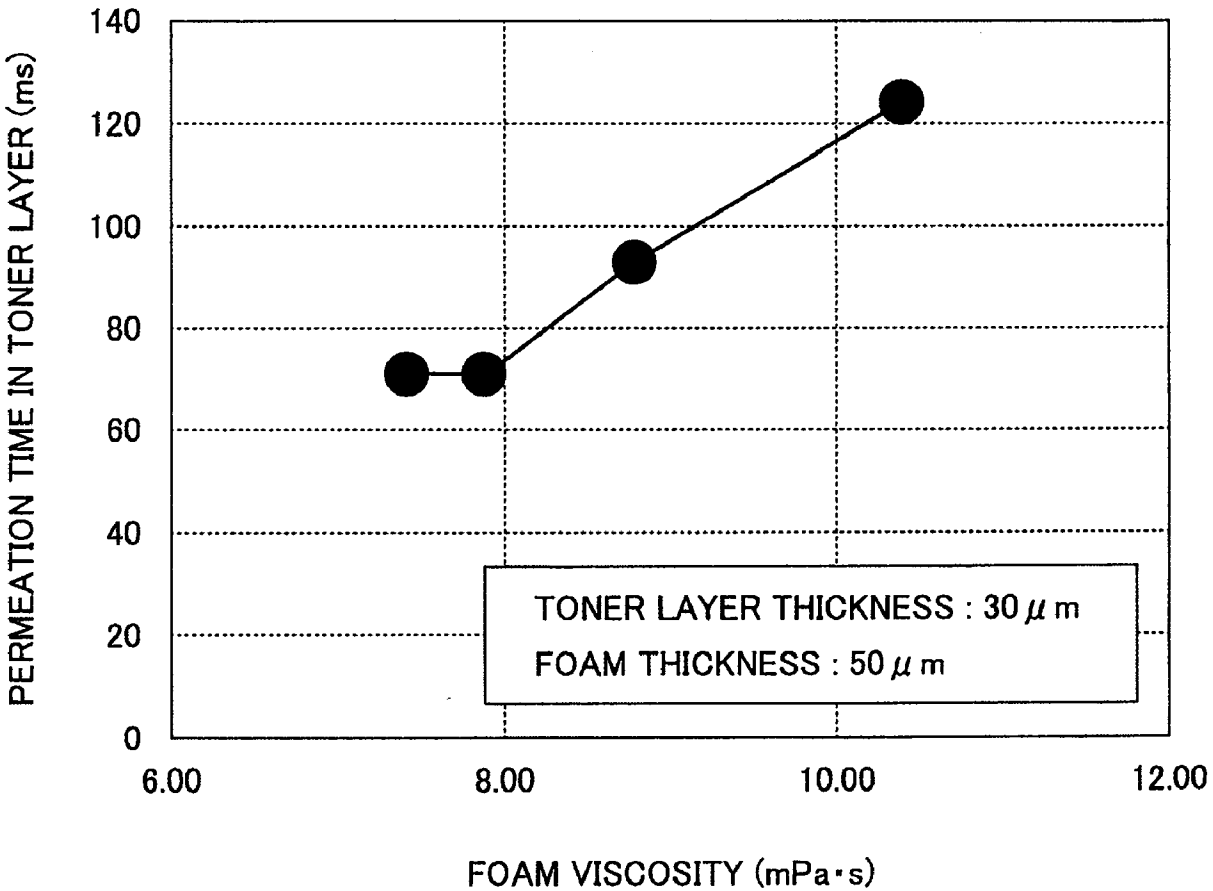
FIG. 17 is a graph illustrating a relationship between foamed fixer viscosity and the permeability time of the foamed fixer in the toner layer.

FIG. 17 is a graph illustrating a relationship between foamed fixer viscosity and the permeability time of the foamed fixer in the toner layer. Note that the foamed fixer viscosity was measured in the following manner. A cone-plate rotational viscometer was used to measure the foamed fixer viscosity. A rotator having an outer diameter of 60 mm was used in the cone-plate rotational viscometer. The foamed fixer viscosity was determined as a rotational viscosity value obtained after one rotation of the cone-plate rotational viscometer. That is, the foamed fixer viscosity was measured at a point 10 seconds after the rotation started at a speed where the number of revolutions per second was 10, a gap between a cone having a cone angle of 1 degree and a plate was set at 3 mm, and the foamed fixer temperature was set at 25 degrees Celsius (° C.).

As illustrated in FIG. 17, the permeation time of the foamed fixer in the toner layer decreases with a decrease in the foamed fixer viscosity. This supports the fact that the permeation time decreases with an increase in the flexibility of the bubbles when the upper bubbles continuously press the lower bubbles to pass through the gaps between the toner particles.

The above measurement examples show that in order to prevent the toner offset by the application member, a time where the toner layer passes through a contact portion (application nip) between the application member and the recording medium may need to be set at a time equal to or longer than the permeation time of the foamed fixer in the toner layer.

As can be seen from the above measurement examples, if the toner particle has a particle size of approximately 5 μm, the permeation time of the foamed fixer in the toner layer falls in a range of 50 to 300 ms. In the printer according to the embodiment, the time where the toner layer passes through a contact portion (application nip) between the application member and the recording medium is set in a range of at least 50 to 300 ms.

As illustrated in FIG. 4, the time where the transfer sheet P passes through the application nip, that is, the time while an end of the transfer sheet P that has entered an inlet of the nip is discharged from an outlet of the nip, is set in a range of 50 to 30 ms. This indicates that the time for the transfer sheet P to pass through the application nip is set at a time equal to or longer than the permeation time of the foamed fixer in the toner layer. The time to pass through the application nip (hereinafter called a "nip time") is computed based on the following formula: "(nip width)/(transfer velocity of transfer sheet)". The transfer velocity of the transfer sheet P may be computed based on engineering design data of a transfer sheet drive mechanism. The nip width is obtained as follows: Coloring paint that is not dry is thinly applied over an entire surface of the application roller, the transfer sheet P is pressurized by sandwiching between the application roller 41 and the pressure roller 43 without rotation to apply the coloring paint on the transfer sheet P. A length of the colored portion (generally colored in a rectangular) in the transferring direction of the transfer sheet P was measured as the nip width. The nip time may need to be set at a time equal to or longer than the permeation time of the foamed fixer in the toner layer based on the transfer velocity of the transfer sheet P by adjusting the nip width.

In the fixing device according to the embodiment, an elastic porous body (hereinafter called a "sponge") is used as the pressure roller 43, and the nip width can be easily changed by changing the distance between shafts of the application roller 41 and the pressure roller 43 made of sponge. The pressure roller 43 may alternatively be made of elastic rubber; however, the sponge can be deformed more easily than the elastic rubber, so that a long nip width may be obtained without extremely increasing the pressure of the application roller 41.

Note that the foamed fixer contains a resin softener or a swelling agent. If the fixer is attached to the pressure roller 43 made of sponge, a sponge material of the pressure roller 43 may deteriorate. Accordingly, it is preferable that the resin material for the sponge material exhibit no reaction with the softener or swelling agent. The surface of the sponge pressure roller 43 may be covered with a flexible film. With this configuration, the pressure roller 43 made of the sponge material, which is susceptible to deterioration when reacted with the softener or swelling agent, can be prevented from deterioration by covering the surface of the sponge material with the flexible film. Examples of the sponge material include a porous body made of resin such as polyethylene, polypropylene, and polyamide. Materials for the flexible film covering the sponge material include polyethylene terephthalate, polyethylene, polypropylene, and tetrafluoroethylene-perfluoroalkylvinyl ether copolymer (PFA).

If the application roller 41 is constantly in contact with the pressure roller 43 made of sponge, the foamed fixer Bu on the application roller 41 may be transferred and attached to the pressure roller 43 made of sponge while the transfer sheet P is not transferred. In order to prevent such attachment, a sheet front-end detection unit (not shown) is provided in front of the application roller 41 to detect the edge of the transfer sheet P before the transfer sheet P is transferred to the application roller 41, and it is preferable that the foamed fixer Bu be formed on the application roller 41 such that the application roller 41 provides the foamed fixer Bu to the transfer sheet P only from the edge onward of the transfer sheet P.

The pressure roller 43 is, while in standby, moved from a position where the pressure roller 43 is in contact with the application roller 41 to a position where the pressure roller 43 is separated from the application by a contact-separate mechanism (not shown). The pressure roller 43 is moved by the contact-separate mechanism to a position where the pressure roller 43 is pressure-contacted with the application roller 41 based on the detection result of the sheet front-end detection unit. A time where the pressure roller 43 is detached from the application roller 41 is determined based on the detection result of the sheet front-end detection unit.

As illustrated in FIG. 17, the permeation time may vary with the foamed fixer viscosity. Accordingly, if the nip time and the nip pressure are constant, and the foamed fixer viscosity is increased due to the change in the formula of the fixer or due to a decrease in an ambient temperature of the fixing device 30, the permeation time of the foamed fixer in the toner layer gets longer than the nip time, which may result in deterioration of the image. In order to prevent the image deterioration due to the fixer formula change or the ambient temperature decrease, it is preferable that the nip time be adjusted to be equal to or longer than the permeation time based on the foamed fixer viscosity, by using the nip pressure that changes the permeation time. In this case, the foamed fixer viscosity may need to be detected in the fixing device 30. As described above, the foamed fixer viscosity obtained is a rotational viscosity measured by the cone-plate rotational viscometer, and it is preferable that a viscosity detector be similar to the cone-plate rotational viscometer configured based on the similar principle. For example, referring to FIG. 4, a detector may be configured to detect, after a desired foamed fixer being made, a motor torque of the rotator in the passage pipe containing the foamed fixer located in front of the nozzle 39 used as a supply port, and determine the detected value as the foamed fixer viscosity as an alternative value of a proper rotation viscosity. Further, the detector may be configured to detect a unique frequency change of a cantilever oscillator, and determine the detected value as the foamed fixer viscosity as an alternative value of a proper rotation viscosity. A nip pressure adjusting unit may be configured to change the distance between the shafts of the application roller 41 and the pressure roller 43 based on the foamed fixer viscosity detected signal.

In order to shorten the permeation time of the foamed fixer in the toner layer, the thickness of the foamed fixer Bu on the application member such as the application roller 41 is equal to or larger than the thickness of the toner layer T as described above. In the color image, the thickness of the unfixed toner layer T on the transfer sheet P differs according to the color and contrast. Accordingly, the thickness of the foamed fixer Bu is set based on the maximum thickness of the unfixed toner layer T on the transfer sheet P. The maximum thickness of the unfixed toner layer T on the transfer sheet P may be obtained based on the image signal. The thickness of the foamed fixer Bu is adjusted by the thickness adjusting blade 42 so as to be larger than the maximum thickness of the unfixed toner layer T obtained based on the image signal. The thickness of the unfixed toner layer T on the transfer sheet P is maintained constant by applying a value in a setting table computed based on the image signal from a scanner or a PC. Thus, the thickness of the foamed fixer Bu on the application roller 41 can be adjusted larger than the maximum thickness of the unfixed toner layer T on the transfer sheet P obtained based on the image signal.

The permeation time of the foamed fixer in the toner layer changes based on the thickness of the unfixed toner layer (i.e., the thicker the unfixed toner layer T, the longer the permeation time). If the thickness of the unfixed toner layer varies, the nip time may need to be changed based on the thickness of the unfixed toner layer. Examples of a nip time changing unit to change the nip time include a transfer sheet velocity changing unit configured to change the velocity of transferring the transfer sheet P or a nip width changing unit configured to change the width of the nip. In the nip time changing unit, the maximum thickness of the unfixed toner layer T on the transfer sheet P is computed based on the image signal so as to compute the permeation time, the nip width or the velocity of transferring the transfer sheet P is changed so as to compute the permeation time longer than that of the maximum thickness of the unfixed toner layer T on the transfer sheet P.

The foamed fixer is obtained by mixing air bubbles in a liquid containing a softener. It is preferable that the softener containing liquid include a foaming agent or a foam booster to produce a foamed fixer uniformly mixed with air bubbles having uniform bubble size. It is preferable that the above softener containing liquid have a thickener to obtain certain degrees of viscosity in order to uniformly disperse bubbles in the liquid.

A preferable example of the foaming agent includes anionic surfactant, and fatty acid salt is particularly preferable. The fatty acid salt has the surface activity, which facilitates foaming of the liquid fixer by decreasing the surface tension of the liquid fixer that contains water, and also provides a strong bubble wall (Plateau boundary) of the foamed fixer due to the lamellar structure of the fatty acid salt on the surface thereof. As a result, the obtained foamed fixer exhibits high foam stability. Further, it is preferable that the liquid fixer contain water to facilitate the foamability of the fatty acid salt. A preferable example of the fatty acid includes saturated fatty acid that exhibits excellent resistance to oxidation in view of long-term stability in the atmosphere. Note that a small amount of unsaturated fatty acid salt may be added to the liquid fixer containing the saturated fatty acid salt in order to supplement solubility and dispersibility of the fatty acid salt to water, exhibit excellent foamability at low temperatures of 5 to 15° C., and provide excellent fixing stability at a wide environmental temperature range. Further, adding the small amount of unsaturated fatty acid salt may prevent the separation of the saturated fatty acid salt in liquid fixer in the long-term storage of the liquid fixer.

Examples of the fatty acid used in the saturated fatty acid salt include saturated fatty acids having the number of carbon atoms of 12, 14, 16, and 18, specifically, lauric acid, myristic acid, palmitic acid, and stearic acid. If the saturated fatty acid has the number of carbon atoms equal to or fewer than 11, the saturated fatty acid salt having the number of carbon atoms equal to or fewer than 11 obtained exhibits high odor intensity. Accordingly, the fixer containing saturated fatty acid salt may be unsuitable to be used in image forming apparatuses in office or home environments. On the other hand, the obtained saturated fatty acid salt having the number of carbon atoms equal to or greater than 19 may exhibit low solubility in water, thereby significantly decreasing the long-term stability of the liquid fixer. The saturated fatty acid salt having the saturated fatty acid may be used alone or in combination as the foaming agent.

The unsaturated fatty acid salt may also be used, which preferably contains the unsaturated fatty acid having the number of carbon atoms of 18 and the number of double bonds of 1 to 3. Specifically, preferable examples of the unsaturated fatty acid include an oleic acid, linoleic acid, and linolenic acid. If the unsaturated fatty acid salt has the number of double bonds equal to or higher than 4, the long-term stability of the liquid fixer may be lowered. The unsaturated fatty acid salt having the unsaturated fatty acid may be used as the foaming agent alone or in combination. The saturated fatty acid salt and the unsaturated fatty acid salt may be mixed so as to be used as the foaming agent.

Preferable examples of the above saturated fatty acid salt or the unsaturated fatty acid salt include a sodium salt, potassium salt or amine salt if they are used as the foaming agent in the liquid fixer. Configuring the fixing device 30 to be ready for fixing images immediately after the power supply is turned on is a critical factor as the commercial value of the fixing device 30. In order for the fixing device 30 to be ready for fixing images, the liquid fixer needs to be in a foam. Thus, if the above fatty acid salt is caused to foam quickly, the fixing device 30 may get ready for fixing images shortly after the power is turned on. Specifically, if the above saturated fatty acid salt or the unsaturated fatty acid salt is the amine salt, the liquid fixer can foam in the shortest time when the shear force is applied to the liquid fixer, thereby producing the foamed fixer quickly. As a result, the fixing device 30 can get ready for fixing images shortly after the power is turned on.

The softener to soften the resin by dissolving or swelling the resin contains aliphatic ester. The aliphatic ester has an excellent solubility and swelling properties to dissolve or swell at least part of the resin contained in the toner.

Further, toner is fixed on the recording medium by frequently used image forming apparatuses in an enclosed environment and the softener remains in the toner that has been fixed on the recording medium. Therefore, it is preferable that the toner be fixed on the recording medium without allowing the toner having the softener to generate volatile organic compounds (VOC) and unpleasant odors. That is, it is preferable that the softener contain no substances that generate volatile organic compounds (VOC) and unpleasant odors. The aliphatic ester has a high boiling point and low volatility, and does not have irritating odors compared with organic solvents in general (e.g., toluene, xylene, methyl ethyl ketone, and ethyl acetate) that are widely used.

Note that as a practical odor measurement capable of accurately detecting odors in an office environment, an odor index measured by a triangle odor bag method (an organoleptic examination) may be used as an indicator (i.e., dilution rate of a substance when no odor of the substance is sensed). The odor index of the aliphatic ester in the softener may preferably be 10 or lower. In this case, unpleasant odors may not be sensed in a normal office environment. Similarly, it is preferable that other liquids contained in the liquid fixer generate neither unpleasant odors nor irritating odors.

The aliphatic ester preferably contains a saturated aliphatic ester. If the aliphatic ester preferably contains the saturated aliphatic ester, the softener may exhibit excellent storage stability (i.e., resistance to oxidation and hydrolysis). Numerous saturated aliphatic esters can dissolve or swell the resin contained in the toner within 1 second. Further, the saturated aliphatic esters may lower a feel of toner adhesion on the recording medium. This may result from the fact that the saturated aliphatic ester form an oil film over the surface of the dissolved or swollen resin.

Preferable examples of the liquid fixer include the saturated aliphatic esters containing a compound represented by "R1COOR2". In the compound represented by the above general formula "R1COOR2", R1 represents an alkyl group having the number of carbon atoms of 11 or more and 14 or less. Likewise, R2 represents a straight or a branched alkyl group having the number of carbon atoms of 1 or more and 6 or less. If the number of carbon atoms of R1 or R2 is fewer than the corresponding desired range, the compound may generate odors, and if the number of carbon atoms of R1 or R2 is greater than the corresponding desired range, softening capability of the compound may decrease. Note that the compound has the odor index of 10 or less so as to generate neither unpleasant odors nor irritating odors.

Examples of such a compound, that is, an aliphatic monocarboxylic acid ester, include ethyl laurate, hexyl laurate, ethyl tridecanoate, isopropyl tridecanoate, ethyl myristate, and isopropyl myristate. Numerous aliphatic monocarboxylic acid esters are dissolved in lipid solvents but are not dissolved in water. Thus, the aliphatic monocarboxylic acid esters are dissolved in aqueous solvents using glycols as a solubilizer so that they may be dissolved in the liquid fixer or may be contained as microemulsion in the liquid fixer.

Preferable examples of the liquid fixer include the aliphatic esters containing an aliphatic dicarboxylic acid ester. The aliphatic ester containing the aliphatic dicarboxylic acid ester can dissolve or swell the resin in the toner in a short time. For example, in high-speed printing such as printing at a printing speed of 60 ppm, it is preferable that a fixing time to apply the fixer over the unfixed toner to fix the toner on the recording medium be within 1 second. If the saturated aliphatic ester contains the aliphatic dicarboxylic acid ester, the fixing time to apply the fixer over the unfixed toner to fix the toner on the recording medium may be within 0.1 second. Further, since the resin contained in the toner can be dissolved or swollen by adding a small amount of softener, the amount of softener to be added may be lowered.

Preferable examples of the aliphatic dicarboxylic acid ester include the aliphatic esters containing a compound represented by "R3(COOR4)2". In the compound represented by the above general formula "R3(COOR4)2", R1 represents an alkylene group having the number of carbon atoms of 3 or more and 8 or less. Likewise, R4 represents a straight or a branched alkyl group having the number of carbon atoms of 3 or more and 5 or less. If the number of carbon atoms of R1 or R2 is fewer than the corresponding desired range, the liquid fixer containing the aliphatic ester may generate odors, and if the number of carbon atoms of R1 or R2 is greater than the corresponding desired range, softening capability of the aliphatic ester may decrease. Note that the compound has the odor index of 10 or less so as to generate neither unpleasant odors nor irritating odors.

Examples of the aliphatic dicarboxylic acid ester include 2-ethylhexyl succinate, dibutyl adipate, diisobutyl adipate, diisopropyl adipate, diisodecyl adipate, diethyl sebacate, and dibutyl sebacate. Numerous aliphatic dicarboxylic acid esters are dissolved in lipid solvents but are not dissolved in water. Thus, the aliphatic dicarboxylic acid esters are dissolved in aqueous solvents using glycols as a solubilizer so that they may be dissolved in the liquid fixer or may be contained as microemulsion in the liquid fixer. Further, in the liquid fixer according to the embodiment, it is preferable that the aliphatic esters contain an aliphatic dicarboxylic acid dialkoxyalkyl. If the aliphatic esters contain the aliphatic dicarboxylic acid dialkoxyalkyl, the fixing properties to fix the toner on the recording medium may be improved.

Preferable examples of the aliphatic dicarboxylic acid dialkoxyalkyl include the aliphatic esters containing a compound represented by "R5(COOR6-O—R7)2". In the compound represented by the above general formula "R5(COOR6-O—R7)2", R5 represents an alkylene group having the number of carbon atoms of 2 or more and 8 or less. Likewise, R6 represents an alkylene group having the number of carbon atoms of 2 or more and 4 or less. Further, R7 represents an alkyl group having the number of carbon atoms of 1 or more and 4 or less. If the number of carbon atoms of R1 or R2 is fewer than the corresponding desired range, the liquid fixer containing the aliphatic ester may generate odors, and if the number of carbon atoms of R1 or R2 is greater than the corresponding desired range, softening capability of the aliphatic ester may decrease. Note that the compound has the odor index of 10 or less so as to generate neither unpleasant odors nor irritating odors.

Examples of the aliphatic dicarboxylic acid dialkoxyalkyl include diethoxyethyl succinate, dibutoxyethyl succinate, diethoxyethyl adipate, dibutoxyethyl adipate, and diethoxyethyl sebacate. Thus, the aliphatic dicarboxylic acid dialkoxyalkyl is dissolved in aqueous solvents using glycols as a solubilizer so that it may be dissolved in the liquid fixer or may be contained as microemulsion in the liquid fixer.

Further, ester citrate, ethylene carbonate, or propylene carbonate that is not a fatty acid ester may be used as a softener or a swelling agent.

If the bubbles of the foamed fixer break while the foamed fixer applied on a particle layer such as a toner layer is pressed to cause the bubble of the foamed fixer to permeate between the particles of the particle layer at an application contact nip portion, the permeation of the foamed fixer in the particle layer may be inhibited. Accordingly, it is preferable that the foamed fixer have high foam stability. Thus, it is preferable that the liquid fixer contain fatty acid alkanolamide of (1:1) type. The fatty acid alkanolamide includes (1:1) type and (1:2) type, however, the (1:1) type fatty acid alkanolamide may be suitable for the liquid fixer according to the embodiment.

Note that the particles subject to fixing that contain resin are not limited to the toner but may be any particles containing resin. For example, the particles may be resin-containing particles that contain a conductive material. Further, the recording medium is not limited to recording paper but may be metal, resin, or ceramics. Note that it is preferable that the recording medium include excellent permeability. If a medium substrate contains no liquid permeability, it is preferable to provide a liquid permeation layer over the medium substrate. Moreover, the recording medium is not limited to a sheet type but may be a three-dimensional material having a flat surface and a curved surface. For example, the particles subject to fixing may be transparent resin particles that are uniformly fixed on the medium such as paper to protect the surface of the medium (e.g., varnish).

Among the particles containing resin, the toner particles used in a electrophotography process exhibit excellent fixing properties in combination with the liquid fixer of the embodiment. The toner contains colorants, a charge inhibitor, and resin such as a binding resin or a mold release agent. The resin contained in the toner is not particularly specified. Preferable examples of the binding resin include polystyrene resin, styrene acrylic copolymer resin, and polyester resin, and preferable examples of the mold release agent include wax components such as carnauba wax and polyethylene. The toner may further contain known colorants, charge-controlling agents, flowability-improving agents, and external additives other than the binding resin. Further, it is preferable that the toner be provided with water repellent treatment by causing hydrophobic particulates such as hydrophobic silica containing a methyl group and hydrophobic titanium oxide to adhere to surfaces of the toner particles. Preferable examples of the recording medium are not particularly specified but include paper, cloth, and a plastic film such as an OHP sheet containing a liquid permeation layer. In this embodiment, oiliness indicates properties having the solubility in water of 0.1 wt % or less at room temperature of 20° C.

Moreover, it is preferable that the fixer in a foam include sufficient affinity to toner particles having water repellent treatment. The affinity herein indicates the wettability on a surface of a solid when a liquid is in contact with the solid. That is, it is preferable that the fixer in a foam exhibit sufficient wettability on the surfaces of toner particles having water repellent treatment. The water repellent surfaces of the toner particles covered with the hydrophobic particulates such as hydrophobic silica containing a methyl group and hydrophobic titanium oxide are covered with the methyl group contained in the surfaces of the hydrophobic silica and the hydrophobic titanium oxide, so that the water repellent surfaces of the toner particles covered with the hydrophobic particulates have surface energy of approximately 20 mN/m. However, in practice, the water repellent surfaces of the toner particles are not completely covered with the hydrophobic particulates, and the water repellent surfaces of the toner particles covered with the hydrophobic particulates have surface energy of approximately from 20 to 30 mN/m. Accordingly, it is preferable that the fixer in a foam have the surface tension of 20 to 30 mN/m in order to sufficiently exhibit affinity (wettability) to the surfaces of toner particles having water repellent treatment.

If the aqueous solvents are used in the foamed fixer, it is preferable that the fixer in a foam have the surface tension of 20 to 30 mN/m by adding a surfactant. Further, it is preferable that the aqueous solvents contain a monovalent alcohol or a polyvalent alcohol. The above-described alcohols may provide high foam stability and resistance to bubble break. Preferable examples of alcohols include the monovalent alcohols such as a cetanol (cetyl alchohol) and the polyvalent alcohols such as glycerin, propylene glycol, and 1,3-butylene glycol. Note that the recording medium such as paper may be prevented from curling by adding the monovalent or polyvalent alcohols to the foamed fixer that is applied over the recording medium.

The liquid fixer may preferably form O/W emulsion or W/O emulsion by containing oily components so as to improve the permeation of the fixer or to suppress curling of the medium such as paper. In this case, preferable examples of the dispersant include sorbitan fatty acid esters such as sorbitan monooleate, sorbitan monostearate, and sorbitan sesquioleate, and sucrose esters such as sucrose laurate ester and sucrose stearic acid ester.

Note that an example of a method for dissolving or dispersing the softener in the liquid fixer or making microemulsion dispersion includes a method for mechanically stirring the softener with the liquid fixer by rotary-vanes of a homomixer or a homogenizer or a method for stirring the softener with the liquid fixer by applying ultrasonic oscillation using an ultrasonic homogenizer. In either cases, a strong shear force is applied to the softener in the liquid fixer to obtain microemulsion dispersion.

The fixing device 30 may include a pair of (e.g., a pair of hard rollers) smoothing rollers for applying pressure on the dissolved or swollen toner that is obtained by dissolving or swelling at least part of the resin in the toner with a softener after the application of the fixer over the toner. When the pair of smoothing rollers pressurizes the surface of the dissolved or swollen toner layer to be smoothed, the surface of the dissolved or swollen toner layer may be made glossy. Further, with the application of pressure on the surface of the dissolved or swollen toner layer using the pair of smoothing rollers, the dissolved or swollen toner is embedded in the recording medium, and hence the fixing properties to fix the toner in the recording medium may be improved.

EXAMPLES

Next, examples of fixing experiments carried out by the inventors of the present application are described as follows. Note that toner is used as resin containing particulates in the fixing experiments.

First Fixing Experimental Example

A liquid fixer was prepared as follows. First, a solution having the following components was prepared.

(1) Diluent Solvent ion exchanged water: 53 wt %

(2) Softner
diethoxyethyl succinate (Croda DES by Croda Corporation): 10 wt %
propylene carbonate: 20 wt %
(3) Thickner
propylene glycol: 10 wt %
(4) Foam Booster
coconut oil fatty acid diethanolamide (1:1) type (Marpon MM by Matsumoto Yushi Seiyaku Co., Ltd): 0.5 wt %
(5) Foaming Agent
amine palmitate: 2.5 wt %
amine myristate: 1.5 wt %
amine stearate: 0.5 wt %
(6) Dispersant
POE (20) sorbitan laurate (RHEODOL TW-S120V by Kao Corporation): 1 wt %
polyethylene glycol monostearate (EMANON 3199 by Kao Corporation): 1 wt %

Note that the dispersant is used for facilitating the softener to be dissolved in the diluent solvent. Aliphatic amine is synthesized by fatty acid and triethanolamine.

The above components excluding the softener were mixed with stirring at a solution temperature of 120° C. to thereby prepare a solution. Subsequently, the softener was mixed in the solution using the ultrasonic homogenizer to prepare the liquid fixer (formulated liquid before foaming).

Next, the fixing device 30 was configured in the following manner. A unit to generate foamed fixer Bu having a large bubble size was composed of the following units. A bottle made of PET (polyethylene terephthalate) resin was prepared as the liquid fixer container 31. A tube pump (an inner diameter of 2 mm, tube material: silicone rubber) was prepared as the transfer pump 33. A silicone rubber tube having an inner diameter of 2 mm was prepared as the transfer pipe 34. A stainless steel wire mesh (#400) having a pore size of approximately 40 μm was prepared as the microporous sheet 37 for generating large bubbles.

A unit to make large bubbles into small bubbles was produced with the following configurations. An inner cylinder of a double cylinder was fixed on a rotational shaft, and was then rotated by a rotational drive motor (not shown). The PET resin was used as a material of the double cylinder. A cylinder having an inner diameter of 10 mm and a length of 120 mm was prepared as an outer cylinder 38*a*. A cylinder having an outer diameter of 8 mm and a length of 100 mm was prepared as the inner cylinder 38*a*. The number of revolutions of the double cylinder was varied within a range of 1000 to 200 rpm.

The foamed fixer Bu was applied on the surface of the application roller 41 based on the following configuration. A small amount of the foamed fixer Bu was supplied from the nozzle 39 to a gap between the surface of the application roller 41 and the thickness adjusting blade 42. The gap between the surface of the application roller 41 and the thickness adjusting blade 42 was set at two distances: 25 μm and 40 μm.

The pressure roller 43 was formed by applying a polyurethane foam material having an outer diameter of Φ50 mm ("Colorfoam EMO" (brand name) by Inoac Corporation) on a cored bar composed of an aluminum alloy roller (Φ10 mm). The application roller 41 was formed by coating baking finish PFA resin over a stainless steel (SUS) roller (Φ30 mm). The thickness adjusting blade 42 was formed by bonding an aluminum alloy support plate with a sheet glass having a thickness of mm. The glass surface was upwardly directed to the application roller 41 side so as to adjust the gap between the application roller 41 and the glass surface within a range of 10 to 100 μm. The transfer velocity of the transfer sheet was set at 150 mm/s.

Using a printer test machine having the fixing device 30 having the above-described configuration (IPSiO Color CX8800 by Ricoh Company, Ltd.), the transfer pump 33 was driven when a PPC sheet (T-6200 Ricoh Company, Ltd.), on which unfixed color toner image was formed, was fed into the fixing device 30. The liquid fixer was pumped up from the fixer container 31, passed through the liquid path to be supplied to the air-liquid mixer 35 (i.e., large bubble generator) configured to generate the foamed fixer Bu having large bubbles and then to the micro-bubble generator 38 configured to make the large bubbles into small bubbles. After 1 second, the foamed fixer having microbubbles having a bubble side of 5 to 30 μm was supplied from a liquid outlet of the nozzle 39 to the application roller 41. Note that the density of the foamed fixer Bu obtained was 0.05 g/cm$^3$.

A foamed fixer application test was conducted under the following three conditions: A) a nip width: 1 mm with a nip time: 6 ms, B) a nip width: 15 mm with a nip time: 100 ms, and C) a nip width: 21 mm with a nip time: 140 ms. Note that the thickness of the toner layer was in the range of 30 to 40 μm.

Figure 18:
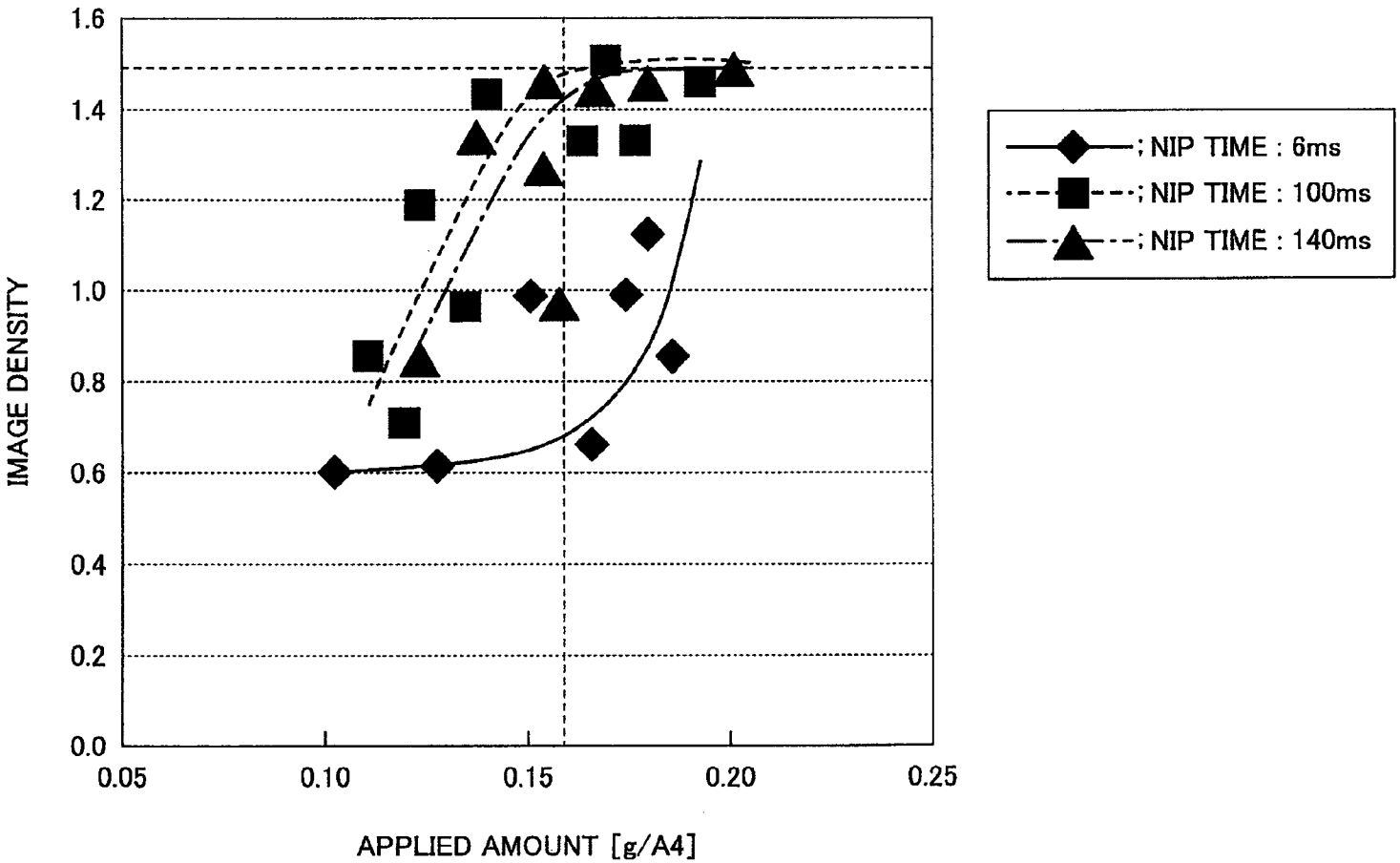
FIG. 18 is a graph illustrating a relationship between image density and an amount of the foamed fixer applied.

The results are illustrated in FIG. 18. The permeation time of the foamed fixer Bu in the toner layer was in a range of 80 to 100 ms. When the amount of the foamed fixer Bu applied on the transfer sheet P was 0.15 g/A size sheet, the thickness of the foamed fixer on the application roller 41 (hereinafter also called a "foam thickness") was approximately 50 μm. When the amount of the foamed fixer Bu applied on the transfer sheet P was 0.1 g/A size sheet, the foam thickness on the application roller 41 was approximately 35 μm. When the amount of the foamed fixer Bu applied on the transfer sheet P was 0.2 g/A size sheet, the foam thickness on the application roller 41 was approximately 70 μm. Note that decrease in image density indicates insufficient deposition of toner on the transfer sheet P due to the toner offset (toner attached to the application roller 41).

As illustrated in FIG. 18, when the thickness of the foamed fixer applied was larger than the thickness of the toner layer (applied amount=0.15 g/A size sheet or more) and the nip time set was equal to or longer than the permeation time of the foamed fixer in the toner layer, the fixed toner image obtained sufficient density, thereby exhibiting good fixing properties. However, when the thickness of the foamed fixer applied was larger than the thickness of the toner layer but the nip time set was shorter than the permeation time of the foamed fixer in the toner layer, insufficient fixation of the toner image on the transfer sheet P was found due to the toner attached to the application roller 41 (toner offset), thereby significantly lowering image density.

Likewise, when the thickness of the foamed fixer applied was smaller than the thickness of the toner layer (applied amount=0.15 g/A size sheet or less) and the nip time set was equal to or longer than 100 ms, insufficient fixation of the toner image on the transfer sheet P was found due to the toner attached to the application roller 41 (toner offset), thereby significantly lowering image density. This result may have the following reason: as illustrated in FIG. 15, when the thickness of the foamed fixer applied is smaller than the thickness of the toner layer, the permeation time of the foamed fixer in the toner layer gets significantly longer, which may have caused the nip time shorter than the permeation time of the foamed fixer in the toner layer.

Second Fixing Experimental Example

Figure 19:
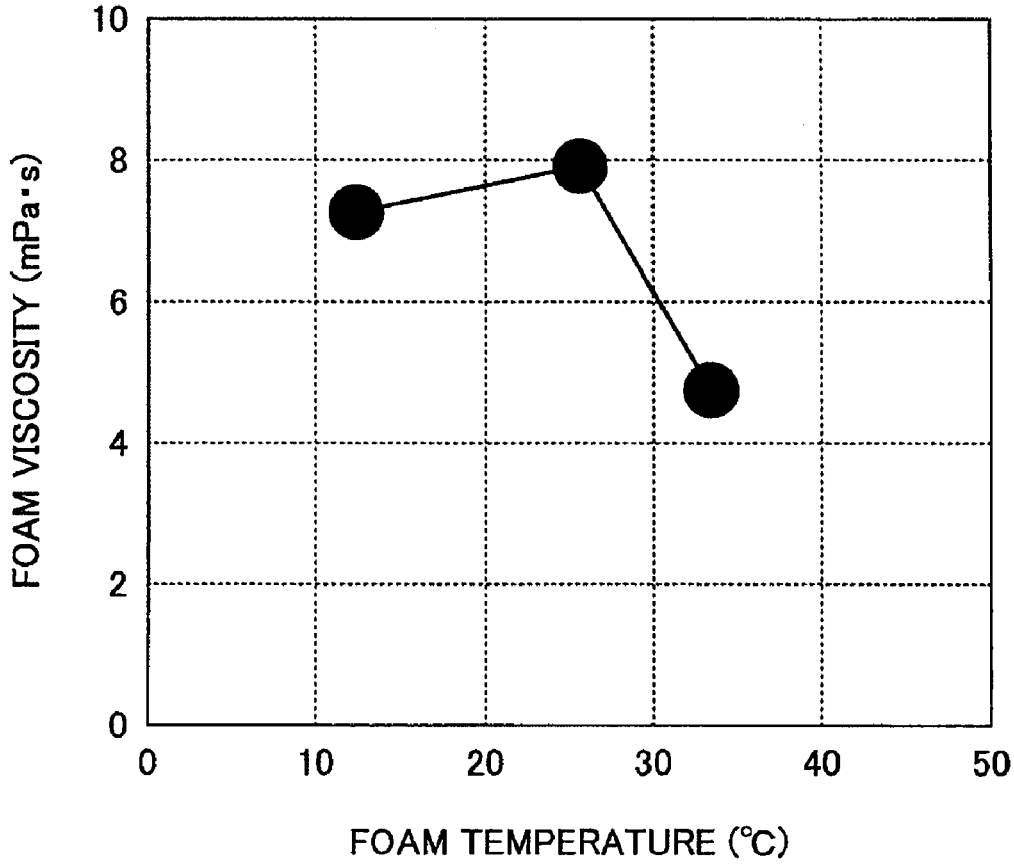
FIG. 19 is a graph illustrating a relationship between a foamed fixer temperature and the foamed fixer viscosity.

The liquid fixer and the fixing device 30 were prepared in the same manner as the first fixing experimental example. However, the fixing test was conducted under three different temperatures of 15° C., 25° C., and 35° C. of ambient atmosphere of the printer. FIG. 19 illustrates a relationship between foamed fixer temperature and foamed fixer viscosity (measured by the above cone-plate rotational viscometer having a rotator diameter of Φ60 mm, a cone angle of 1 degree, and a gap between a cone and a plate of 3 mm, at a speed where the number of revolutions per second was 10). As illustrated in FIG. 19, the viscosity of the foamed fixer varied with the temperature (viscosity lowered at high temperature). Further, as already shown in FIG. 17, the permeation time of the foamed fixer in the toner layer varied with the viscosity of the foamed fixer. The obtained data in FIG. 19 was tabulated in a table. The fixing device 30 was further provided with a temperature detector and a mechanism that was configured to change a distance between the shafts of the application roller 41 and the pressure roller 43 having a sponge roller such that the nip time was equal to or longer than the permeation time of the foamed fixer in the toner layer based on temperature signals.

Using the printer test machine having the fixing device 30 having the above-described mechanism (IPSiO Color CX8800 by Ricoh Company, Ltd.), the fixing test was conducted under the three different temperatures of 15° C., 25° C., and 35° C. of ambient atmosphere of the printer. Sufficient fixation of the toner image on the transfer sheet P was found in the three different temperatures of 15° C., 25° C., and 35° C. of ambient atmosphere of the printer.

Third Fixing Experimental Example

In order to examine the effect of the (1:1) type fatty acid alkanolamide obtained in the first fixing experimental example, the following three types of liquid fixers were prepared: (A) the same liquid fixer as that prepared in the first fixing experimental example, (B) the same liquid fixer as that prepared in the first fixing experimental example without fatty acid alkanolamide, and (C) the liquid fixer including (1:2) type fatty acid alkanolamide (i.e., coconut oil fatty acid diethanolamide (1:2) type (Marpon LS by Matsumoto Yushi Seiyaku Co., Ltd)) instead of the (1:1) type fatty acid alkanolamide used in the first fixing experimental example. Thereafter, the fixing test was conducted by applying the foamed fixer made of the three liquid fixers to unfixed color toner image on the transfer sheet P using the printer test machine (IPSiO Color CX8800 by Ricoh Company, Ltd.).

As illustrated in Table 1 below, the foamed fixer containing the (1:1) type fatty acid alkanolamide had uniform foam film without pin holes, thereby exhibiting excellent fixing properties. By contrast, fine pin holes (having approximately Φ0.5 mm) were obtained in the liquid thin film of the foamed fixer without the (1:1) type fatty acid alkanolamide and the liquid fixer including (1:2) type fatty acid alkanolamide, which resulted in fixation defect on the fixed toner image on the transfer sheet P due to infinite number of pin holes.

Thus, the result shows that the foamed fixer having the (1:1) type fatty acid alkanolamide exhibits an excellent effect on the fixing of the toner image on the transfer sheet P.

TABLE 1

| Aliphatic amine concentration wt % | Coconut fatty acid diethanolamide | Foam viscosity (mPa · s) | Presence of fine pin holes in thin film of foamed fixer |
|---|---|---|---|
| 4 | 0 | 3.70 | Small amount |
| 4 | (1:1) type: 0.5 | 5.15 | None |
| 4 | (1:2) type: 0.5 | 4.52 | Small amount |

Next, a cleaning device configured to clean the application roller 41 is described with reference to FIG. 4. The unfixed toner layer T on the transfer sheet P applied with the foamed fixer Bu softens when passing through the application position of the application nip C where the unfixed toner layer T is in contact with the application roller 41. The application roller 41 configured to apply the foamed fixer Bu to the transfer sheet P applies the foamed fixer Bu to the unfixed toner layer T on the transfer sheet P while being in contact with the unfixed toner layer T. In this process, it is ideal that an entire amount of the foamed fixer Bu on the application roller 41 be applied on the transfer sheet P and the application roller 41 be clean while the transfer sheet P is passing through the application position of the application nip C where the application roller is in contact with the transfer sheet P. However, in reality, the process may not follow such an ideal manner due to mechanical component variability or assembly variability, environmental variability, and time variability. That is, some amount of the foamed fixer Bu or offset toner particles Ta (i.e., toner particles attracted from the unfixed toner layer on the transfer sheet P) may remain on the application roller 41 after having passed through the application nip C.

The foamed fixer Bu remaining on the application roller 41 after having passed through the application nip C (hereinafter called "residual foamed fixer Ba") on the application roller 41 follows the surface movements of the application roller 41 more exactly than the liquid fixer remaining on the application roller 41. Accordingly, when the surface of the application roller 41 rises upwardly due to the rotation, the residual foamed fixer Ba also rises upwardly with the surface movements of the application roller 41. This means that almost the entire amount of the residual foamed fixer Ba on the application roller 41 after passing through the application nip C moves along the surface movements of the application roller 41 without dripping. However, if the residual foamed fixer Ba is still on the application roller 41, new foamed fixer Bu applied to the application roller 41 from the nozzle 39 and the residual foamed fixer Ba is mixed when the application roller 41 has made one revolution. As a result, image quality may degrade due to the unstable thickness of the foamed fixer applied on the application roller 41, or reapplication of offset toner particles Ta on the transfer sheet P. Further, fixing quality may also degrade due to contamination of the foamed fixer Bu with the residual foamed fixer Ba containing offset toner particles Ta that are circulated with the surface movements of the application roller 41. Thus, the residual foamed fixer Ba or the offset toner particles Ta may need to be removed from the application roller 41.

Figure 1:
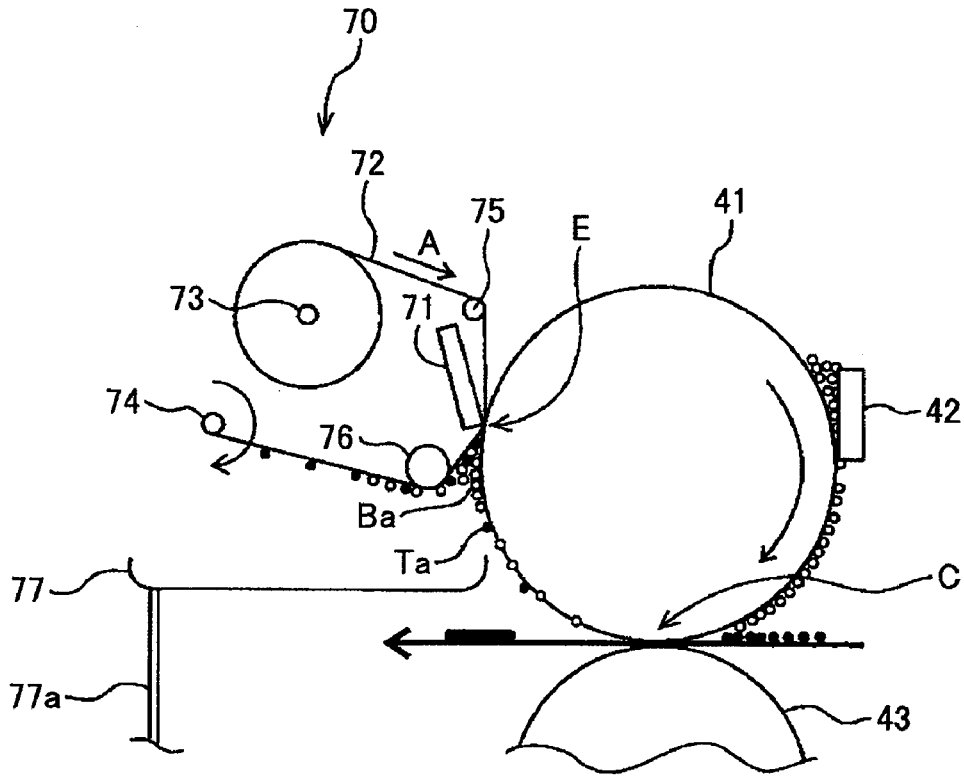
FIG. 1 is an enlarged view illustrating an application member-cleaning device according to an embodiment of the invention.

Next, characteristics of the printer 100 are described below. FIG. 1 is an enlarged view illustrating the application roller 41 and an application member cleaning device 70. The fixer application unit 140 of the fixing device 30 includes the application member cleaning device 70 configured to clean the surface of the application roller 41 after passing through the application position of the application nip C where the foamed fixer Bu is applied to the transfer sheet P by abutting a web 72 composed of polyethylene terephthalate (PET) film on the surface of the application roller 41 before passing through a supply position of the foamed fixer Bu from the fixer supply unit 130. The application member cleaning device 70 includes a web 72 configured to be made windable and be brought into contact with the application roller 41 while moving on the surface of the application roller 41 in an opposite direction to the surface movement direction of the application roller 41, and a film abutting blade 71 configured to abut on the surface of the application roller 41 via the web 72 as a cleaning blade at an abutting position E where the web 72 is brought into contact with the application roller 41.

The application member cleaning device 70 further includes a rotational progressive shaft 73, around a surface of which the belt-shaped web 73 is looped numerous times. The application member cleaning device 70 further includes a rotational winding shaft 74 configured to wind up the belt-shaped web 72 from a downstream side in a surface movement direction of the belt-shaped web 72. The winding shaft 74 rotates in a clockwise direction to wind up the web 72 while the progressive shaft 73 reels out the web 72 in an amount equal to the wound-up amount of the web 72 in a direction shown by an arrow A.

A portion between the progressive shaft 73 and the winding shaft 74 of the belt-shaped web 72 is pressed on the surface of the application roller 41 by the film abutting blade 71 while being stretched with a predetermined tension. The residual foamed fixer and the offset toner particles Ta are blocked at the abutting position E between the wedge shape portion at an upstream side in a surface movement direction of the application roller 41 and the surface of the application roller 41 after the surface of the application roller 41 has passed through the application nip C.

The application member cleaning device 70 further includes a first guide roller 75 at an upstream side along a surface movement direction (the direction indicated by the arrow A) of the web 42 to the abutting position E and a second guide roller 76 at a downstream side along the surface movement direction of the web 42 to the abutting position E. The application member cleaning device 70 is configured such that the web 72 stretched by the first and second guide rollers 75 and 76 in parallel with a tangential line of the application roller 41 at the abutting position E is pressed on the surface of the application roller 41 by the abutting blade, thereby cleaning the surface of the application roller 41. A edge of a film abutting blade 71 can abut on the application roller 41 by the contact-separate mechanism (not shown) and can be detached from the application roller 41 when the abutting of the film abutting blade 71 is cancelled.

In the application member cleaning device 70, the first and second guide rollers 75 and 76 are configured to prevent meandering motion of or crease out of the web 72. In order to prevent the meandering motion of the web 72, the first and second guide rollers 75 and 76 are configured to include slightly larger diameters at both ends of their shafts than at centers thereof. The web 72 receives a linear pressure from the edge of the film abutting blade 71 to block the residual foamed fixer Ba and the offset toner particles Ta at the abutting position E, thereby preventing the residual foamed fixer Ba and the offset toner particles Ta from entering the fixer application portion where the fixer supply unit 130 applies a new foamed fixer Bu on the surface of the application roller 41. A new surface portion of the web 72 is constantly pulled out at an arbitrary timing by winding the web 72 on the winding shaft 74, and the residual foamed fixer Ba and the offset toner particles Ta accumulated at the abutting position E adhere to the surface of the web 72 to be wound on the winding shaft 74.

The film abutting blade 71 presses the web 72 from an opposite side (i.e., rear side) of the surface where the residual foamed fixer Ba and the offset toner particles Ta adhere. Thus, if the web 72 has solvent resistance to the softener contained in the liquid fixer, the film abutting blade 71 is not directly brought into contact with the liquid fixer. That is, a material of the film abutting blade 71 may not have the solvent resistance to the softener contained in the liquid fixer. In general, urethane rubber is used for a material of a cleaning blade. However, if the urethane rubber is used for the material for the cleaning blade to clean the application member that applies the liquid fixer, the cleaning blade may swell due to the softener contained in the liquid fixer. Accordingly, if the cleaning blade is configured to directly abut on the application member, other materials such as ethylene-propylene rubber (EPDM), silicon, and fluorocarbon rubber are preferably used for the cleaning blade. However, since those materials have less durability than urethane rubber, a cycle of component replacement may be reduced, which may cause the difference in life-span between the cleaning blade and other components. This may result in an increase in component replacement cost. By contrast, in the application member cleaning device 70 according to the embodiment having the above configuration, since the film abutting blade 71 (i.e., the cleaning blade) presses the web 72 from the rear side thereof, the cleaning blade made of urethane rubber that may be swollen with the softener can be used. Note that in this configuration, it is preferable that a width of the web 72 be larger than that of the film abutting blade 71 in a width direction perpendicular to the surface movement direction of the web 72.

It is preferable that the foamed fixer Bu to be applied have an area similar to that of the transfer sheet P at the application nip C to eliminate waste of the foamed fixer Bu. However, since the foamed fixer Bu needs to be applied on the entire surface of the transfer sheet P, some conditions must be satisfied in order to apply the foamed fixer Bu in the area similar to that of the transfer sheet P, such as allowable amounts of transfer sheet skew, the foamed fixer straining, and the like. Accordingly, the foamed fixer Bu may also adhere to the surface of the pressure roller 43 due to the unsatisfied conditions. The foamed fixer Bu adhered to the pressure roller 43 may, if not cleaned, be transferred to the transfer sheet P. A rear side of the transfer sheet P is brought into contact with guide plates and rollers that constitute a sheet transfer path after the fixing of toner. Further, if the printer is set at a duplex copy mode, the rear side of the transfer sheet P is brought into contact with toner image carriers such as the intermediate transfer belt and the photoreceptors, thereby significantly affecting the components inside the printer. Accordingly, it is preferable that the pressure roller 43 be cleaned in a similar manner as the application roller 41. As illustrated in FIG. 4, the fixing device 30 according to the embodiment further includes a pressure member cleaning device 80 having a configuration similar to the application member cleaning device 70.

Note that since the pressure roller 43 in the pressure member cleaning device 80 is not susceptible to toner adhesion, a web 72 may be wound at a slower timing than at the timing of the web 72 wound, and the amount of the web 72 to be wound in the pressure member cleaning device 80 may be smaller than that of the web 72 in the application member cleaning device 70. In view of a web replacement cycle, a winding rate of the web 72 in the pressure member cleaning device 80 is preferably 1/n of that of the web 72 in the application member cleaning device 70. That is, the web in the pressure member cleaning device 80 is replaced simultaneously at every n times of the web replacement in the application member cleaning device 70.

Figure 20:
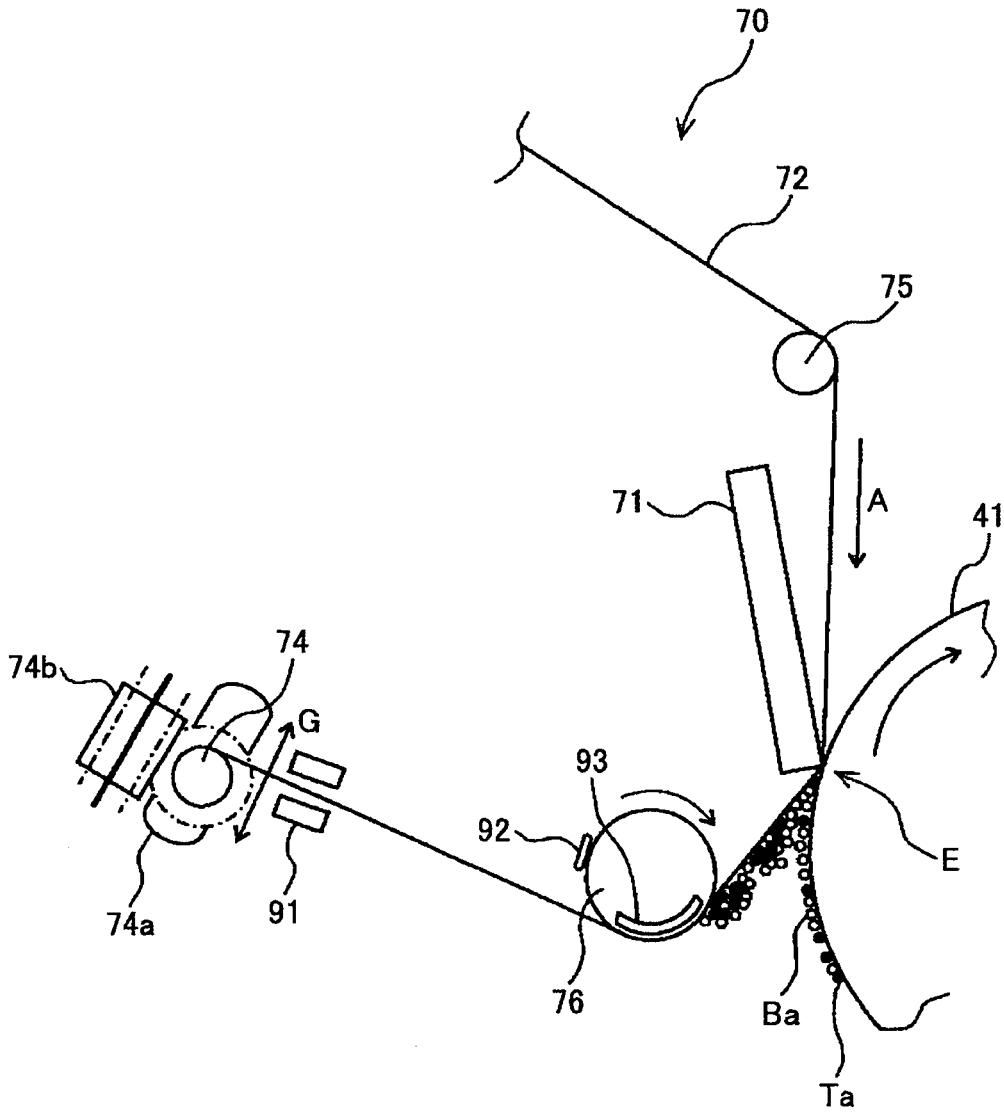
FIG. 20 is an enlarged configuration view illustrating a second guide roller and periphery of the second guide roller.

FIG. 20 is an enlarged view of a periphery of a second guide roller 76. As illustrated in FIG. 20, the second guide roller 76 includes a heater 93 to control temperatures of the second guide roller 76. The residual foamed fixer Ba is quickly defoamed by the application of heat by the heater 93 to allow the residual foamed fixer to be liquefied into the liquid fixer, and the offset toner particles Ta adhered to the web 72 is wound up on the winding shaft 74. If the amount of the liquefied residual fixer is large, the liquefied residual fixer is dripped onto a fixer collecting tray 77 due to the self weight of the liquefied residual fixer, and then passed through the fixer collecting pipe 77*a* to be collected by a fixer collecting container 78. The application member cleaning device 70 and the pressure member cleaning device 80 may either share the same fixer collecting container 78 or may each have the fixer collecting container 78 to collect the liquefied residual fixer from the application member cleaning device 70 and the pressure member cleaning device 80. The fixer collecting container 78 includes a capacity limit detecting sensor 79 configured to notify a user or a service engineer of a collecting time.

A drive signal is input from one end (first end) of the winding shaft 74 in an axis direction so that the other end (second end) of the winding shaft 74 is moved by a winding shaft moving mechanism in a direction perpendicular to a winding direction of the web 72 as shown by an arrow G. The winding shaft moving mechanism is configured such that the second end of the winding shaft 74 is fit in a slide guide hole 74*a* a longitudinal direction of which corresponds to the direction shown by the arrow G. Accordingly, a position of the second end of the winding shaft 74 in the direction shown by the arrow G may be adjusted by the rotation of a worm wheel 74*b*. The winding shaft moving mechanism includes a deviation detecting sensor 91 to detect a position of a portion of the web 72 stretched between the second guide roller 76 and the winding shaft 74 in a width direction of the web, thereby detecting the deviation of the web 72. The winding shaft moving mechanism controls the rotation of the worm wheel 74*b* so as to adjust the position of the second end of the winding shaft 74 (not shown) indicated by the arrow G based on (information including a deviation direction and a deviation amount) deviation detecting sensor 91.

The web in general meanders while being wound up. Since the foamed fixer or toner adheres on the web 72 in the application member cleaning device 70, the thickness of the web 72 changes according to the amount of the foamed fixer or toner. This is because the amount or position of the offset toner particles Ta varies from one place to another on the web 72 just as the amount or position of the offset toner particles Ta varies from one transfer sheet P to another. Thus, the meandering of the web 72 caused by the amount and the position of the offset toner particles Ta needs to be controlled while being wound on the winding shaft 74.

The deviation detecting sensor 91 configured to optically detect the deviation of the web 72 is preferable to that configured to detect the deviation mechanically, because optical detection provides less adverse effect than mechanical detection on the web 72 composed of a thin film. However, since the web 72 is composed of a transparent thin film, the ends in the width direction of the web 72 may not be optically detected. In order to overcome this drawback, light shielding is provided with an entire or the ends of the web 72. For example, the web 72 may be formed of a color film member, the web 72 may be patterned at its ends in the width direction, or the web 72 may be roughened to thereby shield light from the web 72.

Figure 21:
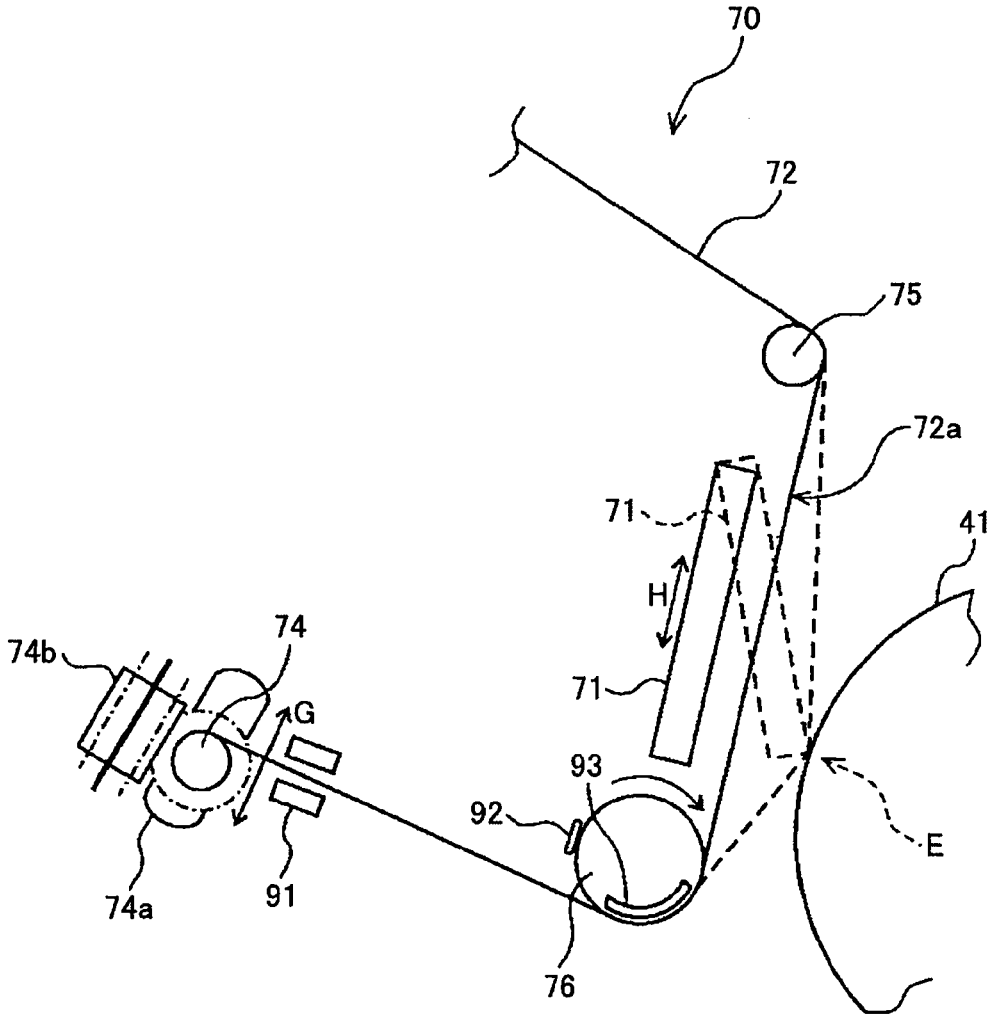
FIG. 21 is a view illustrating a process in which a film-abutting blade is transferred away from the application roller.

FIG. 21 is a view illustrating a process in which the film-abutting blade 71 abutting on the application roller 41 illustrated in FIG. 20 is detached from the application roller 41. The film-abutting blade 71 abutting on the application roller 41 as illustrated in broken lines in FIG. 21 is detached from the application roller 41 as illustrated in solid lines in FIG. 21 by driving the contact-separate mechanism (not shown), thereby cancelling the abutting of the film-abutting blade 71 on the application roller 41. Likewise, the web 72 pressed on the surface of the application roller 41 as illustrated in broken lines in FIG. 21 is detached from the application roller 41 as illustrated in solid lines in FIG. 21 while the film-abutting blade 71 is detached from the application roller 41. In this process, a stretched surface 72*a* of the web 72 between the first and second guide rollers 76 is flat as illustrated in FIG. 21. Further, in the application member cleaning device 70, an extending direction (indicated by an arrow H) of the film-abutting blade 71 detached from the application roller 41 and the stretched surface 72*a* of the web 72 are approximately in parallel as illustrated in FIG. 21.

Figure 22:
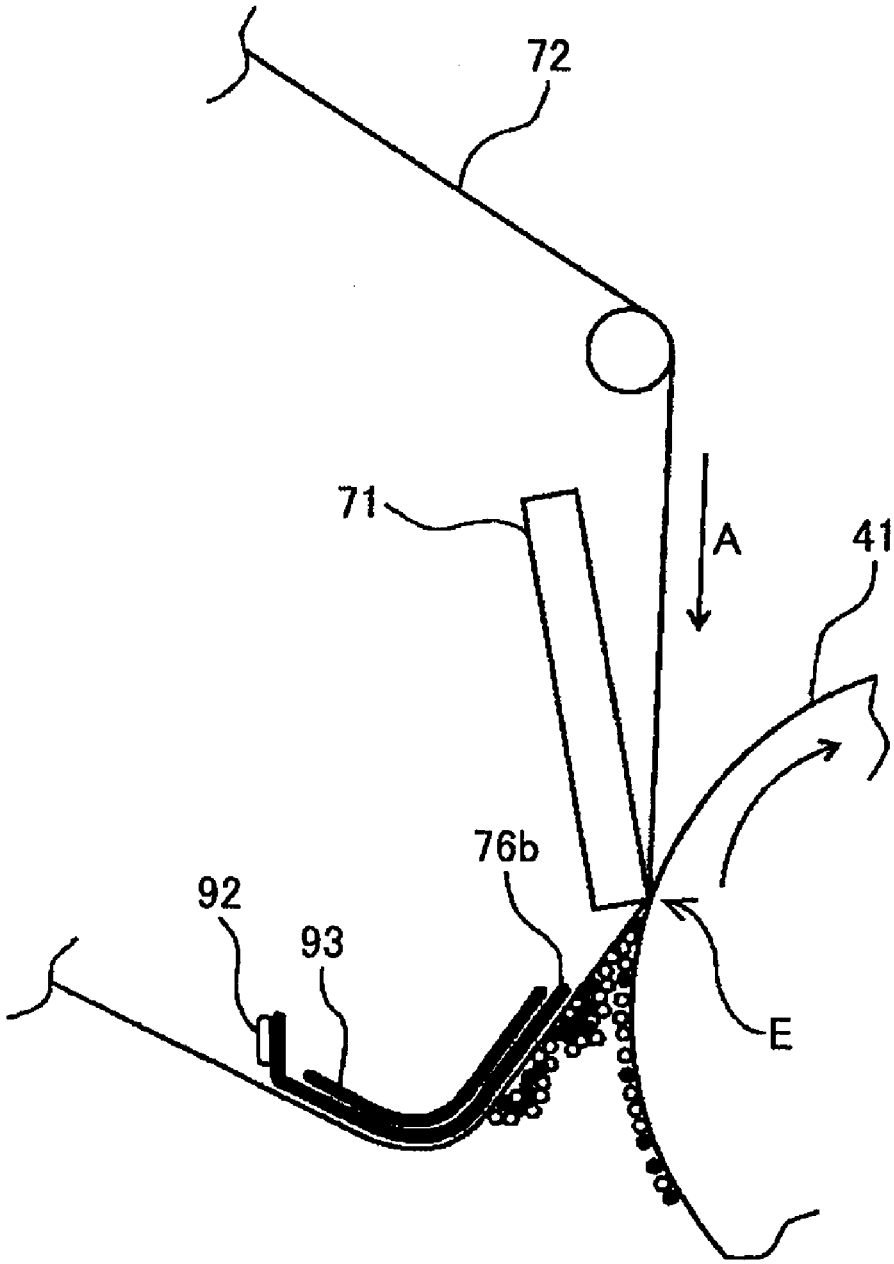
FIG. 22 is a configuration view illustrating that a guide plate is provided as a guide member at a downstream side of an abutting position.

Note that the second guide roller 76 is used as a guide member at the downstream side in the surface movement direction of the web 72 to the abutting position E; however, the guide member is not limited to the roller type second guide roller 76 but may be a guide plate 76*b* as illustrated in FIG. 22. When the guide plate 76*b* is used for guiding the web 72 as illustrated in FIG. 22, the guide plate 76*b* preferably includes a surface with which the web 72 is brought into contact has a reduced frictional coefficient or the guide plate 76*b* is preferably made of a material that has a reduced frictional coefficient. Examples of the guide plate 76*b* having the reduced frictional coefficient generally include Teflon (registered trademark), fluorine coat, polyoxymethylene (POM), and super-high-molecular polyethylene, and the surface of the guide plate 76*b* is preferably roughened to increase the size of an area in contact with the web 72, thereby reducing the frictional coefficient of the surface of the guide plate 76*b*. The reduction of the frictional coefficient of the surface of the guide plate 76*b* reduces resistance to winding the web 72 so that the formation of creases at the abutting position may be suppressed.

With the above configuration, the guide plate 76*b* is brought into contact with a side of the web 72 abutted by the film-abutting blade 71, and the second guide roller 76 configured to guide the web 72 includes the heater 93, thereby heating the web 72 via the second guide roller 76. However, the web 72 is not a subject to be heated by the heater 93 but the residual foamed fixer Ba adhered on the surface of the web 72 that is in contact with the application roller 41 is the subject to be heated by the heater 93. Thus, a defoaming heater 94 may be provided at a position facing the surface of the web 72 that is brought into contact with the application roller 41 in order to heat the residual foamed fixer Ba as illustrated in FIG. 23.

Figure 23:
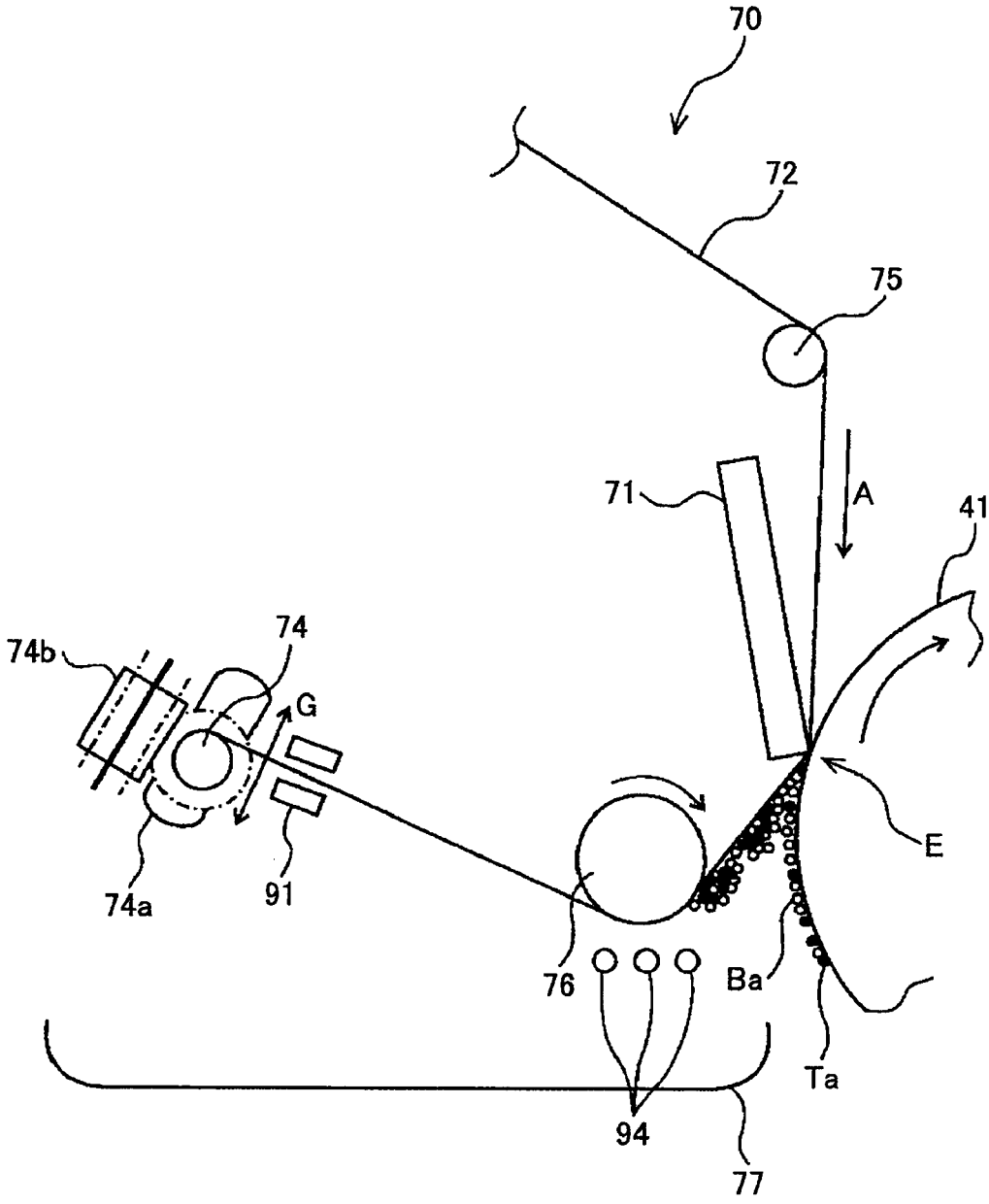
FIG. 23 is a view illustrating the cleaning device in which a heater is provided to face a web surface of a residual foamed fixer carrier.

As illustrated in FIG. 23, the defoaming heater 94 is arranged between the web 72 and the fixer collecting tray 77. Accordingly, when the residual foamed fixer Ba is liquefied by the heat of the defoaming heater 94, the liquefied fixer is dripped onto or in contact with the defoaming heater 94. Thus, the surface of the defoaming heater 94 that is brought into contact with the liquefied fixer preferably includes solvent resistance to the softener contained in the fixer.

Performance evaluation was carried out on configurations of the guide roller (i.e., second guide roller 76) that includes the heater 93 as illustrated in FIG. 20 and of the guide plate 76*b* that includes the heater 93 as illustrated in FIG. 22. The result showed that there was a trade-off relation ship in formation of creases in the web 72 between the thickness of the web 72 and the temperature of the heater 93. That is, in order to suppress the formation of the creases in the web 72, the thicker web 72 and the heater 93 heated at high temperature are preferablely employed. However, since the residual foamed fixer Ba subject to heating adheres on an opposite surface of the web 72, the thicker web 72 may inhibit the heat generated by the heater 93 from transmitting to the residual foamed fixer Ba. Thus, the temperature of the heater 93 may need to be sufficiently increased in order to transmit the generated heat sufficiently to the residual foamed fixer Ba, thereby suppressing the formation of the creases in the web 72.

By contrast, as illustrated in FIG. 23, the defoaming heater 94 is arranged between the web 72 and the fixer collecting tray 74. With this configuration, even when the thickness of the web 72 is increased to suppress the formation of the creases in the web 72, the heat is still sufficiently transmitted to the residual foamed fixer Ba attached on the other side of the defoaming heater 94. Accordingly, the residual foamed fixer Ba is quickly defoamed into the liquefied fixer which is then collected by the fixer collecting tray 77, thereby increasing collection efficiency of the liquefied fixer. Further, in the application member cleaning device 70 illustrated in FIG. 23, a space (distance) between the heater and the web 72 provides an adiabatic effect. Accordingly, in the application member cleaning device 70 in FIG. 23, the temperature of the heater to heat-resistant temperature of the web 72 may be set higher than that in the configurations illustrated in FIGS. 20 and 21. With such a configuration, the residual foamed fixer may securely be defoamed by the application of heat at higher temperatures.

Next, modifications of the printer according to the embodiment are described below. Note that the configurations of the printer according to the following modifications are the same as the configuration of the printer according to the above embodiment unless otherwise specified.

[First Modification]

Figure 24:
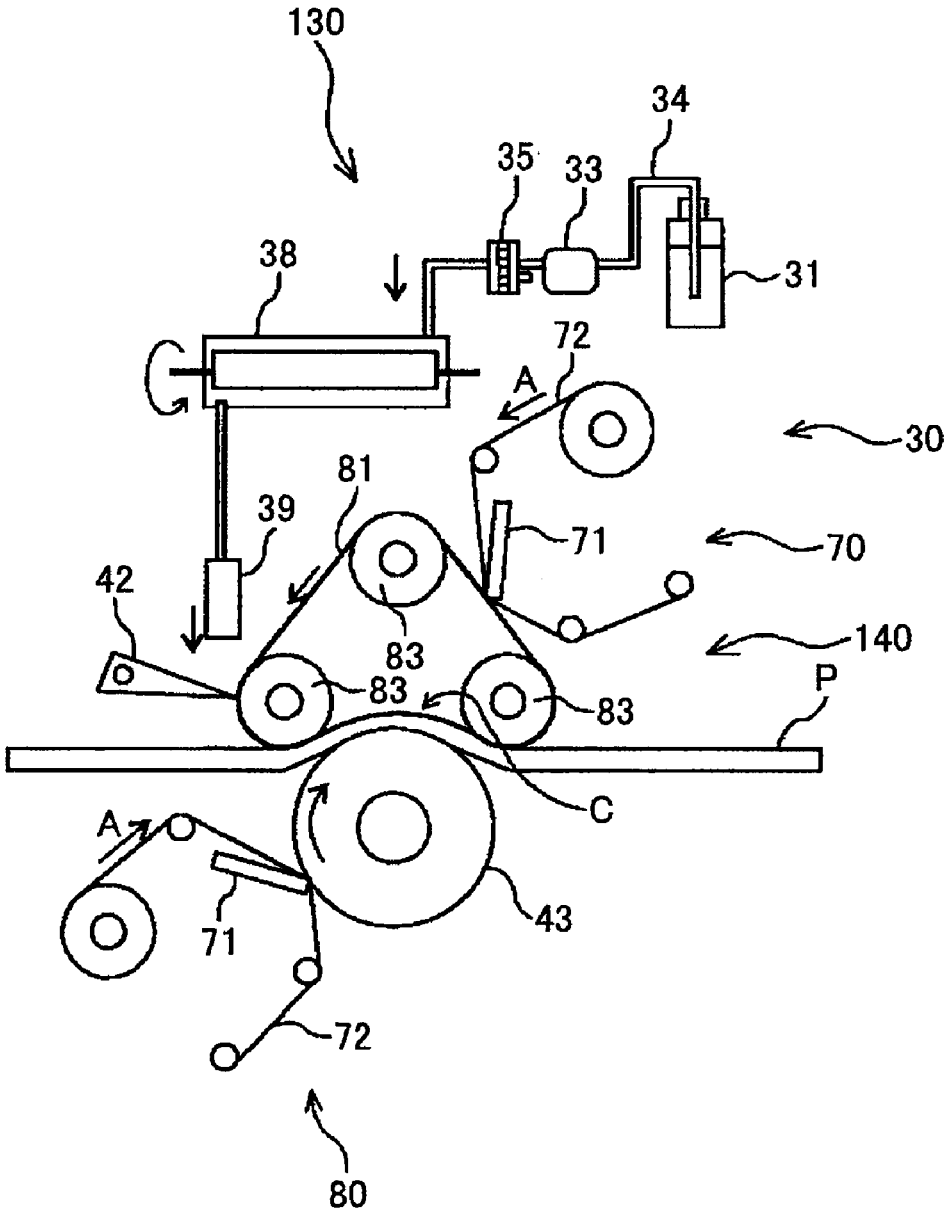
FIG. 24 is an enlarged configuration view illustrating a fixing device of a printer according to a first modification.

FIG. 24 is an enlarged configuration view illustrating the fixing device 30 according to a first modification of the invention. In the fixing device 30 according to the first modification, an application belt 81 is employed as the application member in place of the application roller 41. The endless application belt 81 is configured to endlessly move in a counterclockwise direction while being stretched by plural stretching rollers 83 by rotationally driving one of the stretching rollers 83. A stretched portion between the stretching rollers 83 is configured to abut on the pressure roller 43 to form the application nip C. With this configuration employing the endless application belt 81 as the application member, the endless application belt 81 is flexibly bent along the surface of the pressure roller 43 to form the application nip C that is longer than the application nip C formed between the application roller 41 and the pressure roller 43 in the above embodiment. The application belt 81 may be preferably made by coating a substrate such as a seamless nickel belt or a seamless PET film with mold releasing fluorocarbon resin.

With the configuration employing the endless application belt 81 as the application member, the nip width of the application nip C may be enlarged to increase the nip time. Note that the surface of the application belt 81 after having passed through the application nip C is configured to be cleaned by a cleaning device having the same configuration as the application member cleaning device 70 according to the above embodiment. Note also that the surface of the pressure roller 43 after having passed through the application nip C is configured to be cleaned by a cleaning device having the same configuration as the pressure member cleaning device 80 according to the above embodiment.

[Second Modification]

Figure 25:
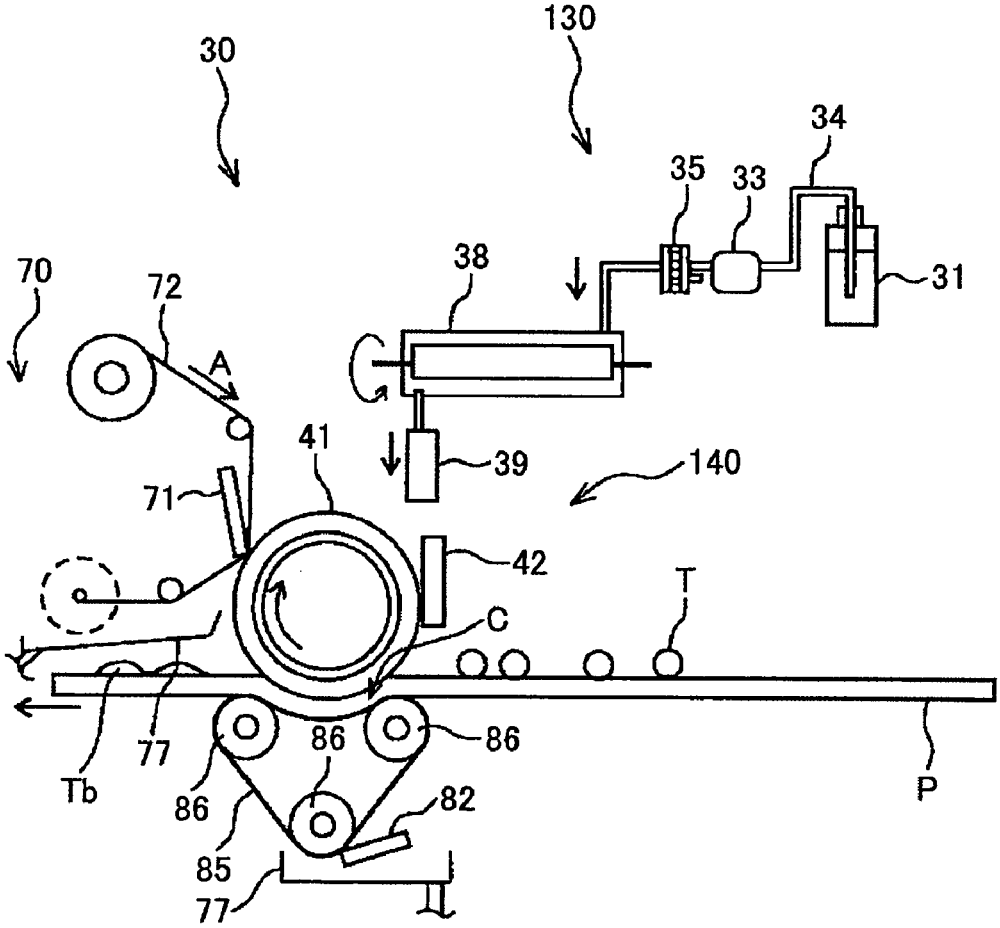
FIG. 25 is an enlarged configuration view illustrating a fixing device of a printer according to a second modification.

FIG. 25 is an enlarged configuration view illustrating the fixing device 30 according to a second modification of the invention. In the fixing device 30 according to the first modification, a pressure belt 85 is employed as the pressure member that abuts on the application member at the application nip C in place of the pressure roller 43. The endless pressure belt 85 is configured to endlessly move in a counterclockwise direction while being stretched by plural pressure stretching rollers 86 by rotationally driving one of the pressure stretching rollers 86. A stretched portion between the pressure stretching rollers 86 is configured to abut on the application roller 41 to form the application nip C. With this configuration employing the endless pressure belt 85 as the pressure member, the endless pressure belt 85 is flexibly bent along the surface of the application roller 41 to form the application nip C that is longer than the application nip C formed between the application roller 41 and the pressure roller 43 in the above embodiment. The pressure belt 85 may be preferably made by coating a substrate such as a seamless nickel belt or a seamless PET film with mold releasing fluorocarbon resin. Note that in the fixing device 30 according to the second modification in FIG. 25, the pressure belt 85 is configured to be cleaned by the pressure belt cleaning belt 82. However, the pressure belt 85 may be configured to be cleaned by a cleaning device the same configuration as the pressure member cleaning device 80 according to the above embodiment.

In the above embodiment and first and second modifications, the web 72 formed of the belt-shaped film that can be wound up is configured to be stretched. However, the web 72 may be formed of an endless loop-type film member and be configured to endlessly move while being sandwiched between the film abutting blade 71 and the application roller 41. In the following third modification, an endless loop-type belt 172 configured to endlessly move in a clockwise direction used as the endless loop film member is described.

[Third Modification]

Figure 26:
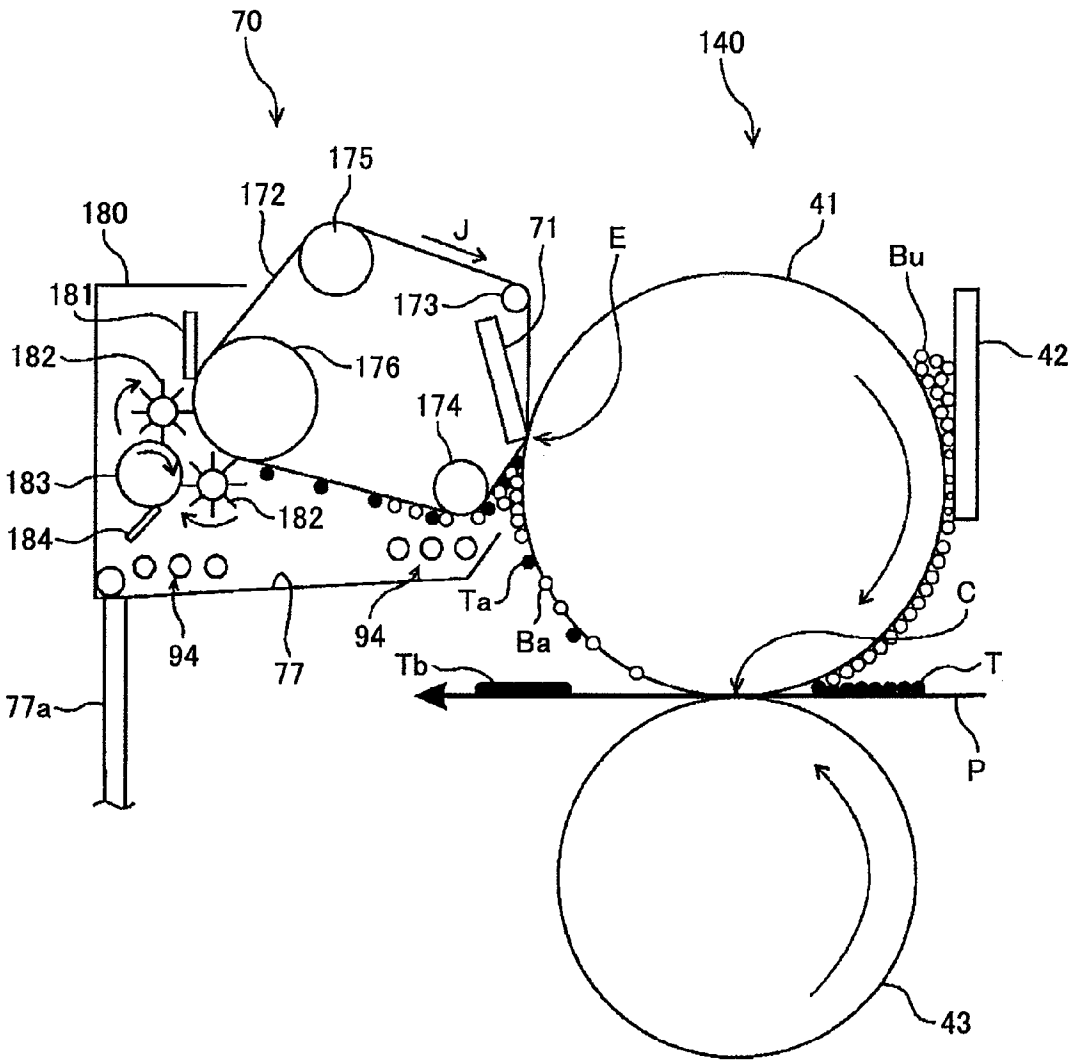
FIG. 26 is an enlarged view illustrating a fixer application portion of a printer according to a third modification.

FIG. 26 is an enlarged view illustrating a fixer application portion 140 of the printer according to the third modification. The fixer application unit 140 of the fixing device 30 includes the application member cleaning device 70 configured to clean the surface of the application roller 41 after passing through the application position of the application nip C where the foamed fixer Bu is applied to the transfer sheet P by abutting an endless belt 172 composed of polyethylene terephthalate (PET) film on the surface of the application roller 41 before passing through a supply position of the foamed fixer Bu from the fixer supply unit 130. The application member cleaning device 70 includes the endless belt 172 configured to be made windable and be brought into contact with the application roller 41 while moving on the surface of the application roller 41 in an opposite direction to the surface movement direction of the application roller 41, and the film abutting blade 71 configured to abut on the surface of the application roller 41 via the endless belt 172 as a cleaning blade at the abutting position E where the endless belt 172 is brought into contact with the application roller 41.

The application member cleaning device 70 further includes a film member cleaning device 180 as a film member cleaning unit configured to remove materials attached on the surface of the endless belt 172 at a position distant from the abutting position E. The endless application belt 172 is configured to endlessly move in a direction shown by an arrow J in FIG. 26 while being stretched by a first stretching roller 173, a second stretching roller 174, a third stretching roller 175, and a fourth stretching roller 176 by rotationally driving one of the first, second, third, and fourth stretching rollers 173, 174, 175, and 176. The endless belt 172 is configured to be pressed between the first and second stretching rollers 173 and 174 by the film abutting blade 71 in the similar manner as in the above embodiment illustrated in FIG. 1 where the web 72 is pressed by the film abutting blade 71 between the first and second guide rollers 75 and 76.

The film member cleaning device 180 includes a film member cleaning blade 181 that is the blade-shaped film member cleaning member configured to abut on the surface of the endless belt 172 at the most downstream side in the surface movement direction of the endless belt 172. The film member cleaning device 180 further includes two nonblade-shaped film member cleaning brushes 182 used as film member cleaning members having a shape differing from a blade, one of which is arranged at a downstream position closest to the abutting position E where the endless belt 172 is brought into contact with the application roller 41 in the surface movement direction of the endless belt 172, and the other of which is arranged at an upstream position where the film member cleaning blade 181 abuts on the endless belt 172 in the surface movement direction of the endless belt 172. Note that both nonblade-shaped film member cleaning brushes 182 are positioned between the film abutting blade 71 and the film member cleaning blade 181 in a direction downstream of the abutting position E where the endless belt 172 is brought into contact with the application roller 41 in the surface movement direction of the endless belt 172. The film member cleaning brushes 182 are each a rotational brush-shaped film member cleaning member and is configured to rotationally remove the adhering matter on the surface of the endless belt 172 by allowing brush fiber of the film member cleaning brushes 182 to be brought into contact with the surface of the endless belt 172.

The film member cleaning device 180 further includes a brush cleaning roller 183 configured to bring a surface of the brush cleaning roller into contact with the film member cleaning brushes 182 to collect the adhering matter therefrom, and a blade-shaped roller member cleaning blade 184 configured to abut on the surface of the brush cleaning roller 183 to remove the adhering matter therefrom.

Since the application member cleaning device 70 according to the third modification employs the endless belt 172 as the film member, the film member may be repeatedly used. The application member cleaning device 70 according to the third modification having the endless belt 172 as the film member may produce less disposal film members than the application member cleaning device having the web 72 having the web 72 as the film member. However, the toner collected from the application roller 41 and attached onto the film member is already dissolved on the surface of the film member, which may solidify or solidify into a solid having high viscosity if it is left on the film member for a substantial amount of time. Accordingly, when the endless belt 172 is employed as the film member, the collected material attached on the surface of the endless belt 172 (i.e., toner from the application roller 41), which may solidify or solidify into a solid having high viscosity if it is left on the film member for a substantial amount of time, needs to be removed, and hence, the film member cleaning device 180 results in having a complex configuration. In addition, it may be difficult to maintain a certain removal performance level in a cleaning unit (i.e., film member cleaning device 180) having the endless belt 172 where the endless belt 172 used as the film member repeatedly removes the adhering matter from the surface of the application roller 41 at the abutting position E.

If the toner softened with the liquid fixer solidifies, the film member cleaning member configured to clean the endless belt 172 may be damaged at a portion where the solidified toner is attached, the endless belt 172 may be damaged by being adhered with the film member cleaning member, and the application roller 41 may be defectively driven. However, if it is possible that the toner softened with the liquid fixer remains unsolidified, the film member that endlessly moves such as the endless belt 172 may be implemented.

Moreover, although the application member cleaning device 70 according to the third modification has a complex cleaning mechanism (i.e., film member cleaning device 180) with the endless belt 172 configured to clean the application member 41, the cleaning mechanism may be arranged at a position distant from the application roller 41. As a result, the film member may be repeatedly used.

The fixing device 30 according to the third modification arranged in the printer 100 is configured to clean a portion of the endless belt 172 having a predetermined length before the printer 100 finishes a print job. In the fixing device 30 according to the third modification before the printer 100 finishes the print job, the endless belt 172 collects adhering matter from the application roller 41 so that the collected adhering matter is attached on the endless belt 172. With this configuration, the toner left on the endless belt 172 may not be left for a substantial amount of time. Accordingly, the number of the film members disposed due to solidified toner there on at the abutting position E may be prevented.

In the application member cleaning device 70 according to the third modification, the fourth stretching roller 176 includes a comparatively large diameter compared to those of other stretching rollers and over which the endless belt 172 is looped is arranged at a position distant from the application roller 41. The endless belt 172 endlessly moves in a direction indicated by an arrow J by rotationally driving the fourth stretching roller 176 as a driving roller. Further, the application member cleaning device 70 according to the third modification includes two film member cleaning brushes 182 that are arranged in the periphery of the fourth stretching roller 176 via the endless belt 172, and brush cleaning roller 183 that are in contact with the two film member cleaning brushes 182.

The film member cleaning brushes 182 rotate in a direction opposite to the surface movement direction of the endless belt 172. The surface movement directions (rotational directions) of the film member cleaning brushes 182 may be configured to be the same as the surface movement direction of the endless belt 172; however, in that case, it is preferable that the rotational velocities of the film member cleaning brushes 182 be set such that linear velocities of the film member cleaning brushes 182 substantially differ form that of the endless belt 172. The residual foamed fixer Ba and the offset toner particles Ta removed by the brush fiber of the film member cleaning brushes 182 are brought into contact with the brush cleaning roller 183 so that the brush cleaning roller 183 can collect residual foamed fixer Ba and the offset toner particles Ta from the brush fiber of the film member cleaning brushes 182. In this process, the rotational directions of the brush cleaning roller 183 may be set regardless of the rotational directions of the film member cleaning brushes 182.

As illustrated in FIG. 26, the film member cleaning device 180 of the application member cleaning device 70 according to the third modification includes the film member cleaning brushes 182 arrange at two respective positions in the surface movement direction of the endless belt 172. In this configuration, one of the film member cleaning brushes (i.e., first film member cleaning brush) 182 is arranged at the upstream side in the surface movement direction of the endless belt 172 and is configured to actively clean the endless belt 172. The other one of the film member cleaning brushes (i.e., second film member cleaning brush) 182 is arranged at the downstream side in the surface movement direction of the endless belt 172 and is configured to rotationally clean a residual adhering matter on the endless belt 172 that fails to be removed by the first film member cleaning brush arranged at the upstream side in the surface movement direction of the endless belt 172, and collection products accumulated on the edge of the film member cleaning blade 181 arranged at the downstream side in the surface movement direction of the endless belt 172. Accordingly, the second film member cleaning brush 182 arranged at the downstream side in the surface movement direction of the endless belt 172 is configured to engage in the edge of the film member cleaning blade 181 arranged at the downstream side in the surface movement direction of the endless belt 172.

The brush cleaning roller 183 has a dedicated roller member cleaning blade 184 configured to collect the liquid fixer and toner from the brush cleaning roller 183 that have collected the liquid fixer and toner from the film member cleaning brushes 182. A material for the roller member cleaning blade 184 preferably includes swelling resistance to the liquid fixer, however, since the cleaning performance of approximately 100% may not have to be maintained, high-molecular polyethylene may be used as the material for the roller member cleaning blade 184. Further, when the application member cleaning device 70 is deactivated, respective members of the application member cleaning device 70 are preferably deactivated in the order of the surface movement of the endless belt 172, the rotations of the film member cleaning brushes 182, and the brush cleaning roller 183 so as to decrease the amount of the adhering matter such as toner on the surfaces of the respective members.

In the application member cleaning device 70 according to the third modification having the endless belt 172 as the film member, the defoaming heaters 94 configured to defoam the residual foamed fixer Ba with heat may preferably be arranged at positions facing the second stretching roller 174 via the endless belt 172 or at positions toward which the adhering matter removed by the film member cleaning device 180 drips. When the defoaming heaters 94 are arranged at the positions toward which the adhering matter drips, undefoamed adhering matter such as the undefoamed fixer that drips onto the defoaming heaters 94 may be defoamed with heat. Accordingly, the collected fixer is in a liquid form, thereby facilitating the handling of the collected fixer.

Note that the above application member cleaning device 70 is configured to include the belt-shaped film member configured to be brought into contact with the member subject to cleaning as a removing member while moving on the surface of the member subject to cleaning in a direction opposite to the surface movement direction of the member subject to cleaning, and a cleaning blade configured to abut on the surface of the member subject to cleaning via the film member at a position where the film member is brought into contact with the surface of the member subject to cleaning. The application member cleaning device 70 having this configuration may be applied to, but are not limited to, the cleaning device for the application member or the pressure member. That is, the application member cleaning device 70 having this configuration may not be necessarily be applied to the fixing device but can be applied to any cleaning devices that clean the surface of the member subject to cleaning.

The above application member cleaning device 70 of the fixing member 30 according to the embodiment includes a removing unit configured to remove the adhering matter such as the residual foamed fixer Ba and the offset toner particles on the surface of the application roller that is a member subject to cleaning. The removing unit of the application member cleaning device 70 includes the web 72 configured to be made rewindable and be brought into contact with the application roller 41 as the belt-shaped film member while moving on the surface of the application roller 41 in an opposite direction to the surface movement direction of the application roller 41, and the film abutting blade 71 configured to abut on the surface of the application roller 41 via the web 72 as a cleaning blade at an abutting position E where the web 72 is brought into contact with the application roller 41. With this configuration, the residual foamed fixer Ba and the offset toner particles Ta on the surface of the application roller 41 can be blocked at the abutting position E where the film abutting blade 71 abuts on the surface of the application roller 41 via the web 72 (i.e., abutting position E where the web 72 is brought into contact with the application roller 41). Then, extraneous matter including the residual foamed fixer Ba and the offset toner particles Ta on the surface of the application roller 41 can be removed at the abutting position E by winding the web 72 at an appropriate timing. Accordingly, it may be possible to prevent damage in the surface of the application roller 41 due to the residual foamed fixer Ba and the offset toner particles Ta continuously accumulated on the surface of the application roller 41 at the abutting position E where the film abutting blade 71 abuts on the surface of the application roller 41. In addition, it may be possible to prevent the defective cleaning due to the damage in the surface of the application roller 41. Thus, the residual foamed fixer Ba or the offset toner particles Ta may be removed from the surface of the application roller 41 for a long time in an excellent manner. Note that Japanese Patent Application No. 2009-000125 (proposed by the inventors of the present application) describes a cleaning device in which a web formed of nonwoven fabric attached on a PET film base is pressed by a pressure roller from a rear side thereof such that the surface of the web is pressed on the foamed fixer applied surface of the application roller. In the proposed cleaning device having the above configuration, the web is wound in a direction opposite to a rotating direction of a rotator such as the application roller, and the winding speed is slow. Accordingly, in this configuration, a web winding resistance can be reduced due to the low speed of winding the web and a sufficient nip width can be obtained by using a pressure roller. However, little amount of extraneous matter including the residual foamed fixer Ba and the offset toner particles Ta on the surface of the application roller 41 can be collected with the nonwoven fabric. Accordingly, in this cleaning device, a PET film alone is used instead of the web formed of the nonwoven fabric attached on the PET film base and a blade is used in place of the pressure roller to be pressed on the surface of the application roller in the same manner as the embodiment of the invention. As a result, an excellent cleaning performance can be obtained. Note that in this cleaning device, when the PET film is pressed from the rear side thereof by the pressure roller, such excellent cleaning performance is not exhibited. Thus, the high cleaning performance may result from the linear pressure obtained by the blade abutting on the application member. Further, since the PET film has solvent resistance to a softener used in the proposed cleaning device, the film abutting blade of the cleaning blade may be prevented from being affected by the fixer containing the softener. Accordingly, the materials for the blade may not be restricted in view of the solvent resistance to the softener contained in the fixer.

In the application member cleaning device 70 according to the embodiment, one of the surfaces of the web 72 that is brought in contact with the film abutting blade 71 may be surface roughened. In the application member cleaning device 70 according to the embodiment, a transparent PET film is used as the web 72. In this case, the flatness of the surface of the film member which is brought in contact with the application roller 4 is an important factor for affecting the cleaning performance. That is, slightly creased film member may adversely affect the cleaning performance of the application member cleaning device 70. The surface smoothness of the film member, which is brought into contact with the application roller 41, is a particularly important factor to maintain the cleaning performance of the application member cleaning device 70 in view of adverse effects of the above web formed of the nonwoven fiber and the crease. In addition, since a high linear pressure obtained by the film abutting blade 71 abutting on the application member exhibits the high cleaning performance, the surface roughness of the surface of the film member may play an important factor. It is preferable that the surface of the film member in contact with the film abutting blade 71 be surface roughened, because the adhesiveness between the film member and the film abutting blade 71 is reduced due to the surface roughness of the film member in contact with the film abutting blade 71, thereby improving the sliding properties between the film member and the film abutting blade 71. As a result, the winding resistance of the film member may be reduced. However, if the degree of the surface roughness of the film member is large, the use of the film member may be affected. Such an effect on the use of the film member may be reduced by decreasing the difference in the height between a recess and a projection of the film member to the thickness of the recess of the film member.

The application member cleaning device 70 includes the first guide roller 75 at the upstream side in the surface movement direction of the web 72 and the second guide roller 76 at the downstream side in the surface movement direction of the web 72 based on the abutting position E where the film abutting blade 71 abuts on the surface of the application roller 41 via the web 72. The film member may be prevented from creasing by being guided by the first and second guides. The first guide roller 75 and the second guide roller 76 are guide members configured to be in contact with the surface of the web 72 on which the film abutting blade 71 abuts so as to guide the web 72. In the application member cleaning device 70, the web 72 stretched by the first and second guide rollers 75 and 76 in parallel with a tangential line of the application roller 41 at the abutting position E is pressed from the rear side of the web 72 on the surface of the application roller 41 by the film abutting blade 71. With this configuration, the web 72 is efficiently fed from the progressive shaft 72 and wound up on the winding shaft 74. Accordingly, the first and second guide rollers 75 and 76 are arranged such that a straight line drawn between the first and second guide rollers 75 and 76 is in parallel with a tangential line of the application roller 41 at the abutting position E. Note that the first and second guide rollers 75 and 76 guide the web 72 from an inner peripheral side of the web 72, thereby widening the range of material selection for the guide members.

In the application member cleaning device 70 according to the embodiment, the film member is the windable web 72 that is fed from the progressive shaft 73 and is wound up on the winding shaft 74 after having passed through the abutting position E where the film abutting blade 71 abuts on the surface of the application roller 41. Alternatively, a tube-shaped endless film such as a seamless belt may be used in place of the web 72. In this case, the surface of the tube-shaped endless film may be repeatedly used while being cleaned at a different place from the cleaning position. However, it is difficult to find a cleaning device having a configuration capable of cleaning the toner that is liquefied with the liquid fixer and has high viscosity with the cleaning performance of approximately 100%. Such liquefied toner having high viscosity may, if left on the surface of the web **72*n* and passed through the cleaning position for the second time, result in the cleaning defect. In addition, a cleaning device configured to clean the residual foamed fixer Ba or the offset toner particles Ta accumulated on the surface of the endless film may be required. In the application member cleaning device 70 having such a cleaning device, since the residual foamed fixer Ba having high viscosity is constantly cleaned with a new portion of the endless film, a certain cleaning performance can be maintained under a predetermined condition. Note that in the cleaning device having characteristics of the application member cleaning device 70** according to the embodiment devised for cleaning dry toner, the endless film may be used so long as such a cleaning device is configured to sufficiently clean the residual foamed fixer Ba and the offset toner particles Ta accumulated on the surface of the endless belt.

Since the film member used in the application member cleaning device 70 according to the third modification is a loop-type endless belt 172 capable of endless moving, the number of film members disposed can be reduced. Further, since the endless belt 172 is repeatedly used, a cleaning mechanism of the film member cleaning device 180 configured to clean the endless belt 172 may be complex. However, since the film member cleaning device 180 can be arranged at a position distant from the abutting position E where the endless belt 172 is brought into contact with the application roller 41, the film member cleaning device 180, despite its complex configuration, can be incorporated in the application member cleaning device 70.

The film member cleaning device 180 incorporated in the application member cleaning device 70 according to the third modification includes the film member cleaning blade 181 that is the blade-shaped film member cleaning member configured to abut on the surface of the endless belt 172 to remove the adhering matter from the surface thereof. The film member cleaning device 180 further includes the two film member cleaning brushes 182 used as the film member cleaning member having a configuration differing from the blade-shaped film member cleaning member, one of which is arranged at a position more downstream in the surface movement direction of the endless belt 172 than the abutting position E and the other of which is arranged at a position more upstream in the surface movement direction of the endless belt 172 than the position where the film member cleaning blade 181 abuts on the endless belt 172. Such blade-shaped cleaning member has a high cleaning capability, however, is susceptible to sticking or damage if the extraneous matter is present or accumulated at the abutting position. Accordingly, in the application member cleaning device 70 according to the third modification, the film member cleaning members each having a configuration differing from the blade-shaped film member cleaning member, such as the film member cleaning brushes 182, may be used for initially cleaning the endless belt 172, and the film member cleaning blade 181 removes residual adhering matter that the film member cleaning brushes 182 have failed to clean.

The film member cleaning blade 181 of the application member cleaning device 70 according to the third modification includes solvent resistance to the fixer in the adhering matter subject to cleaning, and is made of a material that is not swollen with the fixer. Preferable examples of the film member cleaning blade 181 include, but not limited to, polyethylene terephthalate (PET), ethylene propylen dien monomer (EPDM), silicone rubber, fluorocarbon rubber, and super-high-molecular polyethylene. The film member cleaning blade 181 made of the above materials may have resistance to degradation so as to carry out a stable cleaning.

The film member cleaning device 180 incorporated in the application member cleaning device 70 according to the third modification includes the film member cleaning brushes 182 that are the rotational brush-shaped film member cleaning members configured to rotationally abut on the surface of the endless belt 172 to remove the adhering matters from the surface thereof. The film member cleaning device 180 further includes a brush cleaning roller 183 configured to be brought into contact with the surfaces of the film member cleaning brushes 182 to collect the adhering matter therefrom, and a blade-shaped roller member cleaning blade 184 configured to be brought into contact with the surface of the brush cleaning roller 183 to remove the adhering matter therefrom. With this configuration, the toner that may solidifies if left for a substantial amount of time and is softened with the liquid fixer can be reliably removed form the endless belt 172.

The film member cleaning device 180 incorporated in the application member cleaning device 70 according to the third modification includes plural film member cleaning brushes 182 arranged at plural positions in a endless moving direction of the endless belt 172 and configured to abut on the surface of the endless belt 172 at plural positions to remove the adhering matters from the surface thereof. With this configuration, the application member cleaning device 70 according to the third modification has high cleaning performances on the endless belt 172 at the plural positions where the plural film member cleaning brushes 182 are arranged, thereby carrying out reliable and stable cleaning.

The application member cleaning device 70 according to the embodiment includes the deviation detecting sensor 91 (see FIGS. 20, 21, and 23) that is a film end detecting unit configured to detect positions of the ends in a direction perpendicular to the surface movement direction of the web 72 at the downstream side in the surface movement direction of the web 72 based on the abutting position where the film abutting blade 71 abuts on the surface of the application roller 41 via the web 72. In the application member cleaning device 70 according to the embodiment, since part of the film member used for the web 72 is shielded, the deviation detecting sensor 91 can optically detect the positions of the ends of the web 72. Various amounts of the residual foamed fixer Ba, the offset toner Ta, and liquefied fixer obtained by the defoamation are randomly collected by the web 72, so that the web 72 having the various amounts of the residual foamed fixer Ba, the offset toner Ta, and the liquefied fixer is wound up on the winding shaft 74 in a non-uniform manner. This results in the meandering motion the web 72 or crease in the web 72 while winding. The crease may be prevented by providing the guide members to guide the web 72, however, those guide members are not effective for preventing the meandering motion the web 72 while winding. Thus, the meandering motion the web 72 may preferably be controlled while winding may be required. To provide such a control unit in the application member cleaning device 70 according to the embodiment, a wound condition of the web 72 may need to be detected. Accordingly, the deviation detecting sensor 91 may be configured to optically detect the ends of the web 72 and correct, when deviated from a predetermined range, the positions of the ends of the web 72. Since the web 72 is made of a transparent PET film, the end of the web 72 may be shielded regardless of reflective or transmission types to block light entering thererto. Note that if the deviation detecting sensor 91 is configured to detect the ends of the web 72 mechanically, a large amount of resistance is imposed on the thin film of the web 72 to crease the web 72 while detection of the ends thereof. The web 72 employed in the application member cleaning device 70 according to the embodiment may be provided with shielding patterns at their ends, so that the deviation detecting sensor 91 may detect the meandering motion the web 72 by detecting the shielding patterns provided at the ends of the web 72.

The application member cleaning device 70 according to the embodiment includes a slide guide hole 74*a* and a worm wheel 74*b* as a winding shaft shifting mechanism configured to shift the winding shaft 74 in a direction approximately perpendicular to the winding direction of the web 72 and adjust a position of an end of the winding shaft 74 based on a detected result from the deviation detecting sensor 91. With the winding shaft shifting mechanism composed of the slide guide hole 74*a* and the worm wheel 74*b*, the meandering motion the web 72 may be prevented by controlling the winding shaft 74 based on the detected result of the deviation detecting sensor 91. It is a general approach to shift the winding shaft 74 in the direction perpendicular to the winding direction of the film member and this approach is effective when using the web 72 as the film member to be wound on the winding shaft 74. However, the winding condition of the web 72 is not always constant compared with a related art web when used for the application member cleaning device. The winding condition constantly varies while winding the web 72 on which the residual foamed fixer Ba defoamed and the offset toner particles Ta liquefied are randomly adhere. Further, since the winding speed is extremely slow, it may be important to carry out predictive control based on the subtle change in position of the web 72.

The application roller 41 of the application member cleaning device 70 according to the embodiment is a surface moving member configured to carry the residual foamed fixer Ba containing the offset toner particles Ta on the surface thereof, and the web 72 is a film member made of a PET film having solvent resistance to the liquid fixer. Since the film member has the solvent resistance to the liquid fixer containing the softener, a cleaning blade arranged in the inner peripheral side of the loop of the web 72 may be protected, thereby widening the range of material selection for the members arranged in the inner peripheral side of the loop of the web 72. Further, since the web 72 itself does not deteriorate with the liquid fixer, break and deformation of the web 72 due to the tension while winding the web 72 on the winding shaft 74 may be prevented, thereby obtaining a stable winding condition in winding the web 72.

The application member cleaning device 70 according to the embodiment includes the application roller 41 that is the surface moving member configured to carry the residual foamed fixer Ba containing the offset toner particles Ta on the surface thereof, and the heater 93 that is a heating unit configured to heat a portion of the web 72 at downstream side in the surface movement direction of the web 72 based on the abutting position where the film abutting blade 71 abuts on the surface of the application roller 41 via the web 72. The application member cleaning device 70 according to the embodiment is configured such that the film abutting blade 71 presses the web 72 from the rear side thereof to abut on the surface of the application roller 41 via the web 72. With this configuration, the excellent cleaning performance in cleaning the offset toner particles Ta may be obtained. That is, in the application member cleaning device 70 according to the embodiment, the amount of the web 72 to be wound is significantly reduced as compared with the configuration of the cleaning device in Japanese Patent Application No. 2009-000125 proposed by the inventors of the present application. The inventors of the present application carried out an experiment in order to examine a difference in the amount of the web 72 to be wound between the application member cleaning device 70 according to the embodiment and according to the related art cleaning device in Japanese Patent Application No. 2009-000125 proposed by the inventors of the present application, and found that the amount of the web 72 to be wound on the winding shaft 74 in the application member cleaning device 70 according to the embodiment was 1/10 of that of the related art cleaning device in Japanese Patent Application No. 2009-000125. The inventors of the present application also found that consecutive printing was able to be carried out for 3 to 5 minutes after winding the web 72 in an amount of 10 mm, though the amount of toner and process linear speed may have affected the result. However, the cleaning performance may not determine the amount of the web 72 to be wound on the winding shaft 74 and the its winding speed. Even if the cleaning performance is high, it is preferable that the amount of the web 72 wound on the winding shaft 74 and the its winding speed be determined based on the amounts of the residual foamed fixer Ba or the offset toner particles Ta accumulated at the abutting position E. That is, even if the cleaning performance is high, but the amount of the web 72 to be wound on the winding shaft 74 is small or its winding speed is low, large amounts of the residual foamed fixer Ba and the offset toner particles Ta may be accumulated at the abutting position E. Since it takes a long time to defoam the residual foamed fixer Ba, the offset toner particles Ta accumulated at the abutting position E are likely to be lifted up by the residual foamed fixer Ba. The thus accumulated offset toner particles Ta lifted up by the residual foamed fixer Ba at the abutting position E exceeds a certain amount, an overflow of the offset toner particles Ta lifted up by the residual foamed fixer Ba are transferred to various components or places inside the fixing device 30, thereby contaminating the fixing device 30. Accordingly, it is preferable that the offset toner particles Ta and the residual foamed fixer Ba accumulated at the abutting position E be removed with the web 72 by winding the web 72 on the winding shaft 74 before the offset toner particles Ta lifted up by the residual foamed fixer Ba overflows. Moreover, if the residual foamed fixer Ba is collected without defoaming by the web 72, the portion of the foamed fixer Ba accumulated around the center in the width direction is less likely to spread out in the width direction of the web 72. As a result, it may be difficult to squeeze out the portion of the foamed fixer Ba from sides in the width direction of the web 72 by winding up on the winding shaft 74. Accordingly, the web 72 wound up on the winding shaft 74 has various thickness in places, which may cause the meandering motion and crease of the web 72. As described above, the foamed fixer Ba may require a long time for defoaming due to the characteristics of foam, which may discourage to wind the web 72 on the winding shaft 74. However, when the residual foamed fixer Ba and the offset toner particles Ta are accumulated at the abutting position E but the web 72 is not wound on the winding shaft 74, the overflow of the offset toner particles Ta lifted up by the residual foamed fixer Ba may not be prevented. Thus, it is preferable that the residual foamed fixer Ba blocked by the film abutting blade 71 be liquefied. The residual foamed fixer Ba may be defoamed by heating. The application member cleaning device 70 according to the embodiment includes the heater 93 (see FIGS. 20 and 21) configured to heat the residual foamed fixer Ba via the web 72. Accordingly, the residual foamed fixer Ba blocked by the film abutting blade 71 may be defoamed by heating and the liquefied fixer may be collected. Therefore, the offset toner particles Ta lifted up by the residual foamed fixer Ba may be prevented from overflowing.

In the application member cleaning device 70 according to the embodiment, the heater 93 is provided inside the second guide roller 76 used as the guide member to heat the web 72 via the second guide roller 76. A heating unit may be arranged at different positions; however, the heating unit provided inside the guide member in contact with web 72 may efficiently heat the web 72. The inventors of the present application carried out an experiment in order to examine temperatures at which the residual foamed fixer Ba defoamed. The result showed that the residual foamed fixer Ba defoamed to be liquefied at temperatures in a range of 40 to 50° C. The residual foamed fixer Ba defoams more quickly as the temperature of the heater gets higher. However, if the amount of the residual foamed fixer Ba is large, a portion of the residual foamed fixer Ba having a large thickness on the web 72 fails to be defoamed, despite the fact that a portion of the residual foamed fixer Ba around a portion of the web 72 near the heat source (around a portion of the web 72 in contact with the heater) was defoamed. In order to defoam the residual foamed fixer Ba having a large thickness on the web 72, the temperature of the heater may need increasing. However, if once liquefied fixer is present between the residual foamed fixer Ba and the foamed fixer Bu on the web, the temperature of the heater may need to be raised at temperatures where the foamed fixer Bu is defoamed. When the thickness of the residual foamed fixer Ba on the web exceeds 10 mm, the surface of the web 72 that is in contact with the foamed fixer Ba may need to be heated to 100° C. or more. Accordingly, it is preferable that amount of the web 72 to be wound on the winding shaft 74 and its winding speed be set such that the residual foamed fixer Ba having a small thickness of 3 to 5 mm rather than having a large thickness can be removed by winding the web 72 on the winding shaft 74 based on the amount of the residual foamed fixer Ba and the offset toner particles Ta blocked at the abutting position E. Although temperature and winding conditions need to be wet, the application member cleaning device 70 according to the embodiment having the heater 93 as a heating unit is capable of defoaming the residual foamed fixer Ba more quickly than the application member cleaning device without the heating unit.

The temperature of the heater 93 in the application member cleaning device 70 according to the embodiment is controlled by a thermistor 92 configured to heat the web 72 made of a resin film at heatresistant temperatures of the resin film or lower. There is a significant effect on defoaming the residual foamed fixer Ba by heating with the heater 93. However, setting the heater 93 at high temperatures may not always exhibit the effect. If the temperature of the heater 93 is set at too high, advantages of using the nonthermal fixing type fixing device may decrease. Moreover, the high temperature may provide an adverse effect on peripheral components of the heater 93 of the application member cleaning device 70 in the fixing device 30. Accordingly, the temperature to heat the web 72 (or residual foamed fixer Ba) is preferably set at a temperature equal to or fewer than heatresistant temperatures peripheral components of the heater 93. The heatresistant temperature of urethane rubber used for the film abutting blade 71 of the application member cleaning device 70 is approximately 80° C., and that of a PET film used for the web 72 is approximately 85° C. Accordingly, in the application member cleaning device 70 according to the embodiment, the thermistor 92 is arranged on the surface of the second guide roller 76 so as to control the surface temperature of the second guide roller 76 to be 60° C. or lower.

Further, in the configuration example illustrated in FIG. 23, the application member cleaning device 70 according to the embodiment includes the application roller 41 is a surface moving member configured to carry the residual foamed fixer Ba containing the offset toner particles Ta on the surface thereof, and the defoaming heater 94 that is a heating unit configured to heat the residual foamed fixer Ba on the surface of the web 72 facing the surface of the application roller 41 at the downstream side in the surface movement direction side of the web 72. With this configuration illustrated in FIG. 23, the residual foamed fixer Ba may securely be defoamed by the application of heat compared to the configuration in which the heater 93 is provided inside the second guide roller illustrated in FIGS. 20 and 21.

Further, with this configuration illustrated in FIG. 23, since the defoaming heater 94 is arranged between the web 72 and the fixer collecting tray 77 in order for the fixer collecting tray 77 to collect the adhering matter dripped from the surface of the web 72, the surface of the defoaming heater 94 susceptible to the adhering matter is treated to have resistance to the adhering matter. For example, if a self-control heater is used, a surface of the self-control heater exposed outside is covered with silicon rubber that has solvent resistance to the liquid fixer used in the embodiment of the present invention. Thus, portions of the residual foamed fixer Ba that have failed to be defoamed and dripped from the surface of the web 72 can be defoamed with heating by arranging the defoaming heater 94 between the web 72 and the fixer collecting tray 72. Further, the surface of the defoaming heater 94 has the solvent resistance to the liquid fixer, defoaming of the residual foamed fixer Ba can stably be carried out.

Further, the fixing device 30 according to the embodiment includes a fixer supply unit 130 used as a fixer foaming unit configured to generate foamed fixer Bu by dispersing bubbles in the liquid fixer 31*a* that contains the softener to soften part of resin particulates by dissolving or swelling at least part of resin particulates, and the fixer application unit 140 used as a foamed fixer application unit configured to apply the foamed fixer Bu to the transfer sheet P that carries the toner layer T of a resin particulate layer composed of the resin particulates. In the fixing device according to the embodiment, the unfixed toner layer T may be fixed on the transfer sheet P by applying the foamed fixer Bu over the toner particles forming the toner layer T to be softened.

The fixing device 30 according to the embodiment further includes the application member cleaning device 70 and the pressure member cleaning device 80 as the cleaning unit configured to clean portions of the foamed fixer Bu generated by the fixer supply unit 130 that are not transferred onto the transfer sheet P but remain on the surfaces of two surface moving members including the application roller 41 and the pressure roller 43. The use of the foamed fixer makes it possible to apply a small amount of liquid fixer to the toner image on the transfer sheet P and prevent the toner offset at the same time. However, if the foamed fixer Bu that are not transferred onto the transfer sheet P at the application nip C remains on the application roller 41 (i.e., residual foamed fixer Ba), a new foamed fixer Bu is mixed with the residual foamed fixer Ba, thereby inhibiting an appropriate fixing of the toner image on the transfer sheet P. Further, the foamed fixer Bu remaining adhered to the pressure roller 43 (i.e., residual foamed fixer Ba) may, if not cleaned, transferred onto the rear face of the transfer sheet P, which may further be transferred and attached onto the components inside the fixing device 30. However, since the fixing device 30 according to the embodiment includes the application member cleaning device 70 and the pressure member cleaning device 80 that are capable of cleaning the application roller 41 and the pressure roller 43 for a long time in an excellent manner, it may be possible to prevent defect or defective operations of the components of the fixing device 30 due to the foamed fixer Bu remaining on the surfaces of the application roller and the pressure roller 43 (i.e., residual foamed fixer).

Further, the fixer application unit 140 used as the foamed fixer application unit in the fixing device 30 according to the embodiment includes the application roller 41 used as the application member configured to apply the foamed fixer Bu supplied on the surface thereof to the surface of the transfer sheet P at the application nip C that is the application position facing the transfer sheet P subject to foamed fixer Bu application, and the application member cleaning device 70 used as the application member cleaning unit configured to clean the residual foamed fixer Ba that is the portion of the foamed fixer Bu remaining on the surface of the application roller 41 after having passed through the application nip. The offset toner particles Ta and the residual foamed fixer Ba transferred by the application member cleaning device 70 that have reached a cleaning position where they are removed are softened and deformed. Since the offset toner particles Ta have high viscosity and little flowability, they remain adhered and solidified on the cleaning member once they have attached on the cleaning member at the abutting position E. However, in the application member cleaning device 70, the offset toner particles Ta remaining adhered on the web 72 are forcefully removed at the abutting position E by surface movement of the web 72. Therefore, it may be possible to prevent defect or defective operations of the components of the application member cleaning device 70 due to the solidified offset toner particles Ta. Further, since the components such as the film abutting blade used as the cleaning blade that may have an adversely effect when being in contact with the liquid fixer are arranged inside the loop of the web 72 in the application member cleaning device 70, it may be possible to prevent defect or defective operations caused by bringing the components into contact with the liquid fixer.

The printer 100 used as an image forming apparatus according to the embodiment includes a process unit 3 that is a toner image forming unit configured to form the toner layer T on the surface of the transfer sheet P used as a recording medium with toner containing resin particulates composed of resin and colorants, a fixing unit configured to fix a toner image on the surface of the transfer sheet P. In the printer 100, the fixing device 30 according to the embodiment is used as the above fixing unit. Since the residual foamed fixer Ba and the offset toner particles Ta on the application roller 41 may be collected in an excellent manner in the fixing device 30, it may be possible to prevent fixing defect or image quality degradation due to the residual foamed fixer Ba and the offset toner particles Ta remaining on the surface of the application roller 41 in the printer 100. Thus, the printer 100 according to the embodiment can form an image on the recording medium in an excellent manner. Further, since the fixing device 30 is the nonthermal fixing type fixing device, the fixing device 30 is capable of saving a large amount of energy compared to the thermal type fixing device.

In the fixing device according to embodiment, the adhering matter on the surface of the member subject to cleaning is accumulated at the abutting position where the cleaning blade abuts on the surface of the member subject to cleaning via the film member, and the accumulated adhering matter at the abutting position can be removed by causing the film member to surface move at an appropriate timing. Accordingly, it is possible to prevent damage on the surface of the member subject to cleaning due to the adhering matter accumulated at the abutting position between the member subject to cleaning and the cleaning blade, thereby preventing defective cleaning due to the damage on the surface of the member subject to cleaning. With this configuration, the adhering matter on the surface of the member subject to cleaning can be constantly removed for a long time in an excellent manner.

The descriptions of exemplary embodiments for implementing the invention have been provided heretofore. The present invention is not limited to these embodiments, but various variations and modifications may be made without departing from the scope of the present invention.

The present application is based on Japanese priority application No. 2009-162607 filed on Jul. 9, 2009, and Japanese priority application No. 2010-032371 filed on Feb. 17, 2010, with the Japanese Patent Office, the entire contents of which are hereby incorporated by reference.

What is claimed is:

1. A cleaning device for removing adhering matter from a surface of a member subject to cleaning, the cleaning device comprising:

a belt-shaped film member arranged in a stretched configuration capable of being endlessly moved in a direction opposite to a surface movement direction of the member subject to cleaning while being in contact with the surface of the member subject to cleaning;

a cleaning blade configured to abut on the surface of the member subject to cleaning via the belt-shaped film member at a position where the belt-shaped film member is brought into contact with the member subject to cleaning; and a film member cleaning unit configured to remove adhering matter on a surface of the belt-shaped film member, wherein:

the belt-shaped film member is an endless belt-shaped film member capable of moving endlessly, and the film member cleaning unit removes the adhering matter from a surface of the endless belt-shaped film member at a position distant from a position where the endless belt-shaped film member is brought into contact with the member subject to cleaning, the film member cleaning unit includes a film member cleaning blade that is a blade-shaped film member cleaning member configured to abut on the surface of the endless belt-shaped film member to remove the adhering matter from the surface thereof, and nonblade-shaped film member cleaning members having configurations differing from the blade-shaped film member cleaning member, one of which is arranged at a downstream position closest to the position where the endless belt-shaped film member is brought into contact with the member subject to cleaning in a surface movement direction of the endless belt-shaped film member, and the other of which is arranged at an upstream position closest to a position where the film member cleaning blade abuts on the endless belt-shaped film member in the surface movement direction of the endless belt-shaped film member.

2. The cleaning device as claimed in claim 1, wherein the belt-shaped film member includes two surfaces, and one of the two surfaces that is brought into contact with the cleaning blade is surface roughened.

3. The cleaning device as claimed in claim 1, further comprising:

first and second guide members configured to support the belt-shaped film member at an upstream side and a downstream side, respectively, in a surface movement direction of the belt-shaped film member based on an abutting position where the cleaning blade abuts on the surface of the member subject to cleaning via the belt-shaped film member, the first and second guide members being in contact with a same surface of the belt-shaped film member on which the cleaning blade abuts.

4. The cleaning device as claimed in claim 1, wherein:

the film member cleaning unit includes rotational brush-shaped film member cleaning brushes configured to rotationally remove the adhering matter from the surface of the endless belt-shaped film member by allowing brush fiber of the film member cleaning brushes to be in contact with the surface of the endless belt-shaped film member;

a brush cleaning roller configured to bring a surface thereof into contact with the rotational brush-shaped film member cleaning brushes to collect adhering matter from the rotational brush-shaped film member cleaning brushes; and a blade-shaped roller member cleaning blade configured to abut on the surface of the brush cleaning roller to remove the adhering matter therefrom.

5. The cleaning device as claimed in claim 1, further comprising:

a film end detecting unit configured to detect positions of ends of the belt-shaped film member in a width direction perpendicular to a surface movement direction of the belt-shaped film member at an upstream side or a downstream side thereof based on an abutting position where the cleaning blade abuts on the surface of the member subject to cleaning via the belt-shaped film member.

6. The cleaning device as claimed in claim 1, wherein the member subject to cleaning is a surface moving member configured to carry a fixer on the surface thereof, the fixer containing a softener that softens resin particulates by dissolving or swelling at least part of resin in the resin particulates, and the belt-shaped film member has a solvent resistance to the fixer.

7. The cleaning device as claimed in claim 1, further comprising:

a heating unit configured to heat the belt-shaped film member at a downstream side in the surface movement direction of the film member based on an abutting position where the cleaning blade abuts on the surface of the member subject to cleaning via the belt-shaped film member, wherein the member subject to cleaning is a surface moving member configured to carry a foamed fixer on the surface thereof, and the heating unit heats the belt-shaped film member to the surface of which the foamed fixer is transferred from the member subject to cleaning at the downstream side in the surface movement direction of the belt-shaped film member based on the abutting position where the cleaning blade abuts on the surface of the member subject to cleaning via the belt-shaped film member.

8. The cleaning device as claimed in claim 7, further comprising:

a guide member configured to support the belt-shaped film member at a downstream side in the surface movement direction of the belt-shaped film member based on an abutting position where the cleaning blade abuts on the surface of the member subject to cleaning via the belt-shaped film member, the guide member being in contact with a same surface of the belt-shaped film member on which the cleaning blade abuts, wherein the heating unit heats the belt-shaped film member via the guide member.

9. The cleaning device as claimed in claim 1, further comprising:

a heating unit configured to heat the belt-shaped film member at a downstream side in the surface movement direction of the belt-shaped film member based on an abutting position where the cleaning blade abuts on the surface of the member subject to cleaning via the belt-shaped film member, wherein the member subject to cleaning is a surface moving member configured to carry a foamed fixer on the surface thereof, and the heating unit heats, when the foamed fixer is transferred to a surface of the belt-shaped film member from the surface of the member subject to cleaning, the foamed fixer at a position facing the surface of the belt-shaped film member that is brought into contact with the surface of the member subject to cleaning and at the downstream side in the surface movement direction of the belt-shaped film member based on the abutting position where the cleaning blade abuts on the surface of the member subject to cleaning via the belt-shaped film member.

10. A fixing device comprising:

a fixer foaming unit configured to generate a foamed fixer by dispersing bubbles in a liquid fixer containing a softener to soften resin particulates by dissolving or swelling at least part of resin in the resin particulates;

a foamed fixer application unit configured to include a surface moving member carrying the foamed fixer and apply the foamed fixer on a surface of a recording medium on which a resin particulate layer formed of the resin particulates is carried so as to soften the resin particulates to be fixed thereon; and the cleaning device as claimed in claim 1 as a cleaning unit configured to clean a portion of the foamed fixer generated by the fixer foaming unit that is not applied on the surface of the recording medium but remains on the surface moving member.

11. An image forming apparatus comprising:

a toner image forming unit configured to form a toner image on a recording medium with toner containing resin particulates composed of resin and colorants; and the fixing device as claimed in claim 10 as a fixing unit configured to apply a foamed fixer on a surface of a toner image carrier carrying the toner image to be transferred on the recording medium or a surface of the recording medium carrying the toner image so as to fix the toner image on the recording medium.

* * * * *